US010512374B2

(12) United States Patent
Conrad

(10) Patent No.: US 10,512,374 B2
(45) Date of Patent: Dec. 24, 2019

(54) SURFACE CLEANING APPARATUS WITH DIFFERENT CLEANING CONFIGURATIONS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 246 days.

(21) Appl. No.: 15/660,003

(22) Filed: Jul. 26, 2017

(65) Prior Publication Data

US 2017/0319024 A1 Nov. 9, 2017

Related U.S. Application Data

(63) Continuation of application No. 14/307,335, filed on Jun. 17, 2014, now Pat. No. 9,801,511, which is a (Continued)

(30) Foreign Application Priority Data

Mar. 13, 2009 (CA) ..... 2658381
Jul. 30, 2009 (CA) ..... 2674761

(51) Int. Cl.

| | |
|---|---|
| ***A47L 5/22*** | (2006.01) |
| ***A47L 5/24*** | (2006.01) |
| ***A47L 5/28*** | (2006.01) |
| ***A47L 9/00*** | (2006.01) |
| ***A47L 9/16*** | (2006.01) |
| ***A47L 9/24*** | (2006.01) |

(Continued)

(52) U.S. Cl.

CPC ..... *A47L 5/225* (2013.01); *A47L 5/24* (2013.01); *A47L 5/28* (2013.01); *A47L 5/36* (2013.01); *A47L 9/0018* (2013.01); *A47L 9/0027* (2013.01); *A47L 9/0045* (2013.01); *A47L 9/16* (2013.01); *A47L 9/242* (2013.01); *A47L 9/248* (2013.01); *A47L 9/325* (2013.01); *A47L 11/38* (2013.01)

(58) Field of Classification Search

CPC ..... A47L 5/28; A47L 9/1616; A47L 9/149; A47L 9/2857; A47L 9/22; A47L 9/1641; A47L 9/1625; A47L 9/00; A47L 5/24; A47L 9/2884; A47L 9/12; A47L 9/1608; A47L 9/2842

USPC ..... 15/344, 353

See application file for complete search history.

(56) References Cited

U.S. PATENT DOCUMENTS 2,071,975 A 2/1937 Holm-Hansen et al.
2,533,057 A 12/1950 Senne
(Continued)

FOREIGN PATENT DOCUMENTS

CA 1218962 A1 3/1987
CA 2241644 C 12/2007
(Continued)

OTHER PUBLICATIONS

International Search Report received on the corresponding International Application No. PCT/CA2010/000366 dated Jun. 16, 2010.
(Continued)

*Primary Examiner* — David Redding
(74) *Attorney, Agent, or Firm* — Philip C. Mendes da Costa; Bereskin & Parr LLP/S.E.N.C.R.L., s.r.l.

(57) ABSTRACT

A reconfigurable surface cleaning apparatus is provided.

11 Claims, 39 Drawing Sheets

Related U.S. Application Data continuation of application No. 13/255,889, filed as application No. PCT/CA2010/000366 on Mar. 12, 2010, now Pat. No. 9,066,642.

(51) Int. Cl.

| | |
|---|---|
| ***A47L 9/32*** | (2006.01) |
| ***A47L 5/36*** | (2006.01) |
| *A47L 11/38* | (2006.01) |

(56) References Cited

U.S. PATENT DOCUMENTS

| | | | |
|---|---|---|---|
| 2,542,634 | A | 2/1951 | Davis et al. |
| 2,559,384 | A | 7/1951 | Anderson |
| 2,621,756 | A | 12/1952 | Senne |
| 2,632,524 | A | 3/1953 | Senne |
| 2,913,111 | A | 11/1959 | Rogers |
| 2,942,691 | A | 6/1960 | Dillon |
| 3,015,122 | A | 1/1962 | Cook |
| 3,130,157 | A | 4/1964 | Kelsall |
| 3,200,568 | A | 8/1965 | McNeil |
| 3,310,828 | A | 3/1967 | Clark et al. |
| 3,320,727 | A | 5/1967 | Farley et al. |
| 3,356,334 | A | 12/1967 | Domer |
| 3,457,744 | A | 7/1969 | Bisbing |
| 3,530,649 | A | 9/1970 | Prosch et al. |
| 3,582,616 | A | 6/1971 | Wrob |
| 3,822,533 | A | 7/1974 | Oranje |
| 3,898,068 | A | 8/1975 | McNeil et al. |
| 3,988,132 | A | 10/1976 | Oranje |
| 3,988,133 | A | 10/1976 | Schady |
| 4,187,088 | A | 2/1980 | Hodgson |
| 4,236,903 | A | 12/1980 | Malmsten |
| 4,373,228 | A | 2/1983 | Dyson |
| 4,393,536 | A | 7/1983 | Tapp |
| 4,443,910 | A | 4/1984 | Fitzwater |
| 4,573,236 | A | 3/1986 | Dyson |
| 4,635,315 | A | 1/1987 | Kozak |
| 4,826,515 | A | 5/1989 | Dyson |
| 4,831,685 | A | 5/1989 | Bosy et al. |
| 4,836,515 | A | 6/1989 | Franz et al. |
| 5,054,157 | A | 10/1991 | Werner et al. |
| 5,078,761 | A | 1/1992 | Dyson |
| 5,129,125 | A | 7/1992 | Gamou et al. |
| 5,230,722 | A | 7/1993 | Yonkers |
| 5,287,591 | A | 2/1994 | Rench et al. |
| 5,309,600 | A | 5/1994 | Weaver et al. |
| 5,309,601 | A | 5/1994 | Hampton et al. |
| 5,524,321 | A | 6/1996 | Weaver et al. |
| 5,715,566 | A | 2/1998 | Weaver et al. |
| 5,836,047 | A | 11/1998 | Lee et al. |
| 5,842,254 | A | 12/1998 | Lee |
| 5,858,038 | A | 1/1999 | Dyson et al. |
| 6,058,559 | A | 5/2000 | Yoshimi et al. |
| 6,070,291 | A | 6/2000 | Bair et al. |
| 6,081,961 | A | 6/2000 | Wang |
| 6,085,382 | A | 7/2000 | Bobrosky et al. |
| 6,210,469 | B1 | 4/2001 | Tokar |
| 6,221,134 | B1 | 4/2001 | Conrad et al. |
| 6,228,260 | B1 | 5/2001 | Conrad et al. |
| 6,231,645 | B1 | 5/2001 | Conrad et al. |
| 6,251,296 | B1 | 6/2001 | Conrad et al. |
| 6,256,832 | B1 | 7/2001 | Dyson |
| 6,295,692 | B1 | 10/2001 | Shideler |
| 6,406,505 | B1 | 6/2002 | Oh et al. |
| 6,440,197 | B1 | 8/2002 | Conrad et al. |
| 6,463,622 | B2 | 10/2002 | Wright et al. |
| 6,531,066 | B1 | 3/2003 | Saunders et al. |
| 6,553,612 | B1 | 4/2003 | Dyson et al. |
| 6,560,818 | B1 | 5/2003 | Hasko |
| 6,581,239 | B1 | 6/2003 | Dyson et al. |
| 6,599,338 | B2 | 7/2003 | Oh et al. |
| 6,623,539 | B2 | 9/2003 | Lee et al. |
| 6,736,873 | B2 | 5/2004 | Conrad et al. |
| 6,746,500 | B1 | 6/2004 | Park et al. |
| 6,782,583 | B2 | 8/2004 | Oh |
| 6,782,585 | B1 | 8/2004 | Conrad et al. |
| 6,833,015 | B2 | 12/2004 | Oh et al. |
| 6,848,146 | B2 | 2/2005 | Wright et al. |
| 6,874,197 | B1 | 4/2005 | Conrad et al. |
| 6,902,596 | B2 | 6/2005 | Conrad et al. |
| 7,131,165 | B2 | 11/2006 | Wright et al. |
| 7,146,681 | B2 | 12/2006 | Wright et al. |
| 7,160,346 | B2 | 1/2007 | Park |
| 7,222,393 | B2 | 5/2007 | Kaffenberger et al. |
| 7,377,008 | B2 | 5/2008 | Park et al. |
| 7,381,234 | B2 | 6/2008 | Oh |
| 7,386,916 | B2 | 6/2008 | Bone |
| 7,448,363 | B1 | 11/2008 | Rasmussen et al. |
| 7,485,164 | B2 | 2/2009 | Jeong et al. |
| 7,488,362 | B2 | 2/2009 | Jeong et al. |
| 7,547,338 | B2 | 6/2009 | Kim et al. |
| 7,581,286 | B2 | 9/2009 | Choi |
| 7,594,296 | B2 | 9/2009 | Park |
| 7,604,675 | B2 | 10/2009 | Makarov et al. |
| 7,624,475 | B2 | 12/2009 | Choi |
| 7,645,309 | B2 | 1/2010 | Jeong et al. |
| 7,645,311 | B2 | 1/2010 | Oh et al. |
| 7,686,858 | B2 | 3/2010 | Oh |
| 7,882,592 | B2 | 2/2011 | Hwang et al. |
| 7,887,612 | B2 | 2/2011 | Conrad |
| 7,922,794 | B2 | 4/2011 | Morphey |
| 7,934,286 | B2 | 5/2011 | Yoo et al. |
| 7,979,953 | B2 | 7/2011 | Yoo |
| 8,032,981 | B2 | 10/2011 | Yoo |
| 8,032,983 | B2 | 10/2011 | Griffith et al. |
| 8,100,999 | B2 | 1/2012 | Ashbee et al. |
| 8,127,398 | B2 | 3/2012 | Conrad |
| 8,166,607 | B2 | 5/2012 | Conrad |
| 8,191,203 | B2 | 6/2012 | Yoo |
| 8,359,705 | B2 | 1/2013 | Conrad |
| 8,468,646 | B2 | 6/2013 | Yoo |
| 8,484,799 | B2 | 7/2013 | Conrad |
| 8,528,160 | B2 | 9/2013 | Conrad |
| 8,769,767 | B2 | 7/2014 | Conrad |
| 9,015,899 | B2 | 4/2015 | Conrad |
| 2002/0011053 | A1 | 1/2002 | Oh |
| 2002/0062531 | A1 | 5/2002 | Oh |
| 2002/0134059 | A1 | 9/2002 | Oh |
| 2002/0162188 | A1 | 11/2002 | Harmen |
| 2002/0178535 | A1 | 12/2002 | Oh et al. |
| 2002/0178698 | A1 | 12/2002 | Oh et al. |
| 2002/0178699 | A1 | 12/2002 | Oh |
| 2003/0046910 | A1 | 3/2003 | Lee |
| 2003/0066273 | A1 | 4/2003 | Choi et al. |
| 2003/0158238 | A1 | 8/2003 | Hale et al. |
| 2003/0159411 | A1 | 8/2003 | Hansen et al. |
| 2004/0010885 | A1 | 1/2004 | Hitzelberger et al. |
| 2004/0025285 | A1 | 2/2004 | McCormick et al. |
| 2004/0163201 | A1 | 8/2004 | Murphy et al. |
| 2005/0198769 | A1 | 9/2005 | Lee et al. |
| 2005/0252179 | A1 | 11/2005 | Oh et al. |
| 2006/0037172 | A1 | 2/2006 | Choi |
| 2006/0042206 | A1 | 3/2006 | Arnold et al. |
| 2006/0080947 | A1 | 4/2006 | Lee et al. |
| 2006/0123590 | A1 | 6/2006 | Fester et al. |
| 2006/0137304 | A1 | 6/2006 | Jeong et al. |
| 2006/0137305 | A1 | 6/2006 | Jung |
| 2006/0137306 | A1 | 6/2006 | Jeong et al. |
| 2006/0137309 | A1 | 6/2006 | Jeong et al. |
| 2006/0137314 | A1 | 6/2006 | Conrad et al. |
| 2006/0156699 | A1 | 7/2006 | Kim |
| 2006/0162298 | A1 | 7/2006 | Oh et al. |
| 2006/0162299 | A1 | 7/2006 | North |
| 2006/0168922 | A1 | 8/2006 | Oh |
| 2006/0168923 | A1 | 8/2006 | Lee et al. |
| 2006/0207055 | A1 | 9/2006 | Ivarsson et al. |
| 2006/0207231 | A1 | 9/2006 | Arnold |
| 2006/0230715 | A1 | 10/2006 | Oh et al. |
| 2006/0230723 | A1 | 10/2006 | Kim et al. |
| 2006/0230724 | A1 | 10/2006 | Han et al. |
| 2006/0230726 | A1 | 10/2006 | Oh |
| 2006/0236663 | A1 | 10/2006 | Oh |
| 2006/0278081 | A1 | 12/2006 | Han et al. |

(56) References Cited

U.S. PATENT DOCUMENTS

| | | | |
|---|---|---|---|
| 2007/0012002 | A1 | 1/2007 | Oh et al. |
| 2007/0012003 | A1 | 1/2007 | Oh et al. |
| 2007/0039120 | A1 | 2/2007 | Chi |
| 2007/0067944 | A1 | 3/2007 | Kitamura et al. |
| 2007/0079473 | A1 | 4/2007 | Min |
| 2007/0079584 | A1 | 4/2007 | Kim |
| 2007/0079585 | A1 | 4/2007 | Oh |
| 2007/0079587 | A1 | 4/2007 | Kim |
| 2007/0084161 | A1 | 4/2007 | Yoo |
| 2007/0095028 | A1 | 5/2007 | Kim |
| 2007/0095029 | A1 | 5/2007 | Min |
| 2007/0226947 | A1 | 10/2007 | Kang |
| 2007/0251048 | A1 | 11/2007 | Choi |
| 2007/0271724 | A1 | 11/2007 | Hakan |
| 2007/0289085 | A1 | 12/2007 | Yoo |
| 2007/0289089 | A1 | 12/2007 | Yacobi |
| 2007/0289264 | A1 | 12/2007 | Oh |
| 2008/0047091 | A1 | 2/2008 | Nguyen |
| 2008/0083085 | A1 | 4/2008 | Genn |
| 2008/0134462 | A1 | 6/2008 | Jansen et al. |
| 2008/0172821 | A1 | 7/2008 | Kang et al. |
| 2008/0172995 | A1 | 7/2008 | Conrad |
| 2008/0178416 | A1 | 7/2008 | Conrad |
| 2008/0178420 | A1 | 7/2008 | Conrad |
| 2008/0196196 | A1 | 8/2008 | Conrad |
| 2009/0031522 | A1 | 2/2009 | Yoo et al. |
| 2009/0044371 | A1 | 2/2009 | Yoo et al. |
| 2009/0144929 | A1 | 6/2009 | Yoo |
| 2010/0005611 | A1 | 1/2010 | Hong et al. |
| 2010/0043170 | A1 | 2/2010 | Ni |
| 2010/0071153 | A1 | 3/2010 | Genn |
| 2010/0095476 | A1 | 4/2010 | Kim et al. |
| 2010/0162515 | A1 | 7/2010 | Stephens |
| 2010/0175217 | A1 | 7/2010 | Conrad |
| 2010/0175219 | A1 | 7/2010 | Soen et al. |
| 2010/0229322 | A1 | 9/2010 | Conrad |
| 2010/0229336 | A1 | 9/2010 | Conrad |
| 2010/0229338 | A1 | 9/2010 | Conrad |
| 2010/0242222 | A1 | 9/2010 | Conrad |
| 2011/0023262 | A1 | 2/2011 | Conrad |
| 2011/0219573 | A1 | 9/2011 | Conrad |
| 2011/0314629 | A1 | 12/2011 | Conrad |
| 2012/0000030 | A1 | 1/2012 | Conrad |
| 2012/0159734 | A1 | 6/2012 | Fujiwara |
| 2012/0222239 | A1 | 9/2012 | Conrad |
| 2012/0222245 | A1 | 9/2012 | Conrad |
| 2012/0272472 | A1 | 11/2012 | Conrad |
| 2013/0091660 | A1 | 4/2013 | Smith |
| 2013/0091661 | A1 | 4/2013 | Smith |
| 2013/0091812 | A1 | 4/2013 | Smith |
| 2013/0091813 | A1 | 4/2013 | Smith |
| 2013/0104335 | A1 | 5/2013 | Conrad |
| 2014/0237768 | A1 | 8/2014 | Conrad |
| 2016/0367094 | A1 | 12/2016 | Conrad |

FOREIGN PATENT DOCUMENTS

| | | | |
|---|---|---|---|
| CA | 2675723 | A1 | 6/2008 |
| CA | 2658005 | A1 | 9/2010 |
| CA | 2658014 | A1 | 9/2010 |
| CA | 2658381 | A1 | 9/2010 |
| CA | 2658651 | A1 | 9/2010 |
| CA | 2659212 | A1 | 9/2010 |
| CA | 2674056 | A1 | 9/2010 |
| CA | 2678119 | A1 | 9/2010 |
| CA | 2755305 | C | 9/2010 |
| CA | 2755307 | C | 9/2010 |
| CA | 2730689 | A1 | 9/2011 |
| CA | 2574291 | C | 8/2013 |
| CA | 2677530 | C | 1/2014 |
| CA | 2674761 | C | 10/2016 |
| CA | 2674758 | C | 2/2017 |
| CN | 2524655 | Y | 12/2002 |
| CN | 2534954 | Y | 2/2003 |
| CN | 1765283 | A | 5/2006 |
| CN | 1806741 | A | 7/2006 |
| CN | 201101488 | Y | 8/2008 |
| CN | 101288572 | | 10/2008 |
| CN | 101357051 | A | 2/2009 |
| CN | 101448447 | A | 6/2009 |
| CN | 101061932 | A | 10/2010 |
| CN | 101631494 | B | 4/2012 |
| CN | 202699035 | U | 1/2013 |
| DE | 3734355 | A1 | 4/1988 |
| DE | 112010001135 | T5 | 8/2012 |
| EP | 489468 | A1 | 6/1992 |
| EP | 887040 | B1 | 9/2003 |
| EP | 966912 | B1 | 9/2003 |
| EP | 1674009 | B1 | 6/2012 |
| EP | 2201875 | B1 | 4/2013 |
| EP | 1629758 | B1 | 10/2013 |
| FR | 2812531 | B1 | 2/2002 |
| GB | 2049000 | B | 4/1983 |
| GB | 2163703 | B | 1/1988 |
| GB | 2365324 | B | 7/2002 |
| GB | 2458243 | B | 4/2012 |
| JP | 2005040246 | A | 2/2005 |
| JP | 2009261501 | A | 11/2009 |
| JP | 2010227287 | A | 10/2010 |
| NL | 10681 | C | 7/1923 |
| WO | 9619294 | A1 | 6/1996 |
| WO | 00/78546 | A1 | 12/2000 |
| WO | 2008017802 | A1 | 11/2004 |
| WO | 2005089618 | A3 | 9/2005 |
| WO | 2006026414 | A3 | 3/2006 |
| WO | 2007084699 | A1 | 7/2007 |
| WO | 2007104138 | A1 | 9/2007 |
| WO | 2008070966 | A1 | 6/2008 |
| WO | 2008070980 | A1 | 6/2008 |
| WO | 2009026709 | A1 | 3/2009 |
| WO | 2010102396 | A1 | 9/2010 |
| WO | 2010102410 | A1 | 9/2010 |
| WO | 2010102411 | A1 | 9/2010 |

OTHER PUBLICATIONS

English machine translation of DE112010001135, published on Aug. 2, 2012.

English machine translation of JP2010227287, published on Oct. 14, 2010.

English machine translation of CN202699035, published on Jan. 30, 2013.

English machine translation of CN201101488, published on Aug. 20, 2008.

English machine translation of CN101631494, published on Apr. 25, 2012.

English machine translation of CN101357051, published on Feb. 4, 2009.

English machine translation of DE3734355, published on Apr. 28, 1988.

English machine translation of FR2812531, published on Nov. 5, 2004.

English machine translation of CN2534954, published on Feb. 12, 2003.

English machine translation of CN2524655, published on Dec. 11, 2002.

English machine translation of CN1806741, published on Jul. 26, 2006.

English machine translation of CN1765283, published on May 3, 2006.

Forum—Dyson DC16 Root 6 Hand Held Bagless Cleaner, retrieved at http://abbyguide.com/vacuum/legacy/cgi-bin/yabb/2618-YaBB.html, blog dated Oct. 21, 2006.

English Machine translation of CN101061932, published on Oct. 31, 2010.

English machine translation of JP2005040246, published on Feb. 17, 2005.

English machine translation of JP2009261501, published on Nov. 12, 2009.

(56) References Cited

OTHER PUBLICATIONS

English machine translation of CN101288572, published on Oct. 22, 2008.
English machine translation of CN101448447, published on Jun. 3, 2009.
English machine translation of NL10681C, published on Jul. 16, 1923.

SURFACE CLEANING APPARATUS WITH DIFFERENT CLEANING CONFIGURATIONS

CROSS REFERENCE TO RELATED APPLICATIONS

This application claims benefit under 35 USC 120 as a continuation application of co-pending U.S. patent application Ser. No. 14/307,335. which was filed on Jun. 17, 2014 as a continuation of U.S. Ser. No. 13/255,889 which itself was filed under 35 USC 371 as a national phase entry of co-pending International Patent Application No. PCT/CA2010/000366 with a filing date of Mar. 12, 2010 which itself claims the benefit of priority under 35 USC 119 from Canadian Patent Application No. 2,658,381, filed on Mar. 13, 2009 and Canadian Patent Application No. 2,674,761, filed on Jul. 30, 2009, entitled SURFACE CLEANING APPARATUS WITH DIFFERENT CLEANING CONFIGURATIONS, the specifications of which are incorporated herein by reference.

FIELD

The specification relates to a reconfigurable surface cleaning apparatus. In a preferred embodiment, the surface cleaning apparatus has an upright cleaning unit, a surface cleaning head and a detachably mounted cleaning unit in airflow communication with the surface cleaning head. In use, the cleaning unit can be detached from the upright cleaning unit and moved independently from the upright cleaning unit optionally without having to reconfigure the airflow conduit between the cleaning unit and the surface cleaning head.

INTRODUCTION

The following is not an admission that anything discussed below is prior art or part of the common general knowledge of persons skilled in the art.

Various types of surface cleaning apparatus are known. Typical upright vacuum cleaners include an upper section, including an air treatment member such as one or more cyclones and/or filters, drivingly mounted to a surface cleaning head. An up flow conduit is typically provided between the surface cleaning head and the upper section. In some such vacuum cleaners, a spine, casing or backbone extends between the surface cleaning head and the upper section for supporting the upper section. The air treatment member or members and/or the suction motor may be provided on the upper section.

Surface cleaning apparatus having a portable cleaning module that is removably mounted to an upright vacuum cleaner are known. See for example, U.S. Pat. No. 5,309,600. In addition surface cleaning apparatus having a removably mounted hand vacuum cleaner are also known. See for example U.S. Pat. No. 4,635,315.

SUMMARY

The following introduction is provided to introduce the reader to the more detailed discussion to follow. The introduction is not intended to limit or define the claims.

According to one broad aspect, a surface cleaning apparatus is provided is operable in an upright operating mode as an upright vacuum cleaner. For example, a vacuum cleaner may have a surface cleaning head for cleaning a floor. A support structure having a handle may be drivingly connected to the surface cleaning head such that a user can maneuver the surface cleaning head across the floor by manipulating the handle. The surface cleaning apparatus also comprises a cleaning unit, which is preferably a portable surface cleaning unit that is selectively detachably mounted to the support structure. The portable surface cleaning unit preferably provides the vacuum suction and air treatment for the surface cleaning apparatus and is connected in airflow, or fluid flow, communication with the surface cleaning head such that the floor can be cleaned by the surface cleaning head.

Mounting the portable surface cleaning unit on the support structure increases the weight of the support structure and can affect the maneuverability and ease of use of the surface cleaning apparatus. Accordingly, in some cleaning situations the user may preferably detach the cleaning unit from the support structure and choose to operate the apparatus in a portable operating mode, e.g., carry the cleaning unit by hand or by a strap while still using the support structure to drivingly maneuver the surface cleaning head. When the cleaning unit is detached, a user may more easily maneuver the surface cleaning head around or under obstacles, like furniture and stairs.

To enable the vacuum suction generated by the cleaning unit to reach the surface cleaning head when the portable surface cleaning unit is detached from the support structure, the airflow connection between the surface cleaning head and the cleaning unit is preferably at least partially formed by a flexible conduit, such as a flexible hose. The use of a flexible conduit allows a user to detach the portable surface cleaning unit and maintain a flow connection between the portable surface cleaning unit and the surface cleaning head without having to reconfigure or reconnect any portions of the airflow conduit.

Accordingly, when the surface cleaning apparatus is in use, a user may detach the cleaning unit from the support structure without interrupting the airflow communication between the cleaning unit and the surface cleaning head. This allows a user to selectively detach and re-attach the cleaning unit to the support structure during use without having to stop and reconfigure the connecting hoses or airflow conduits.

It is also preferred that the portable surface cleaning is detachably connected from fluid flow communication with the surface cleaning head and may have its own nozzle. Accordingly, the surface cleaning apparatus may have a third mode of operation, namely the cleaning unit may be operable as an independent portable surface cleaning apparatus, such as a hand vacuum cleaner.

In other cleaning situations a user may wish to configure the surface cleaning apparatus into other portable operating configurations in which the cleaning unit is fluidly disconnected from the surface cleaning head and used as a separate cleaning apparatus, or connected to an auxiliary cleaning tool.

It is also preferred that the portable surface cleaning unit is removable from the surface cleaning apparatus using only one handed operation. For example, the portable surface cleaning unit may be held in place on an upright section of the surface cleaning apparatus by gravity. Accordingly a user may use one hand to lift the portable surface cleaning unit of the surface cleaning apparatus while still operating the surface cleaning apparatus with the user's other hand. Optionally, a lock may be provided. In such a case, the lock is preferably operated using a single hand and the portable surface cleaning unit preferably remains in position when the lock is disengaged so that a user may use the same hand to release the lock and to then remove the portable surface cleaning unit.

In one embodiment, a surface cleaning apparatus may comprise a floor cleaning unit comprising a surface cleaning head having a dirty air inlet, a cleaning head air outlet and an upright section comprising a handle drivingly connected to the surface cleaning head. The surface cleaning apparatus may also comprise a cleaning unit removably mounted to the handle. The cleaning unit can have an air inlet, an air outlet and a suction motor. The surface cleaning apparatus can also comprise an air flow path extending through the surface cleaning apparatus that includes a flexible air flow conduit forming at least part of an air flow path from the surface cleaning head to the cleaning unit. The flexible air flow conduit can include a portable portion that is removably mounted to the surface cleaning apparatus. The air flow path can also include a rigid extension wand. The surface cleaning apparatus has a plurality of operating modes comprising an upright operating mode wherein the surface cleaning apparatus is operable as an upright surface cleaning apparatus with the cleaning unit mounted to the handle and forming part of the air flow path. The plurality of operating modes also includes at least one additional operating mode comprising a first portable operating mode wherein the cleaning unit is removed from the handle and the portable portion is detached from the extension wand, and a second portable operating mode, in which the cleaning unit is removed from the handle, the portable portion is connected to the extension wand and the extension wand is detached from the surface cleaning head. The plurality of operating modes also includes at least one second additional operating mode comprising a third portable operating mode and a fourth portable operating mode. In the third portable operating mode the cleaning unit is removed from the handle, the portable portion is detached from the extension wand and the surface cleaning head is in fluid flow communication with the portable portion. In the fourth portable operating mode the cleaning unit is removed from the handle, the portable portion is connected to the extension wand and the surface cleaning head is in fluid flow communication with the extension wand.

In some examples the surface cleaning apparatus is operable in the first and second portable operating modes.

In some examples the surface cleaning apparatus is operable in the third and fourth portable operating modes.

In some examples the surface cleaning apparatus is operable in the third and fourth portable operating modes.

In some examples the handle comprises the extension wand.

In some examples, the cleaning unit is useable by itself without any attachments. Preferably, it has a built in surface cleaning nozzle. Any such nozzle known in the vacuum art may be used. Accordingly, when disconnected from the flexible air flow conduit, the cleaning unit may be directly ready for use.

In some examples, the flexible air flow conduit may comprise a portable portion that is removably mounted to the surface cleaning apparatus and the surface cleaning apparatus has at least one additional operating mode wherein the cleaning unit is operable when removed from the handle together with the portable portion of the flexible air flow conduit.

In some examples, the portable portion comprises a handle and has an end distal to the cleaning unit and the distal end is adapted to receive a cleaning tool.

In some examples, the flexible air flow conduit has an end proximate the cleaning unit and the proximate end is removably mounted in air flow communication with the cleaning unit and the surface cleaning apparatus has at least one additional operating mode wherein the cleaning unit is operable when removed from the handle and from the flexible air flow conduit.

In some examples, the cleaning unit comprises a hand vacuum cleaner. Alternately, the cleaning unit may be carriable by, e.g., a strap.

In some examples, the surface cleaning apparatus may comprise an attachment member that is removably attached to the cleaning unit and the flexible air flow conduit is mounted to the attachment member.

In some examples, the attachment member forms part of airflow path from the surface cleaning head to the cleaning unit.

In some examples, the flexible air flow conduit is removably mounted to the attachment member.

In some examples, the handle comprises a cleaning unit mount that removably receives the attachment member.

In some examples, the cleaning unit is mounted to the upright section at a position spaced from the surface cleaning head.

In some examples, cleaning unit further comprises a nozzle that is selectively connectable in air flow communication with an accessory cleaning tool and the air flow path from the surface cleaning head to the cleaning unit.

In some examples, the cleaning unit comprises a hand vacuum cleaner having a nozzle that is configured for directly cleaning a surface.

In some examples, the upright section has an absence of a housing defining a recess for receiving the cleaning unit.

In some examples, the upright section comprises one or more thin support members.

In some examples, the upright section consists essentially of one or more thin support members.

It will be appreciated that an embodiment may contain one or more of features set out in the examples,

DRAWINGS

In the detailed description, reference will be made to the following drawings, in which.

Figure 1:
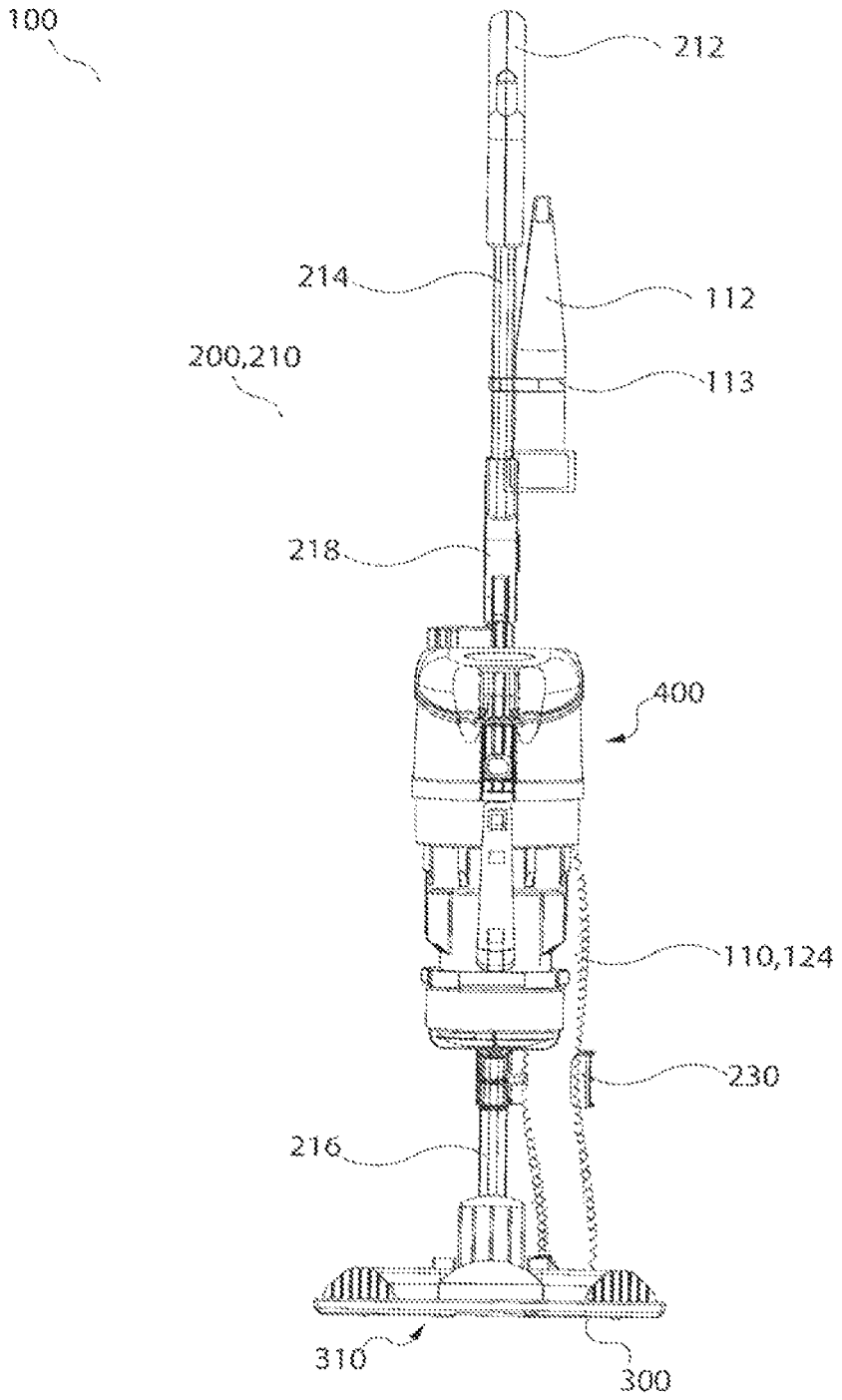
FIG. 1 is a front elevation view of an example of a vacuum cleaner.
Figure 2:
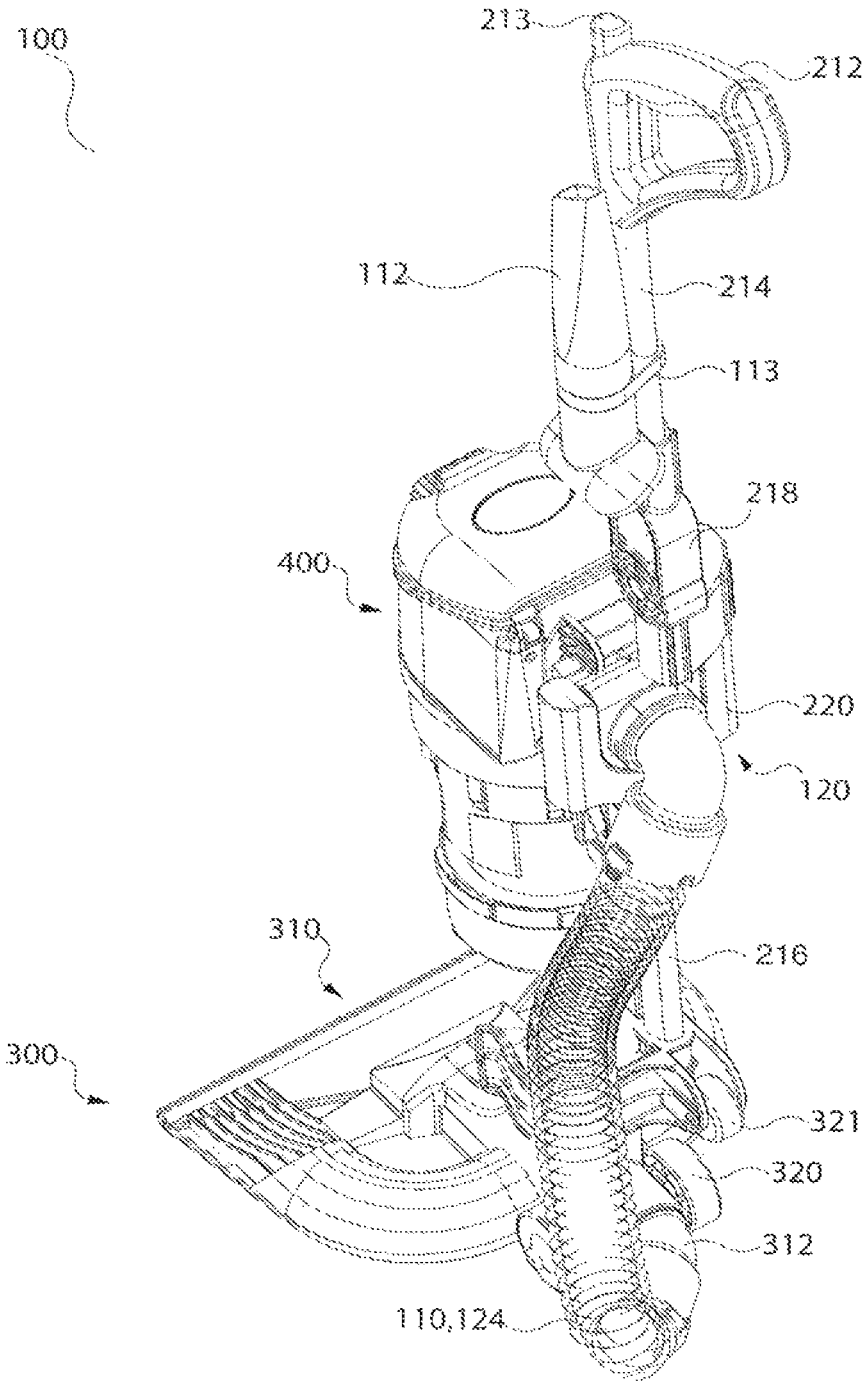
FIG. 2 is a back perspective view of the vacuum cleaner of FIG. 1 with a cleaning unit mounted to a support structure.
Figure 3A:
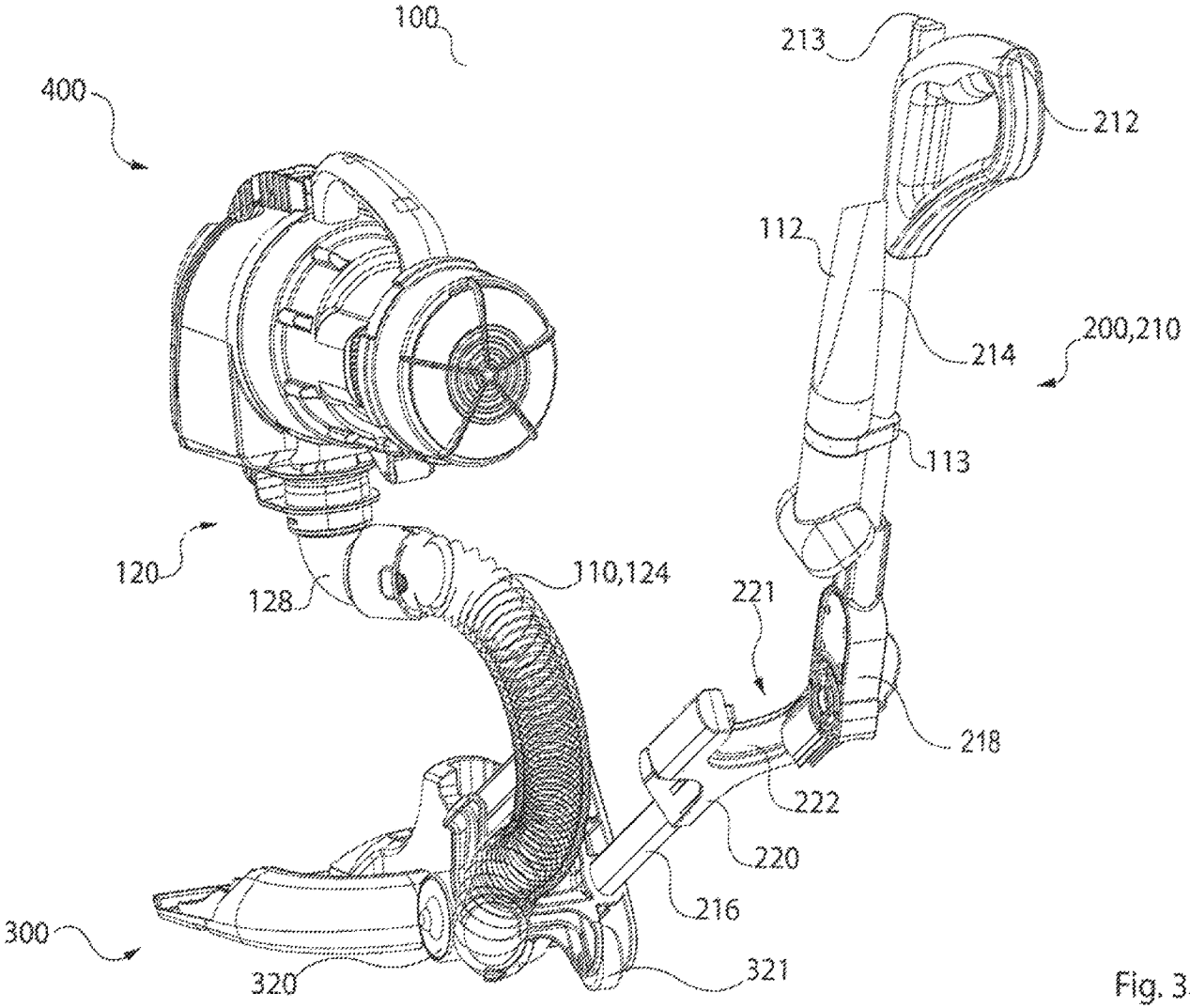
Figure 3B:
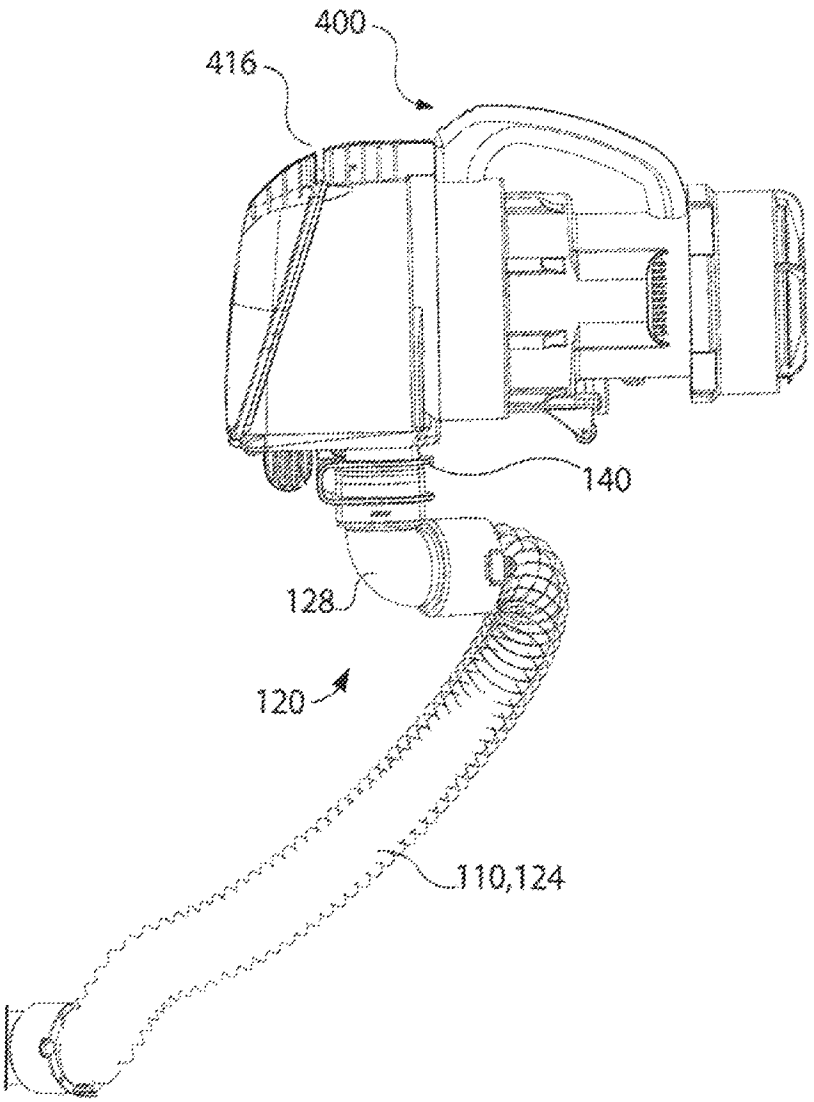
Figure 4:
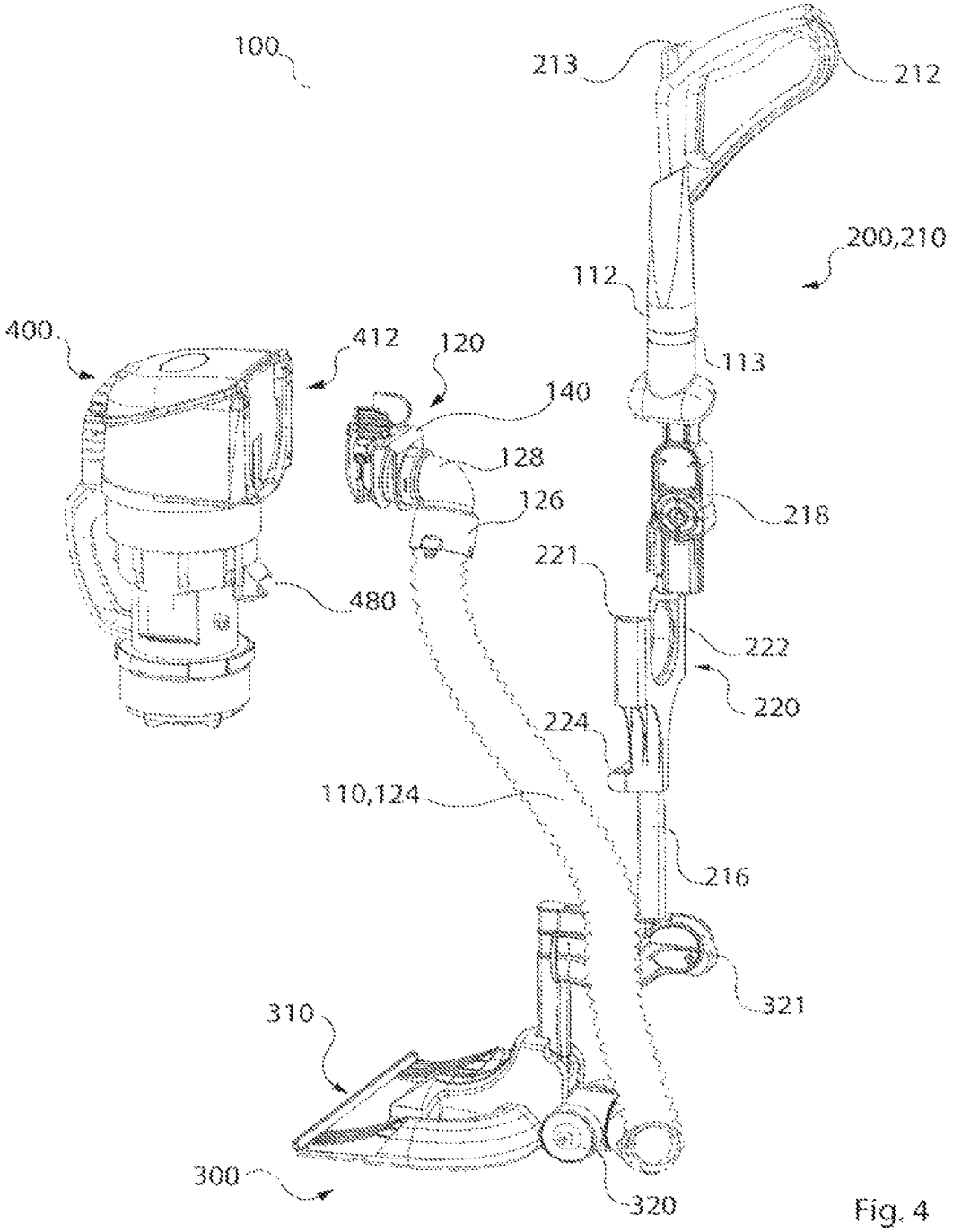
Figure 5:
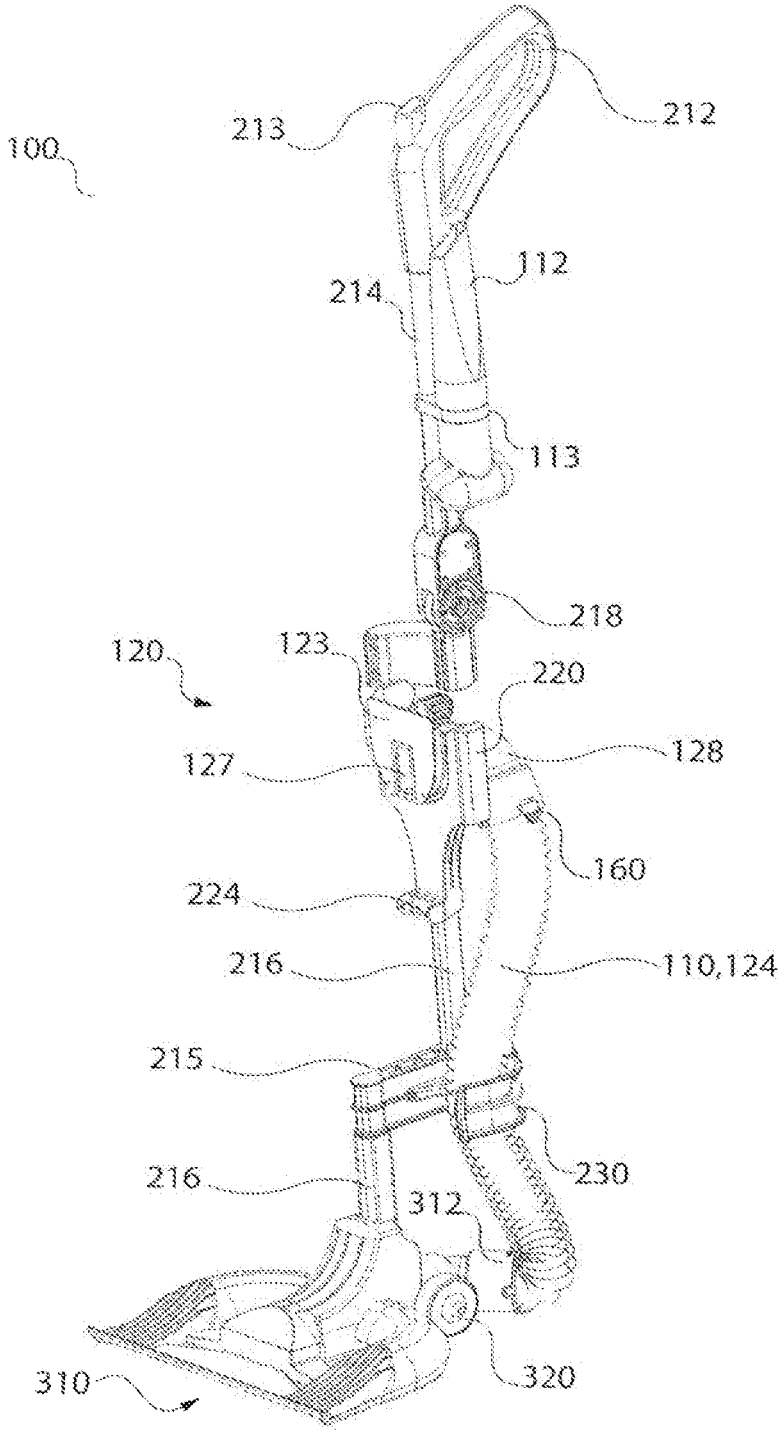
Figure 6:
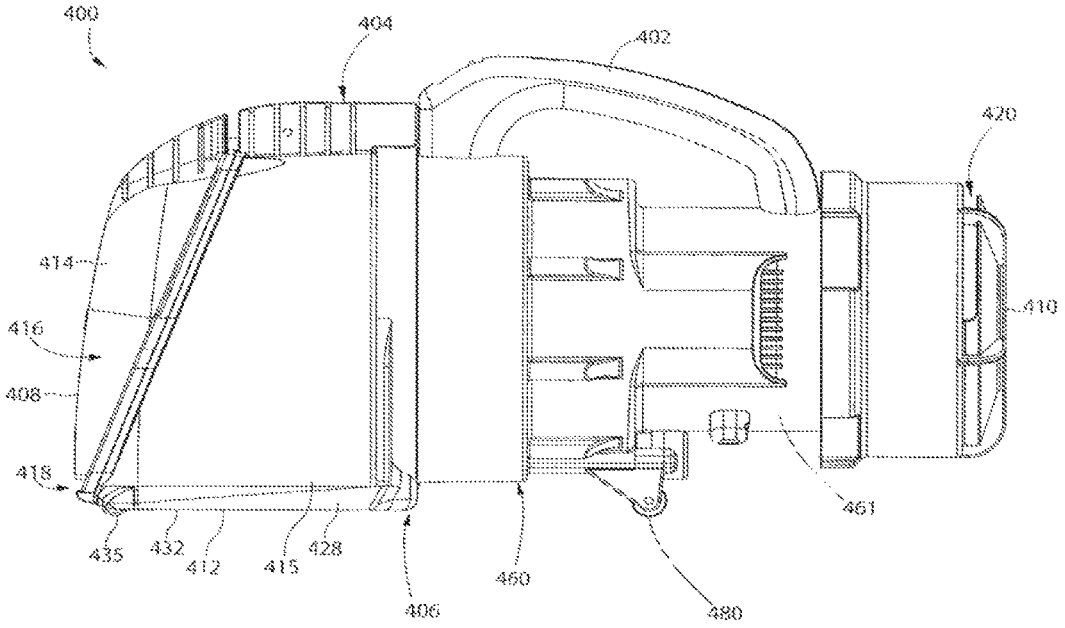
Figure 7:
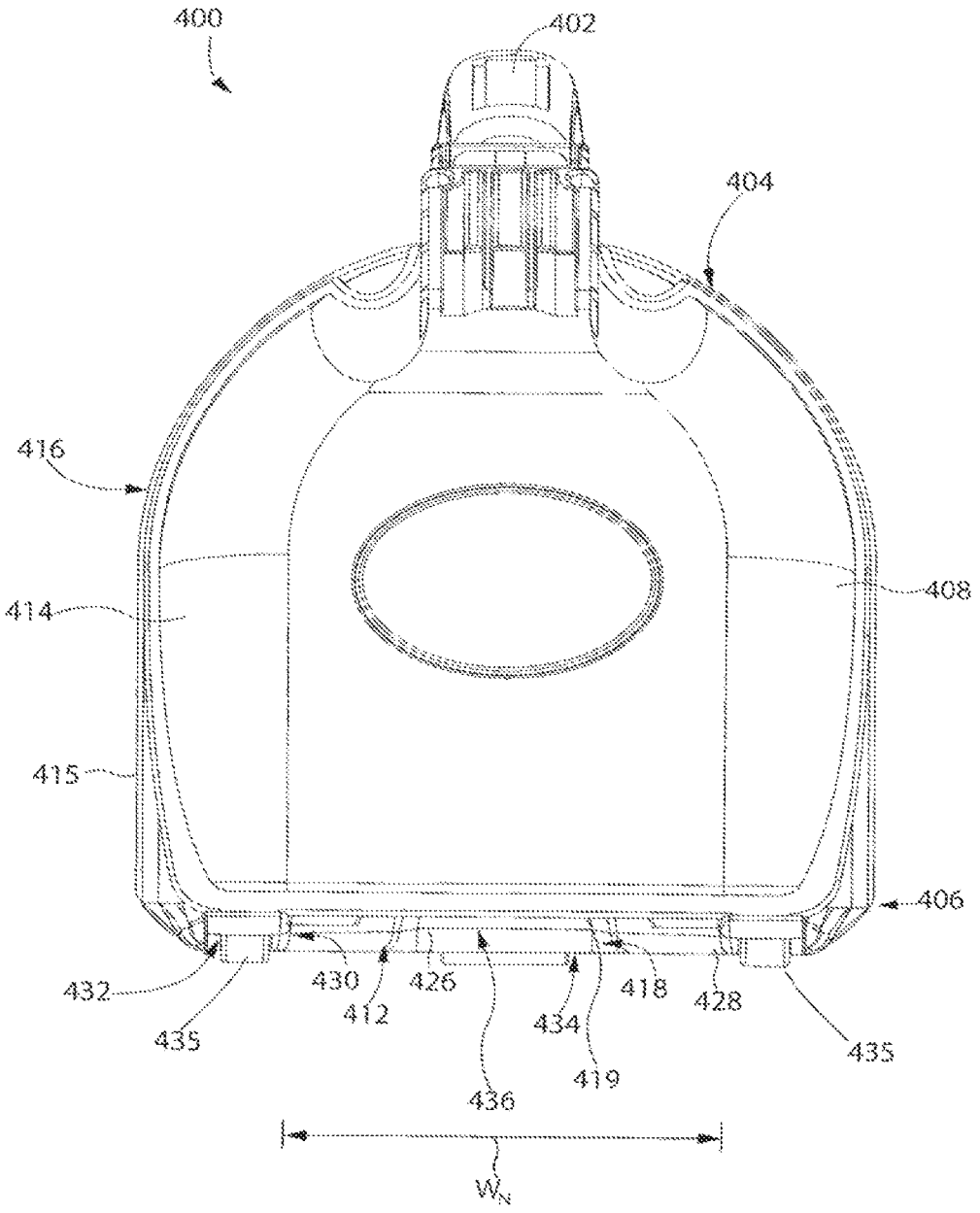
Figure 8:
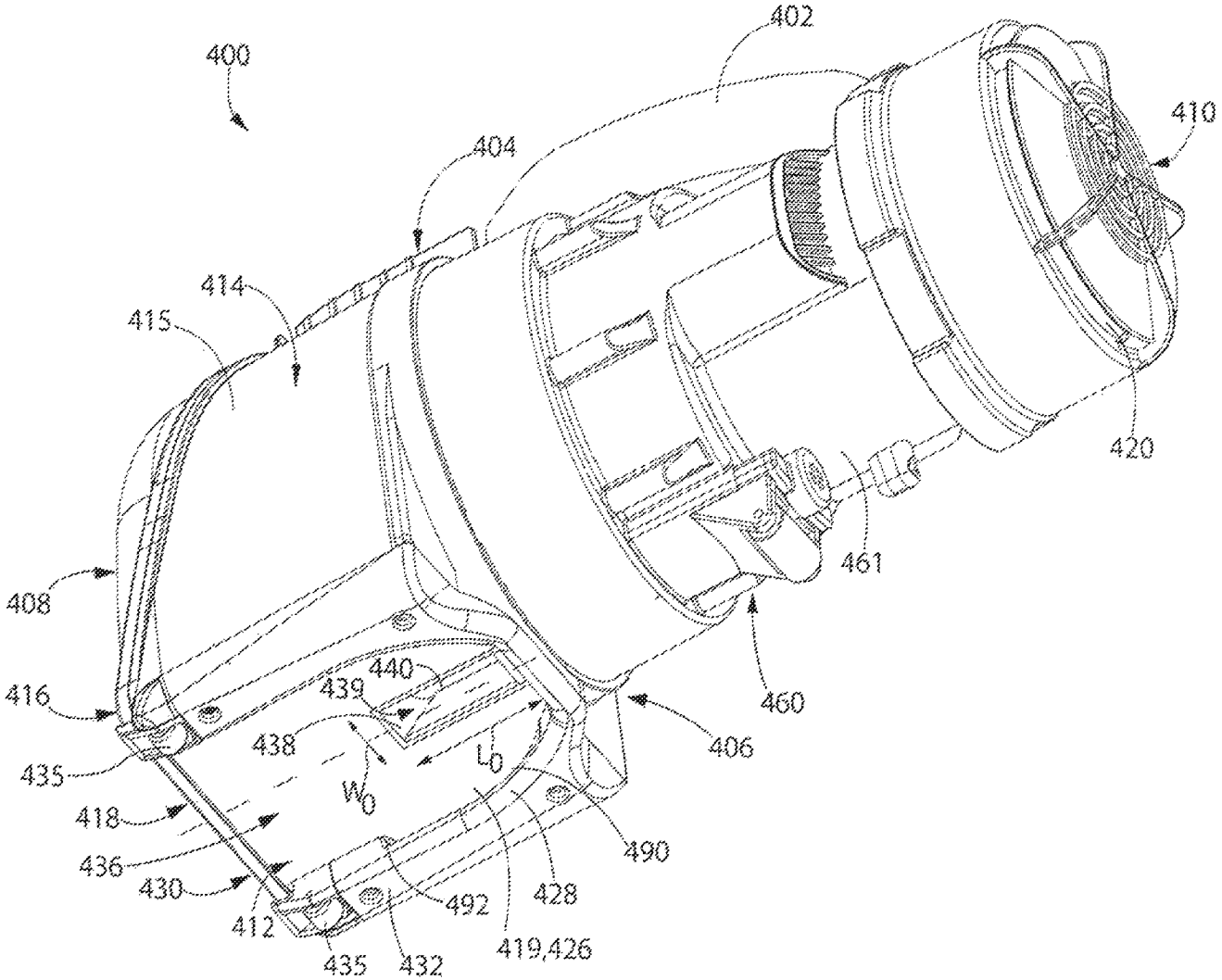
Figure 9:
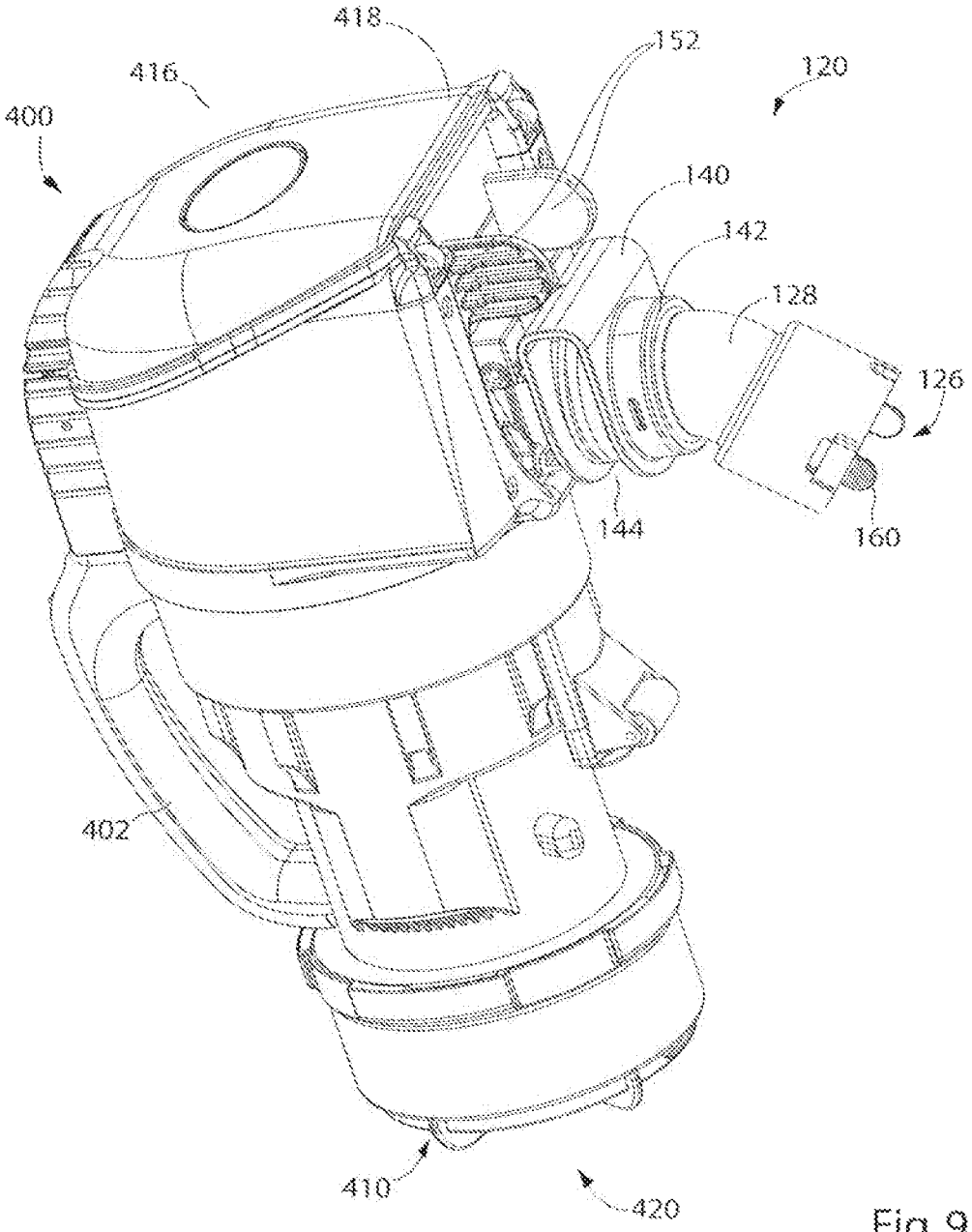
Figure 10:
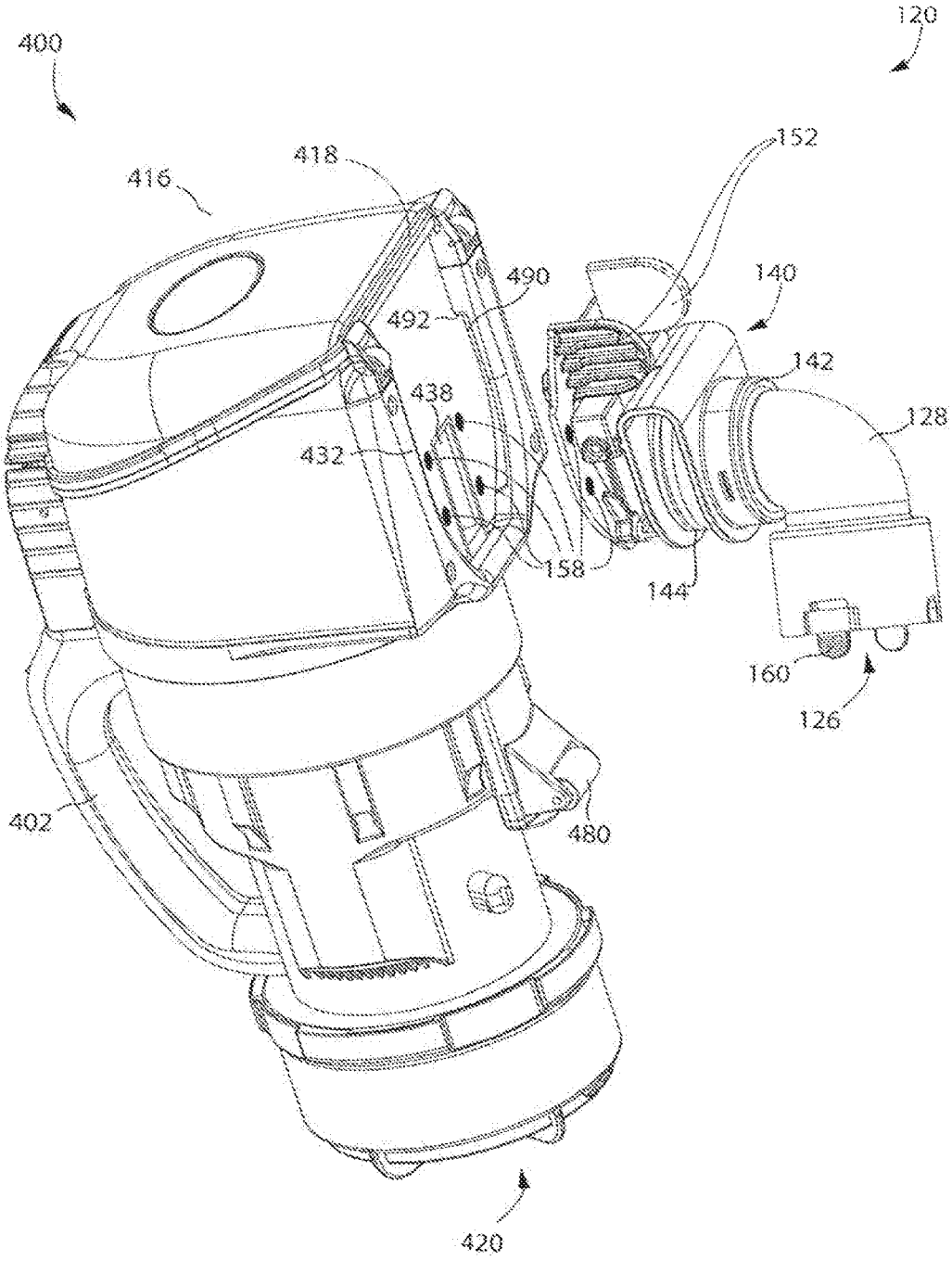
Figure 11:
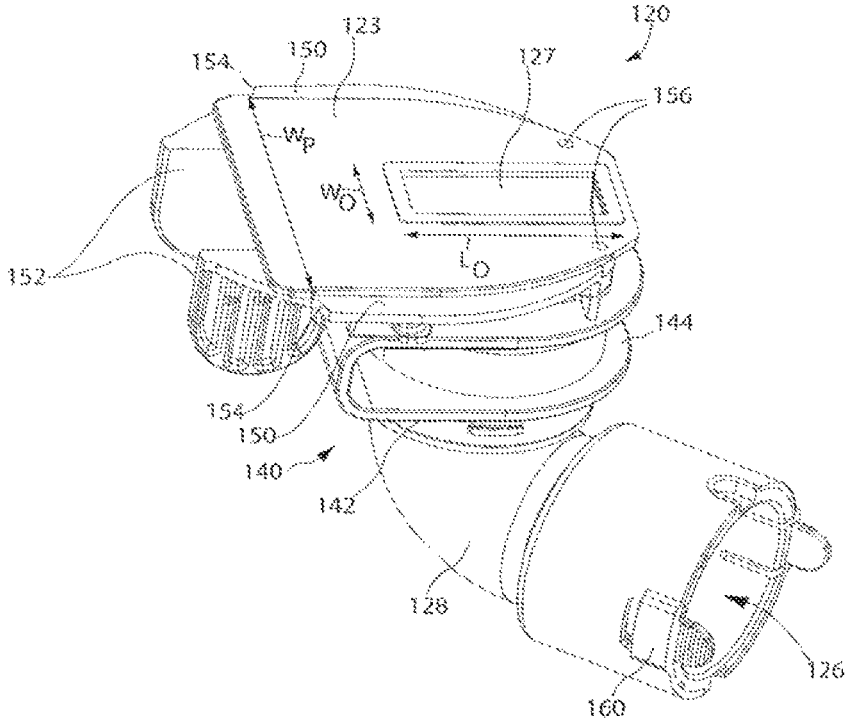

FIG. 3*a* is a back perspective view of the vacuum cleaner of FIG. 1 with the cleaning unit removed from the support structure and in a position in which it may be carried by hand;

FIG. 3*b* is a side elevation view of the cleaning unit of FIG. 3*a* wherein the cleaning unit has been removed from the support structure and is in a position in which it may be carried by hand with flexible hose detached from the surface cleaning head;

FIG. 4 is a partially exploded side perspective view of the vacuum cleaner of FIG. 1 with the cleaning unit removed from air flow communication with the floor cleaning unit;

FIG. 5 is a front isometric view of the vacuum cleaner of FIG. 1 with the cleaning unit removed;

FIG. 6 is side elevation view of a hand vacuum cleaner;

FIG. 7 is a front elevation view of the hand vacuum cleaner of FIG. 6;

FIG. 8 is a bottom isometric view the hand vacuum cleaner of FIG. 6;

FIG. 9 is a bottom isometric view of the hand vacuum cleaner and an attachment member;

FIG. 10 is a partially exploded bottom isometric view of the hand vacuum cleaner and an attachment member of FIG. 9;

FIG. 11 is a side isometric view of the attachment member of

Figure 12:
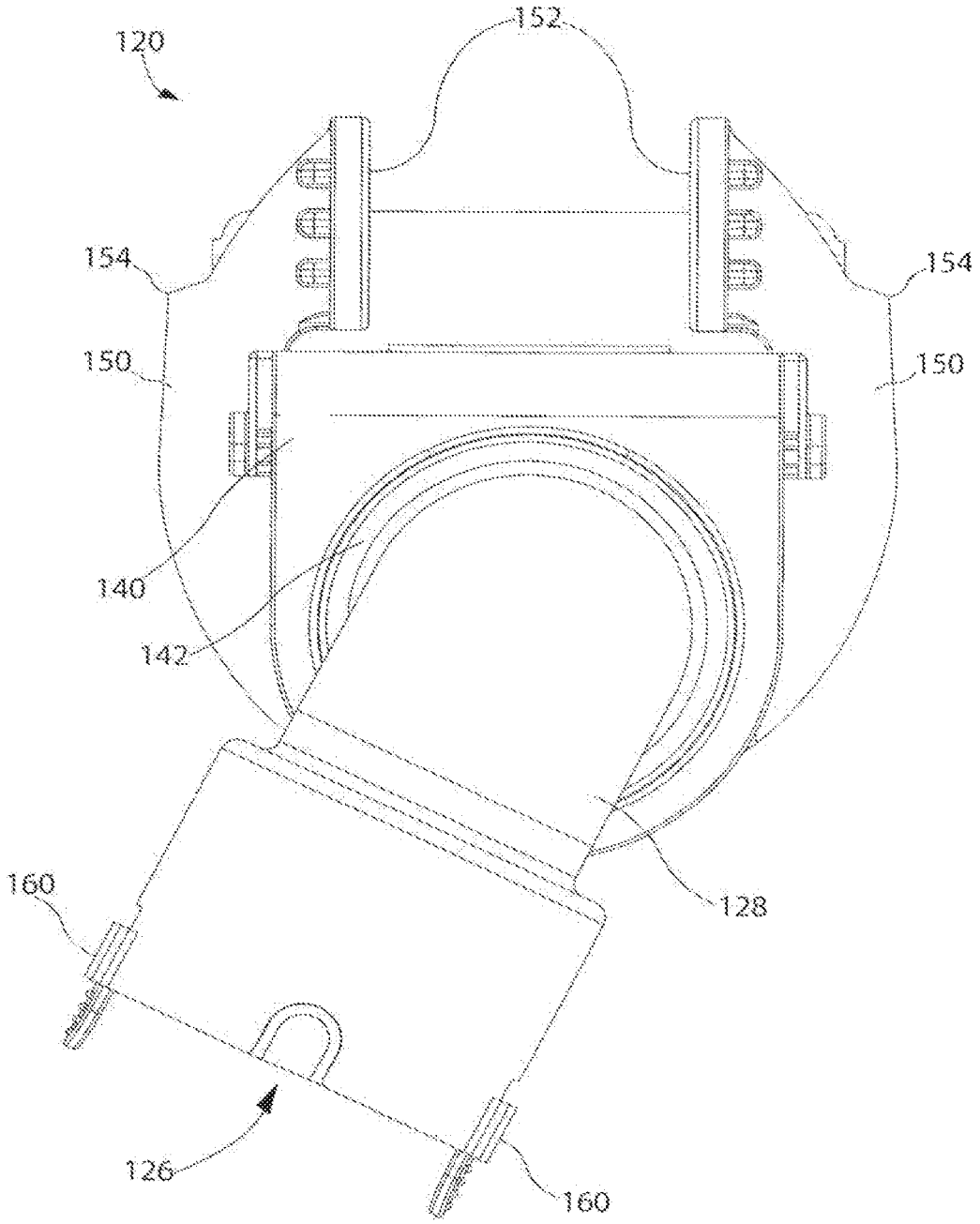
Figure 13:
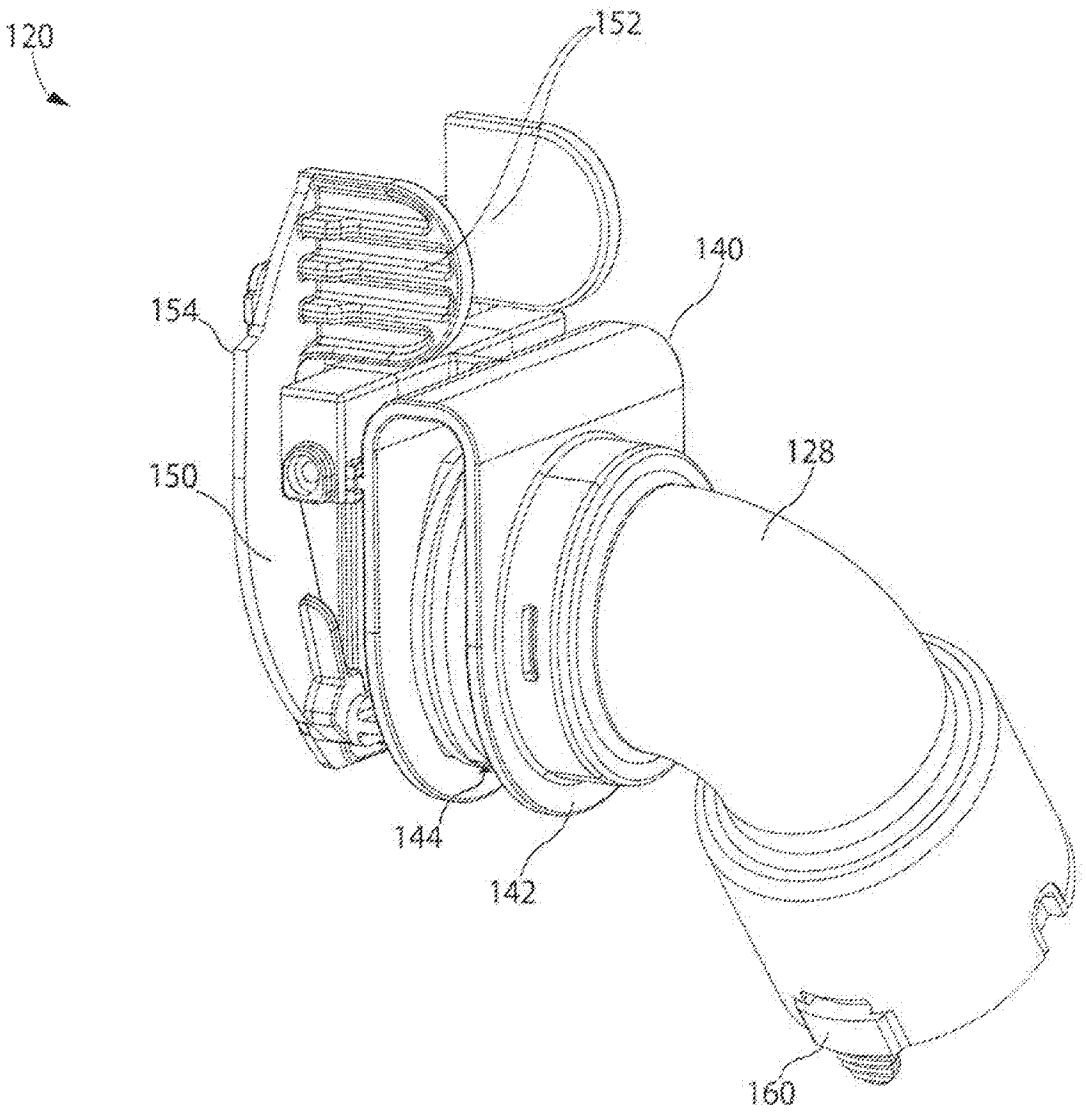
Figure 14:
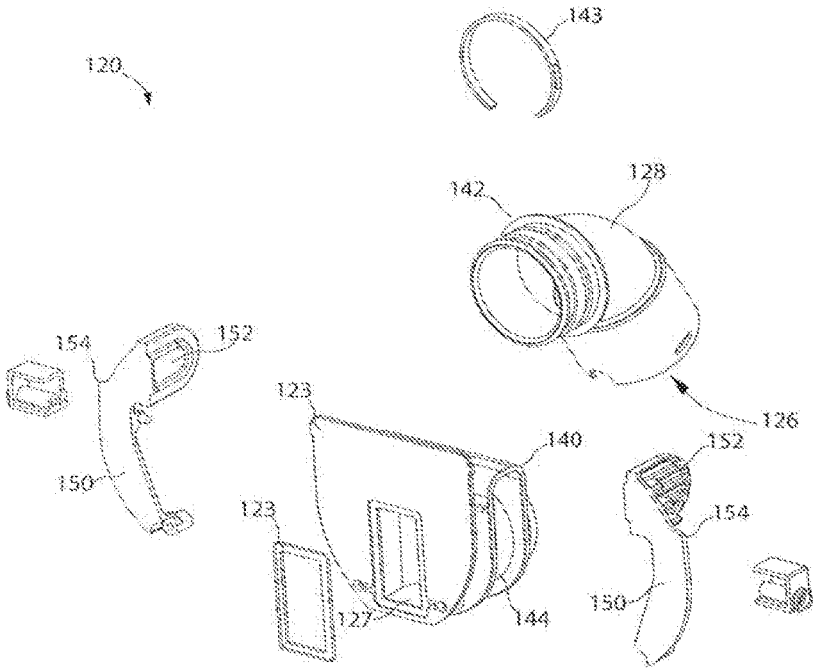
Figure 15:
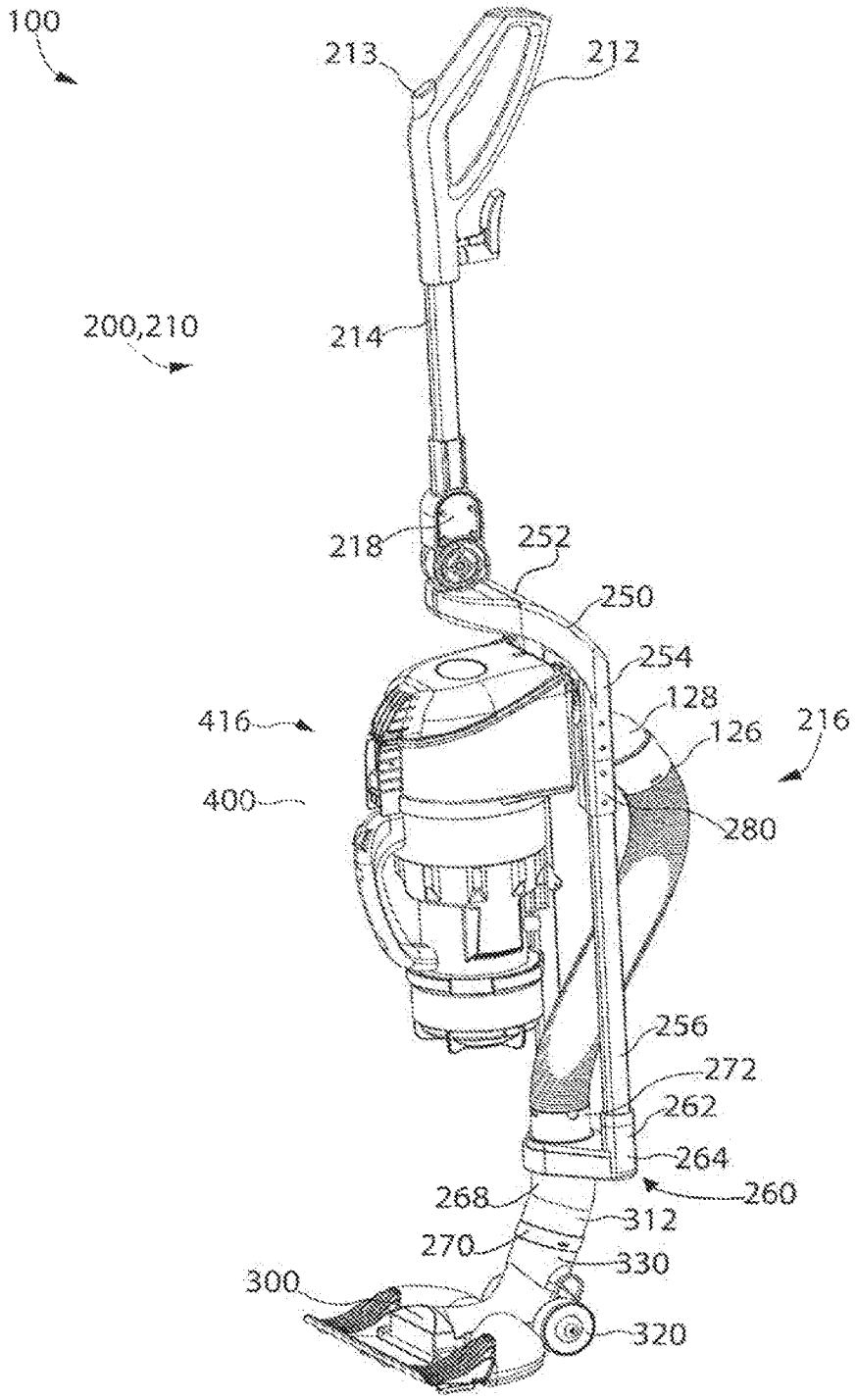
Figure 16:
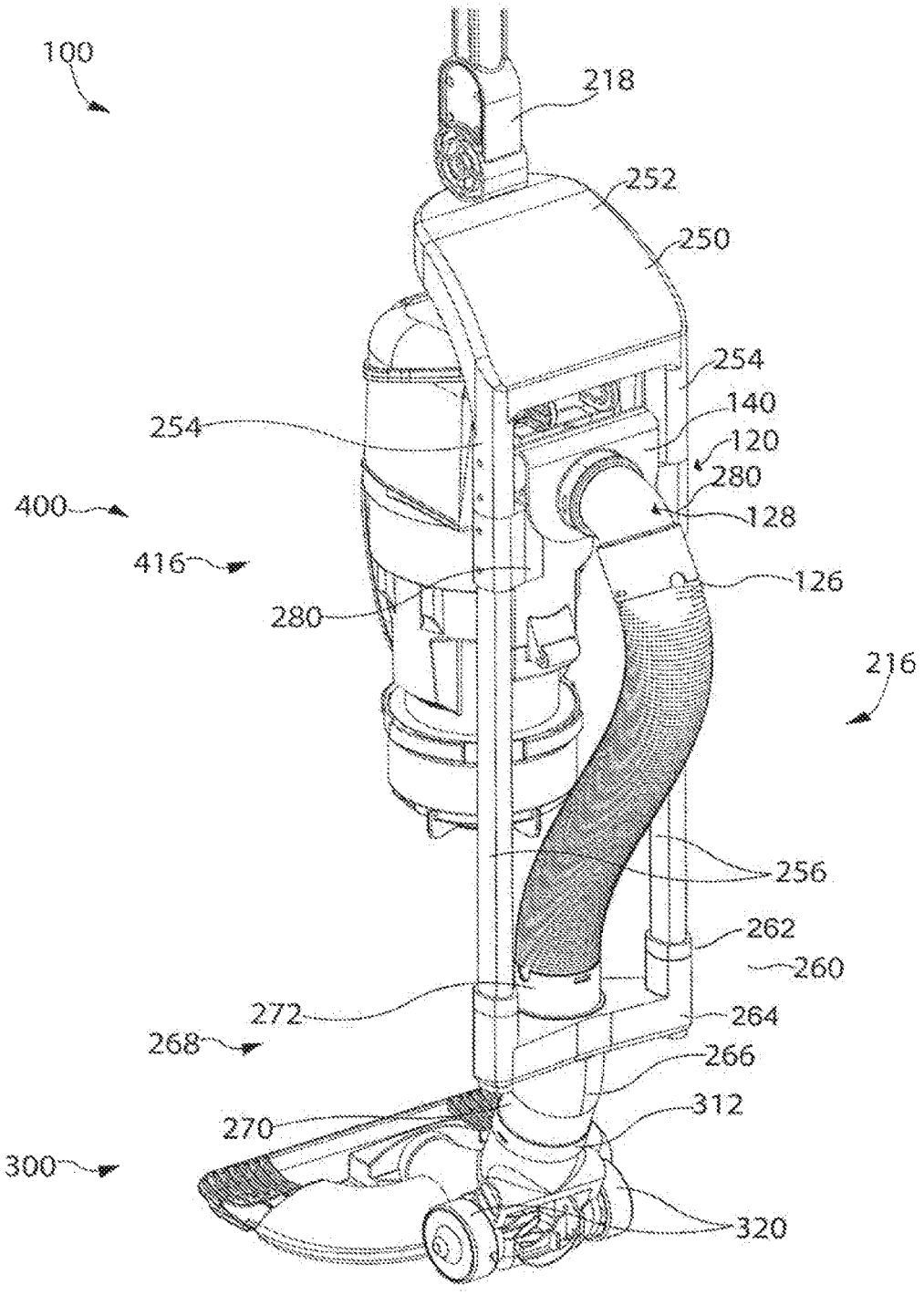

FIG. 9;

FIG. 12 is a front elevation view of the attachment member of FIG. 11;

FIG. 13 is a side isometric view of the attachment member of FIG. 11;

FIG. 14 is a partially exploded isometric view of the attachment member of FIG. 11;

FIG. 15 is a front isometric view of an alternate example of a vacuum cleaner with a cleaning unit mounted thereto;

FIG. 16 is a partial rear isometric view of the vacuum cleaner of

Figure 17:
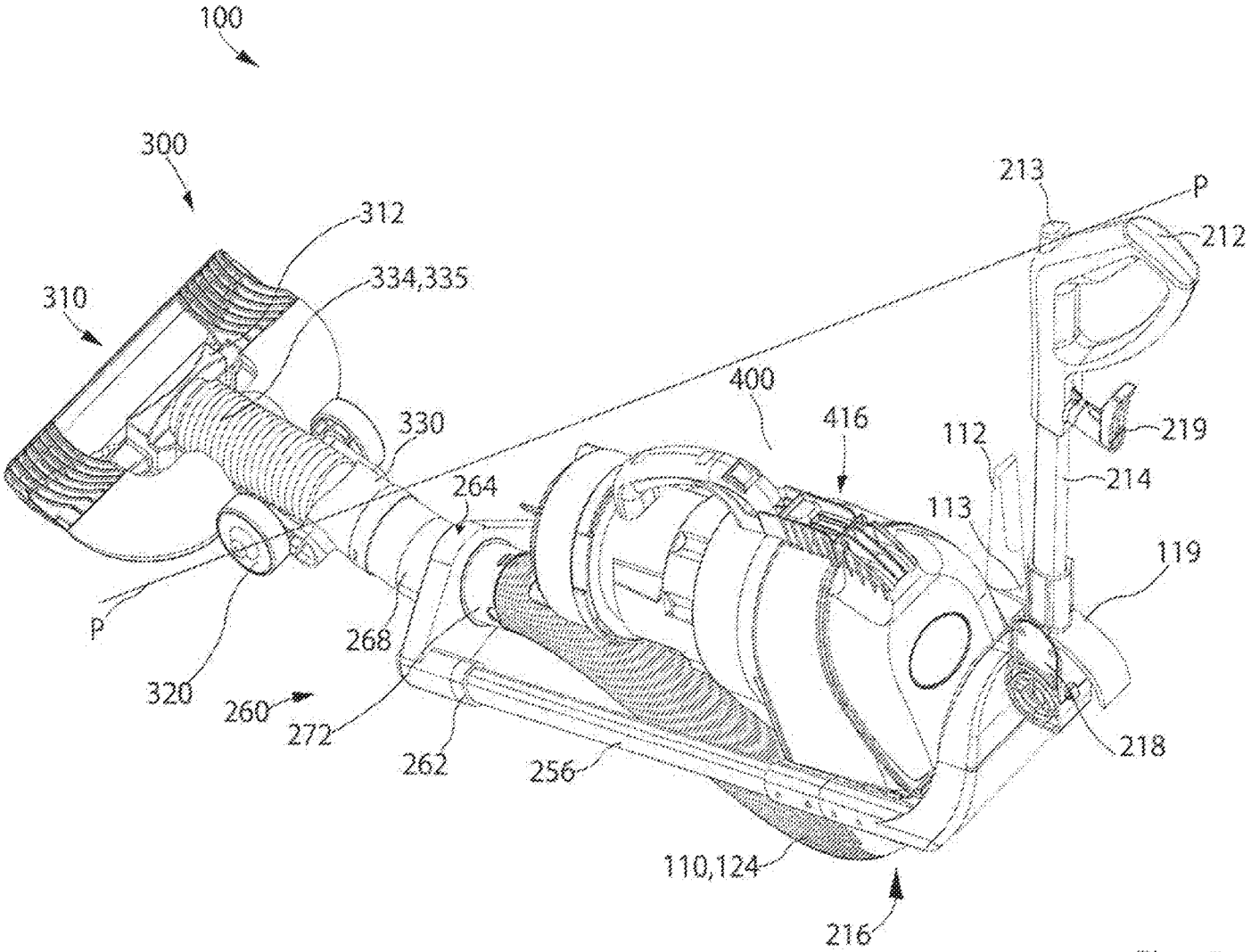
Figure 18:
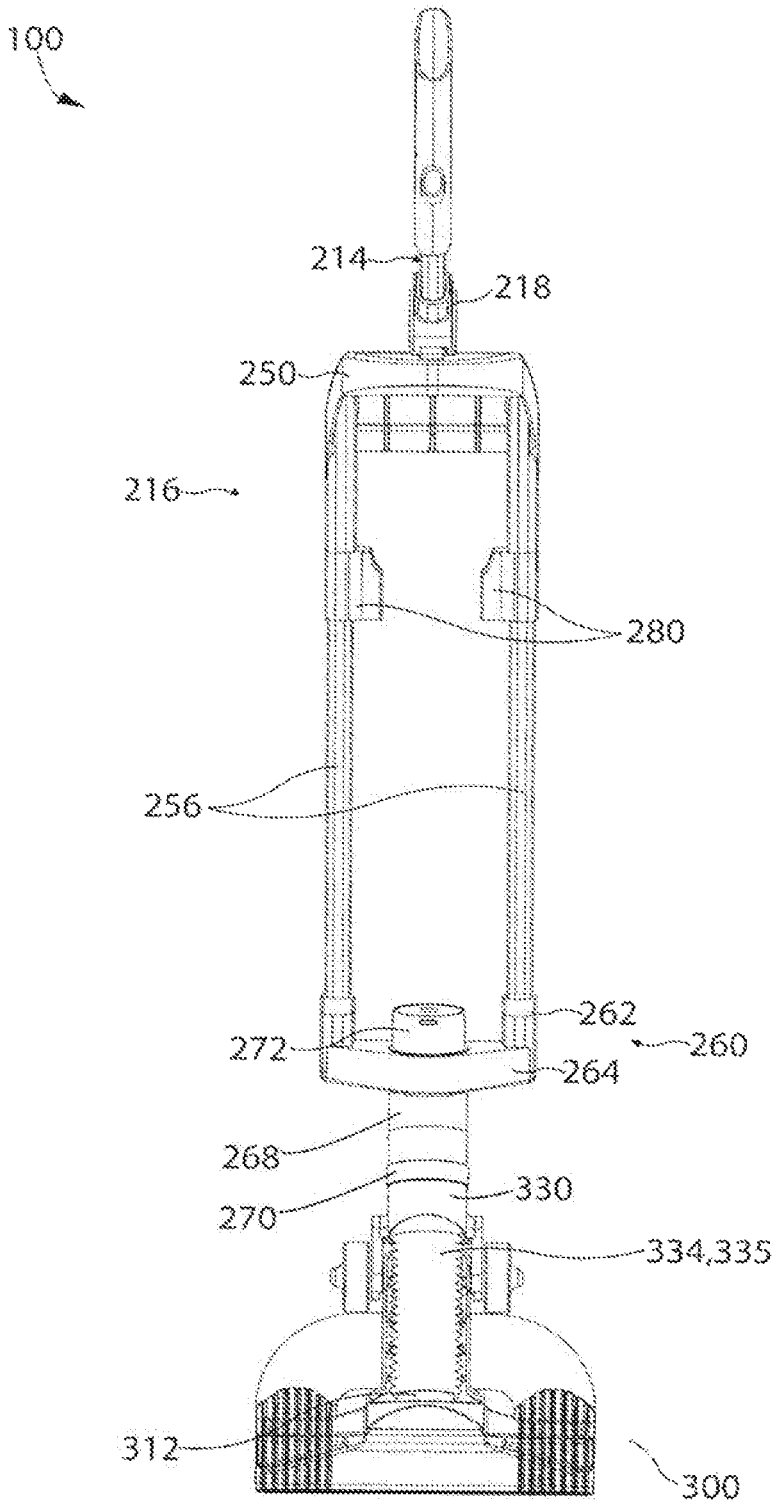
Figure 19:
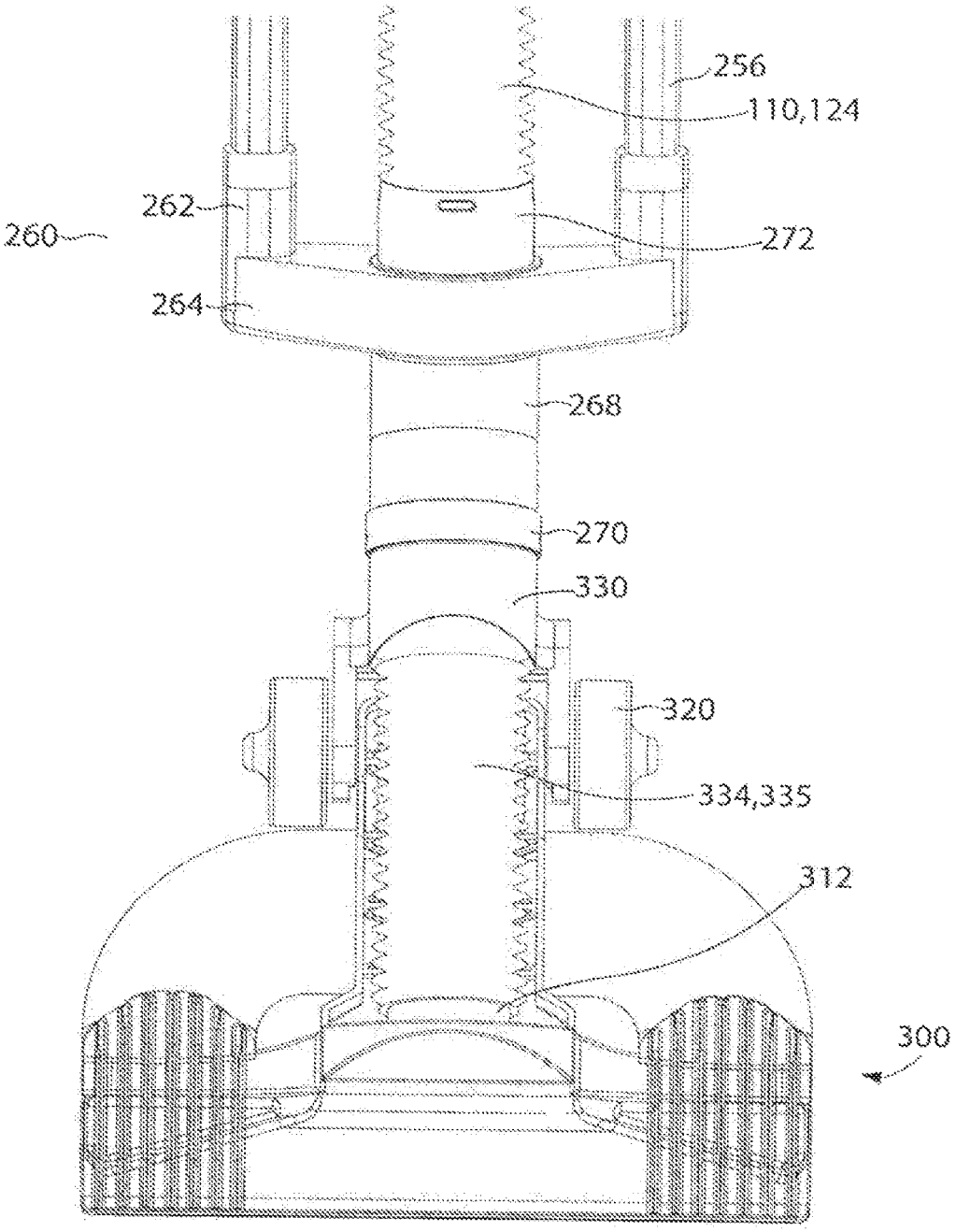
Figure 20:
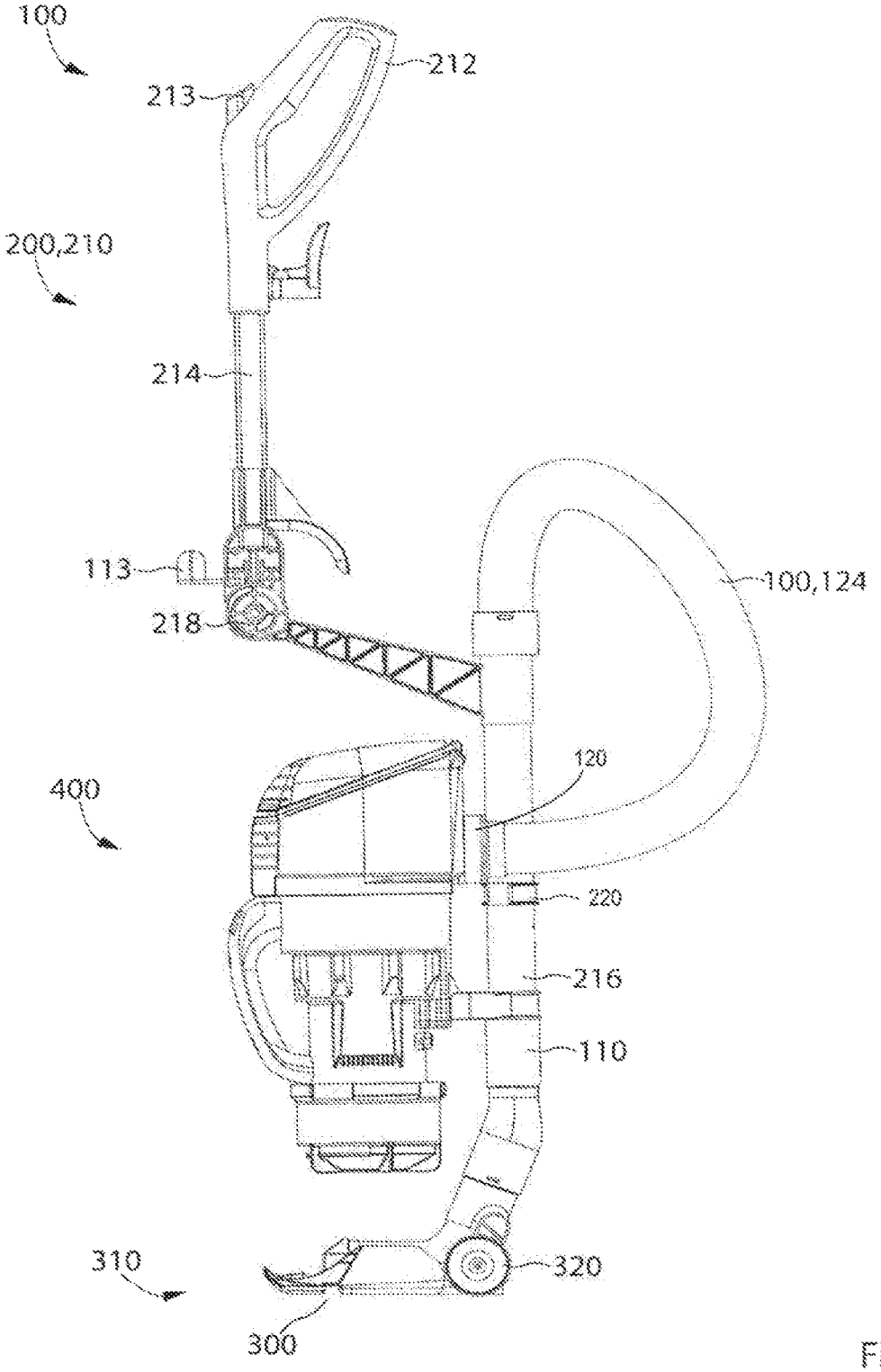
Figure 21:
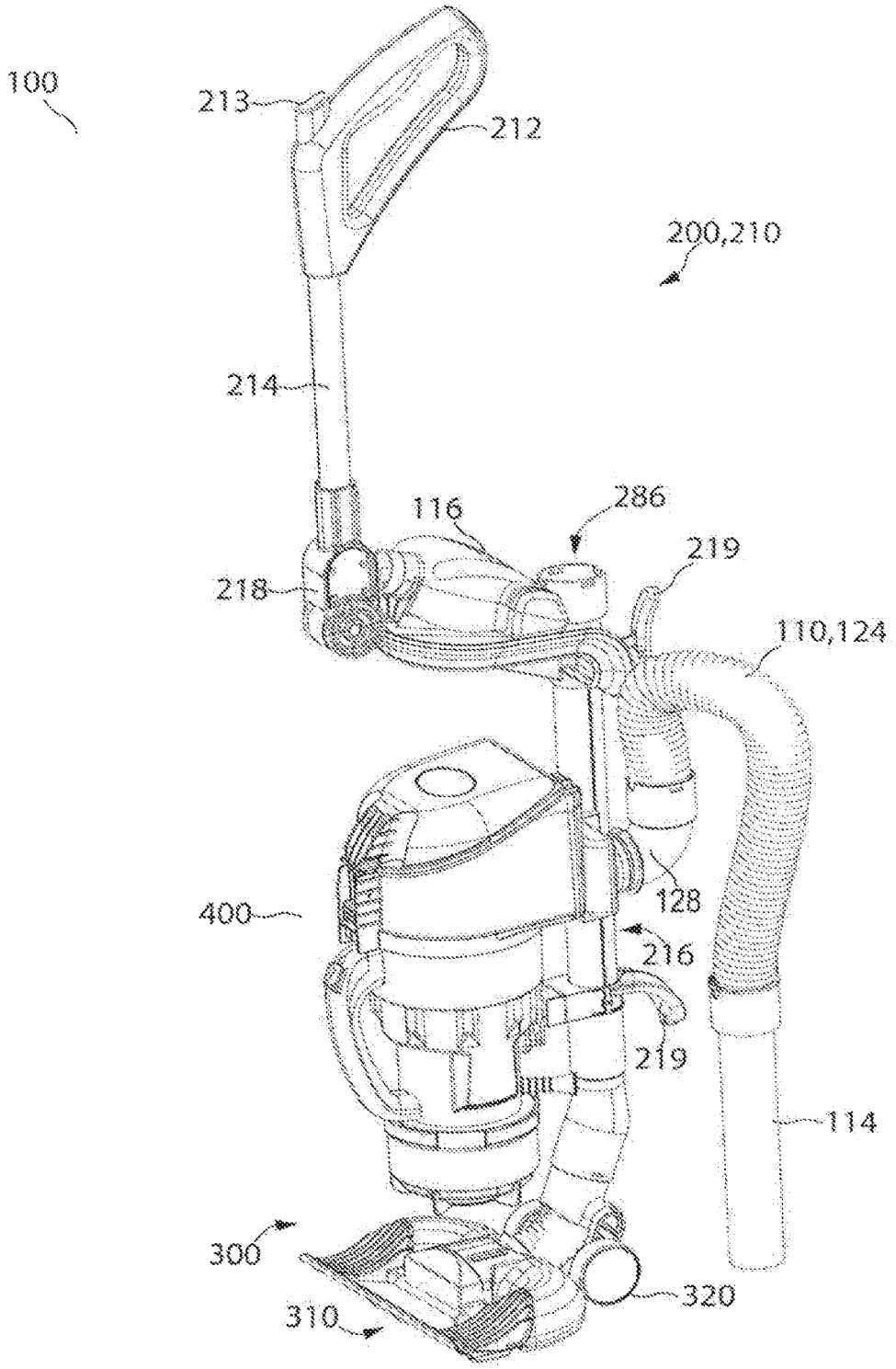
Figure 22:
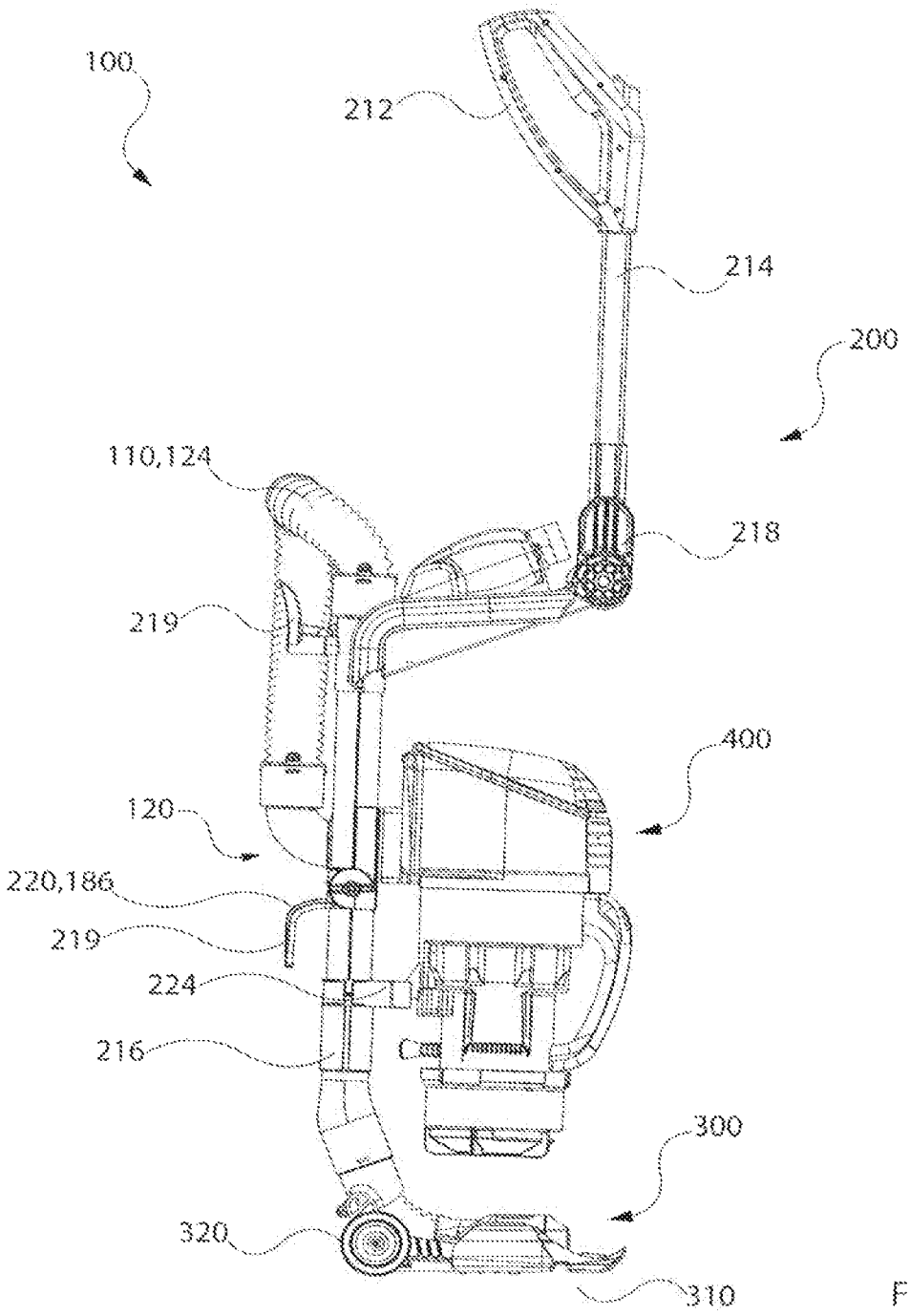
Figure 23:
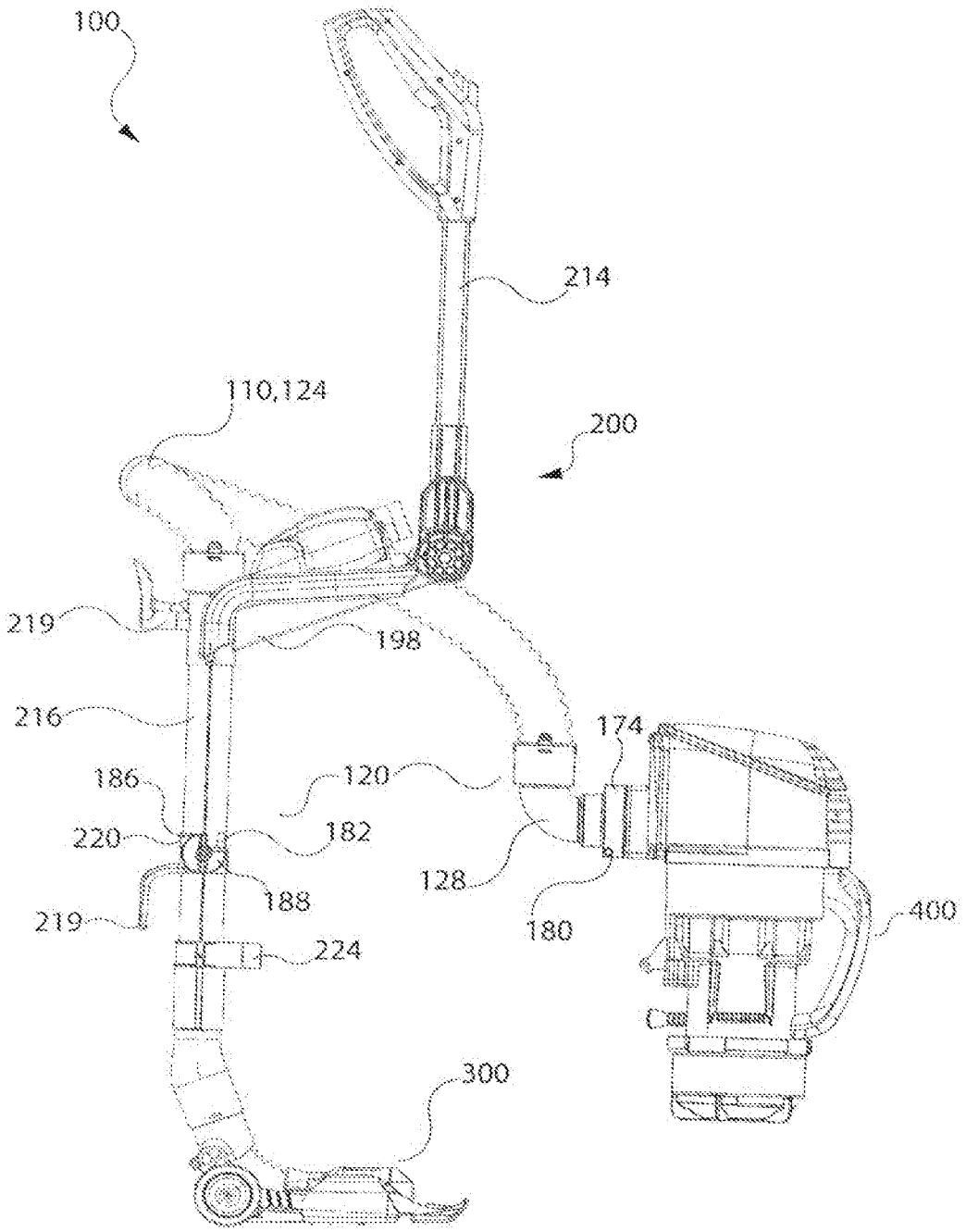
Figure 24:
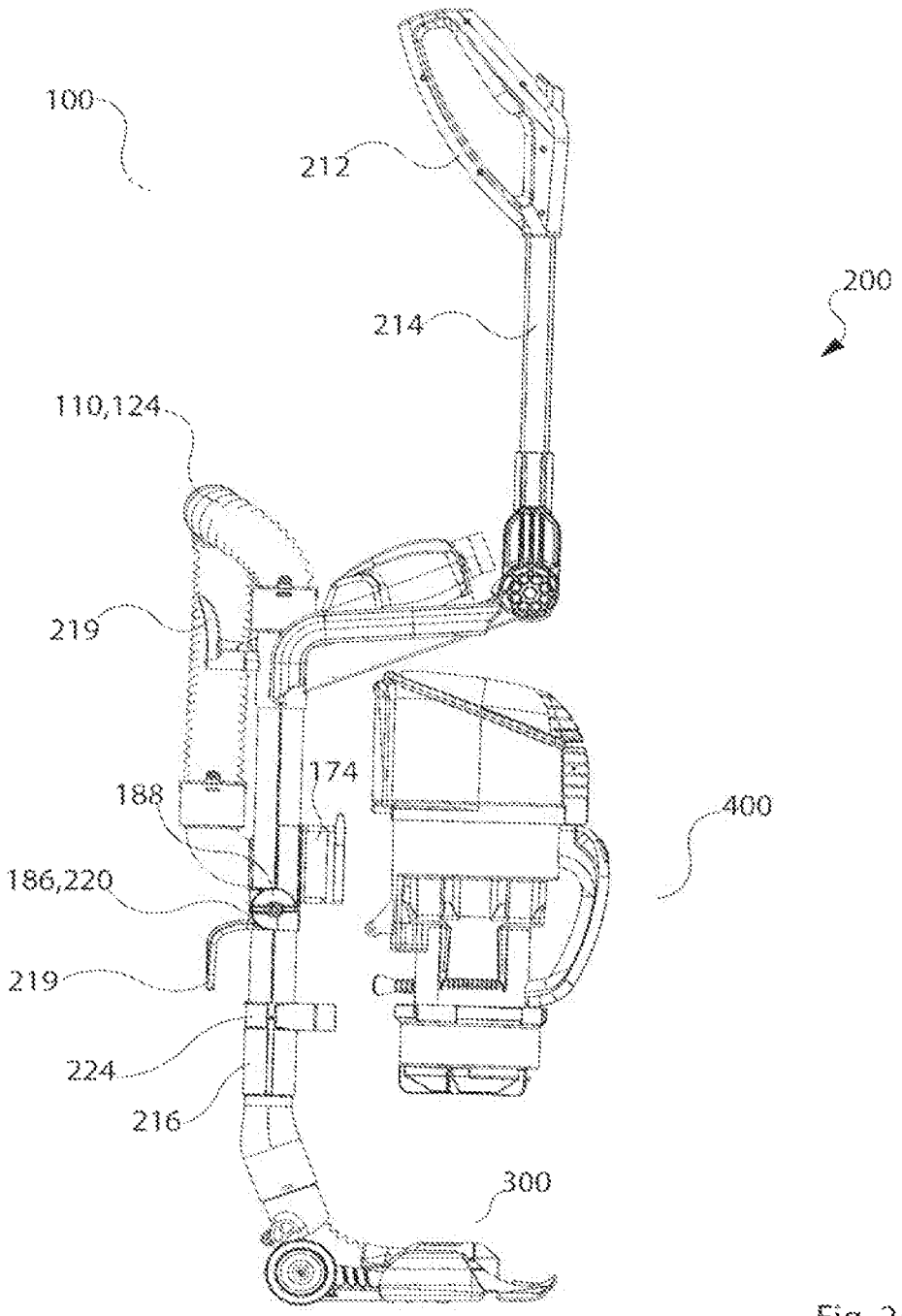
Figure 25:
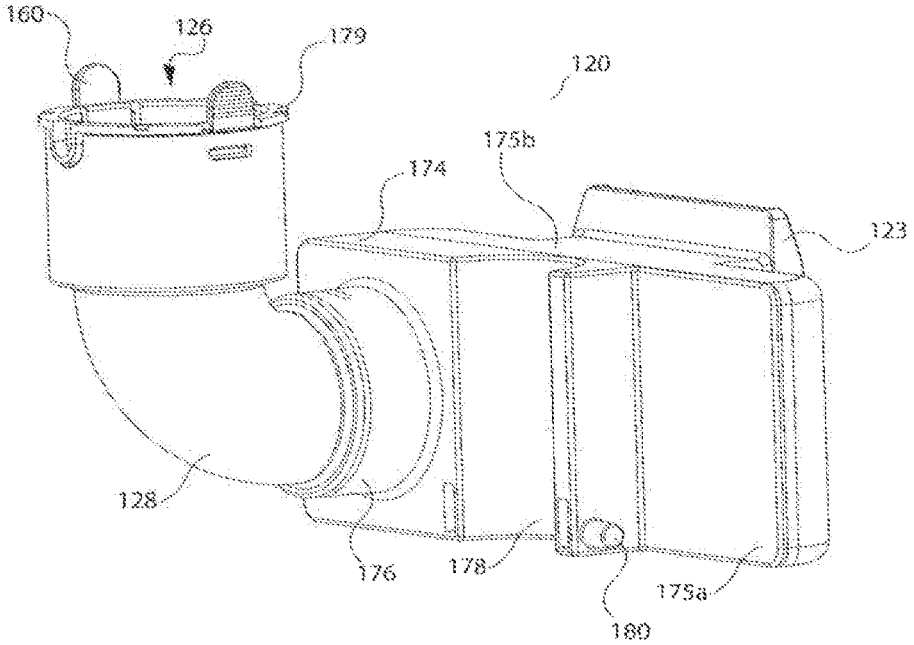
Figure 26:
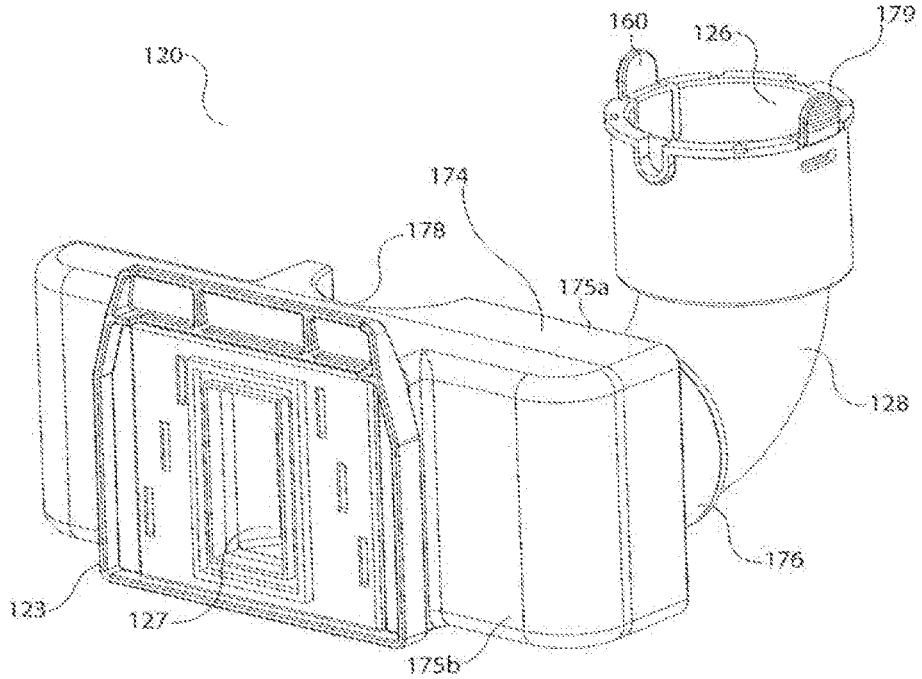
Figure 27:
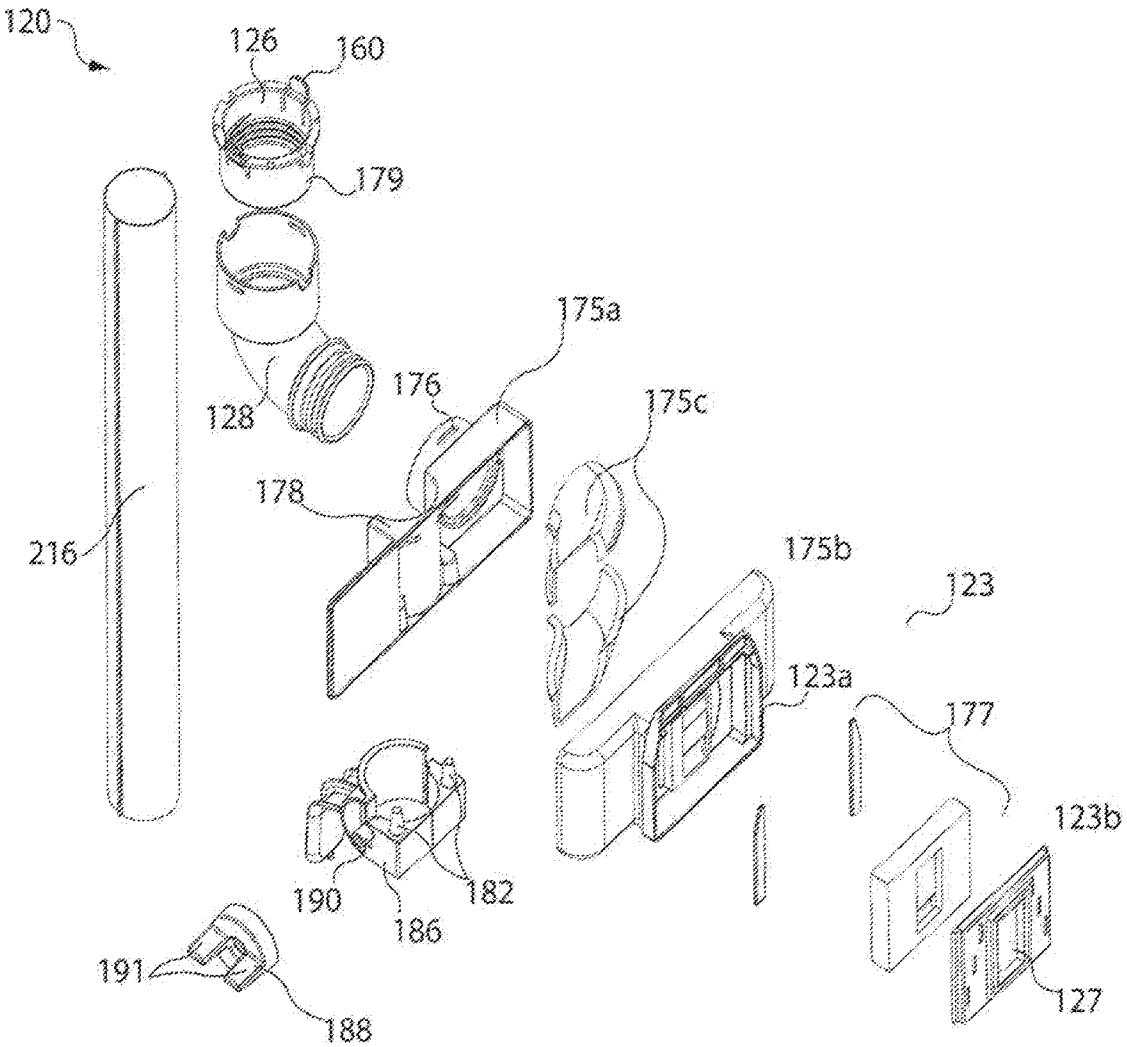
Figure 28:
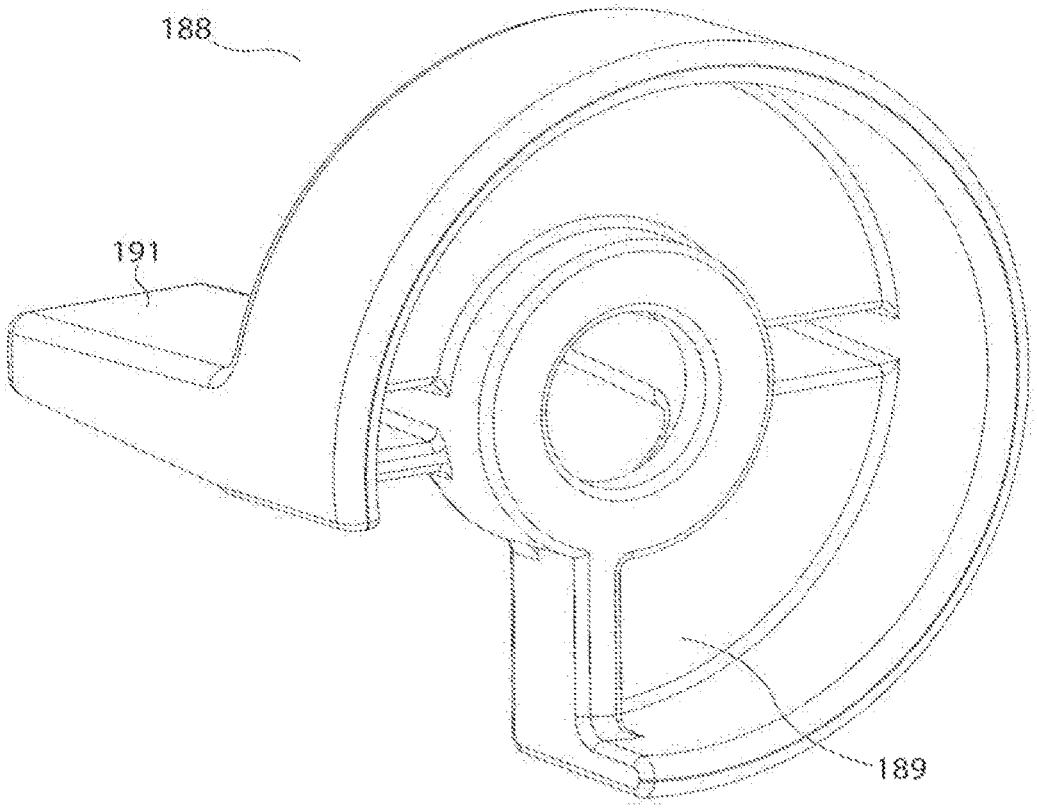
Figure 29:
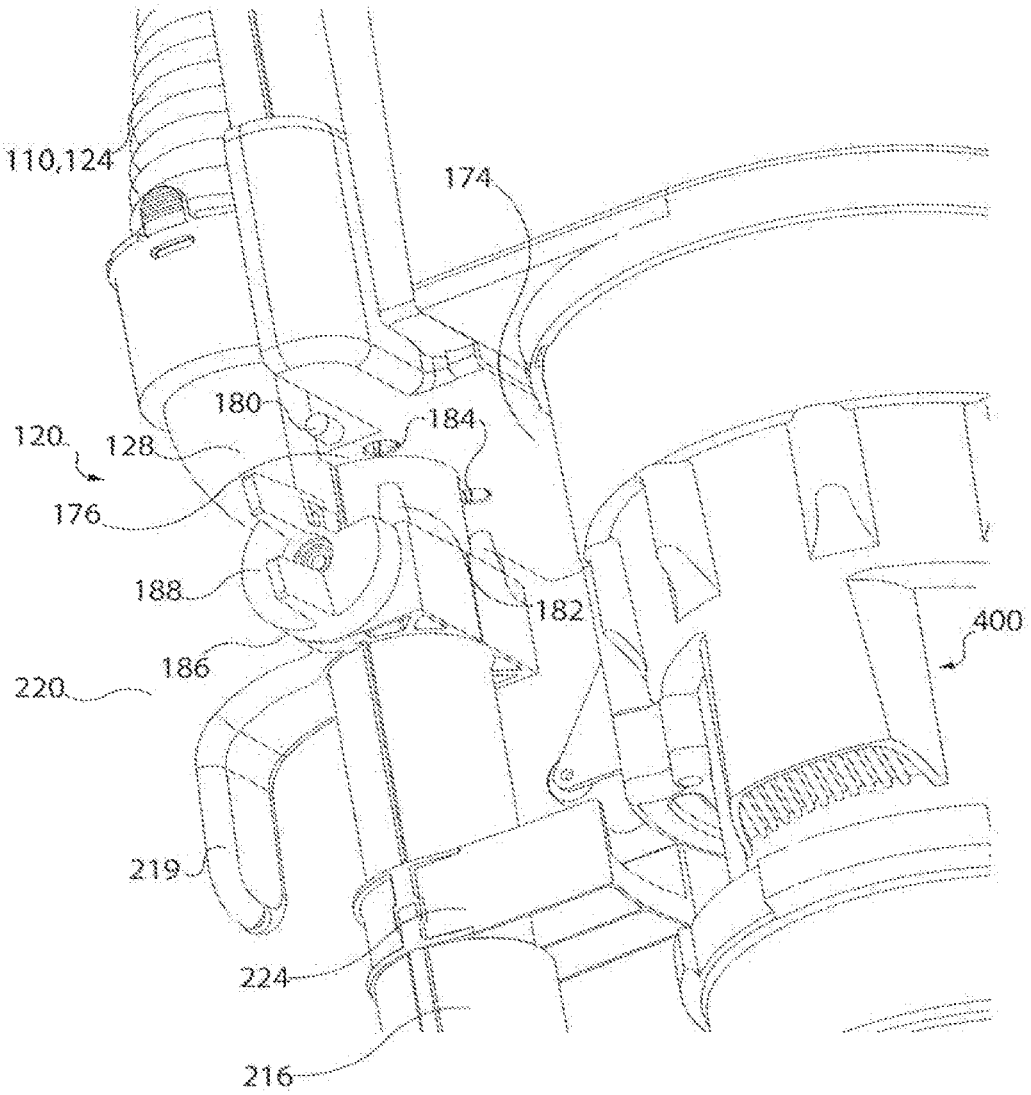
Figure 30:
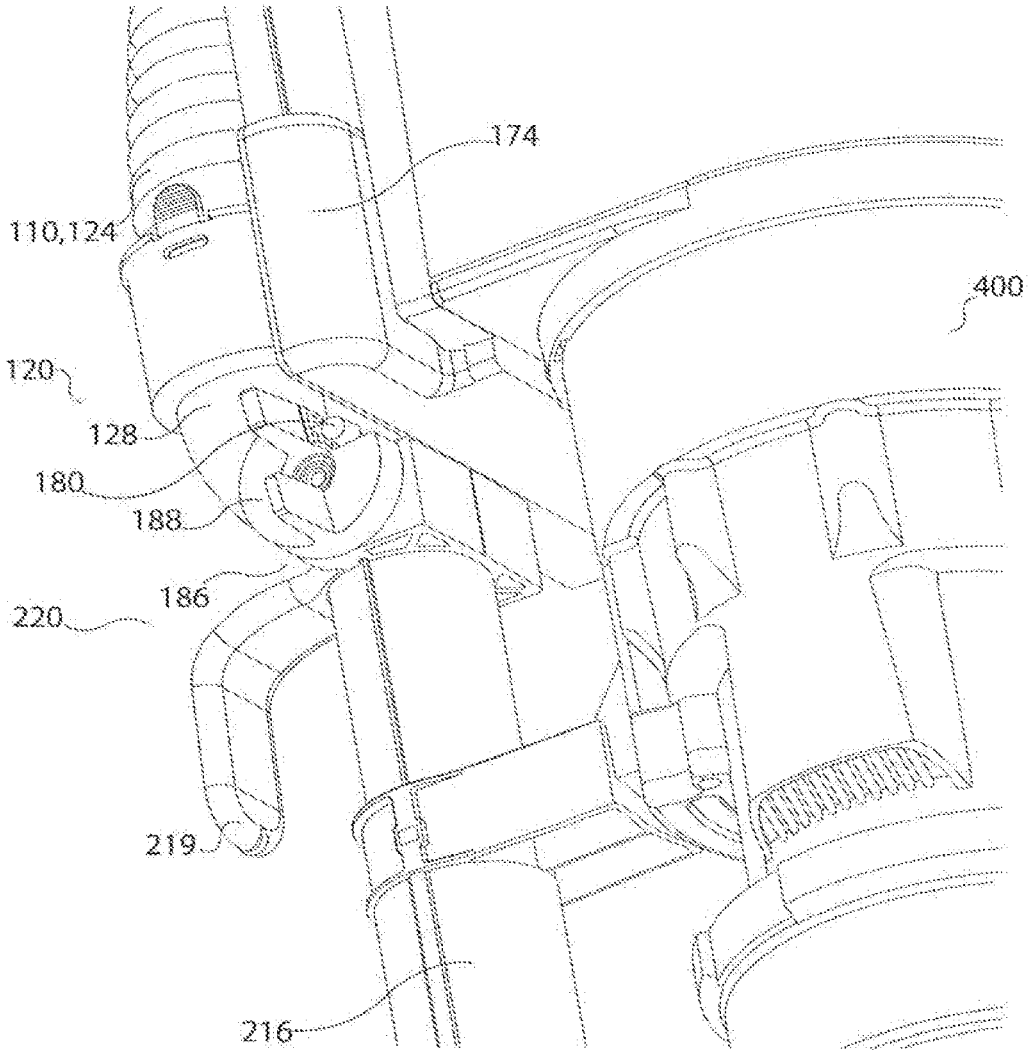
Figure 31:
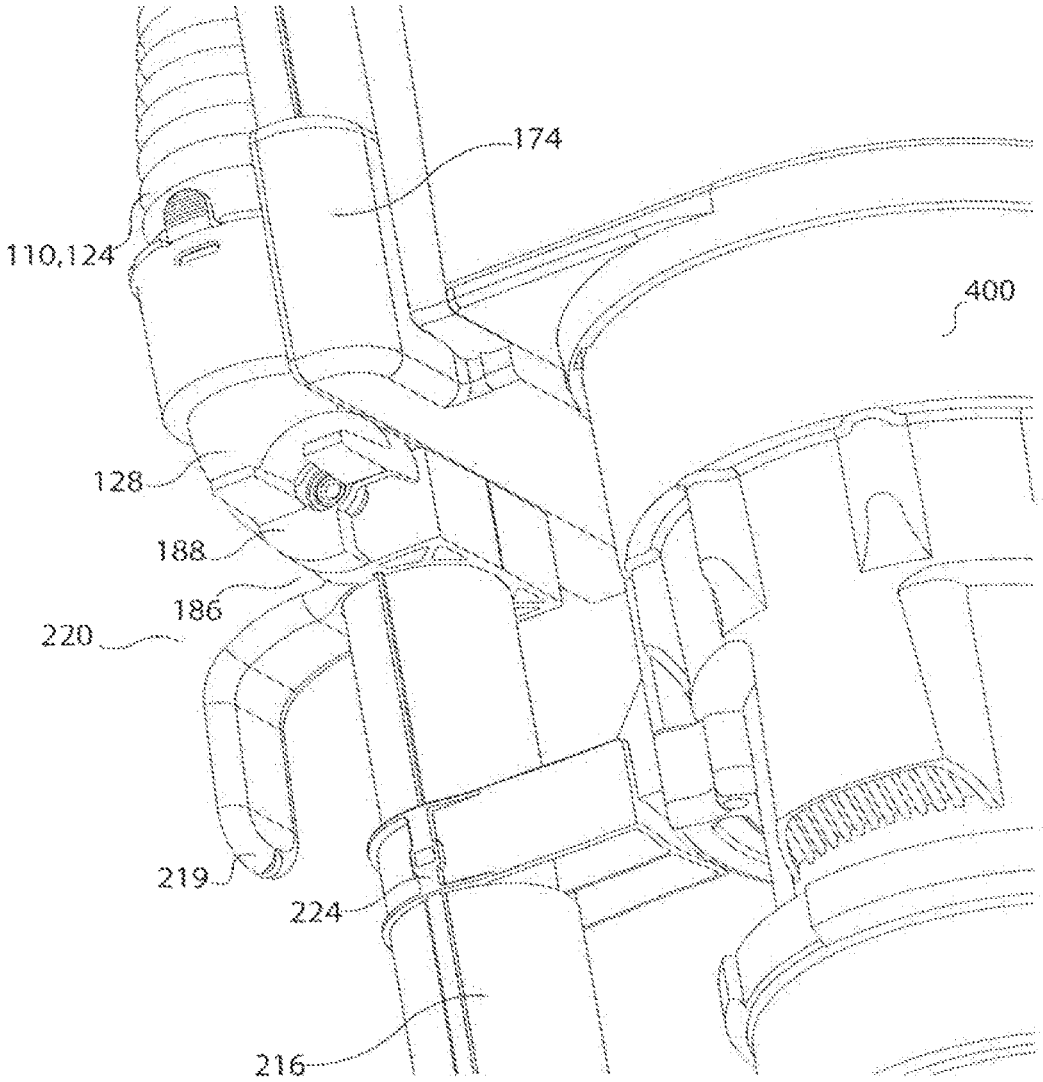
Figure 32:
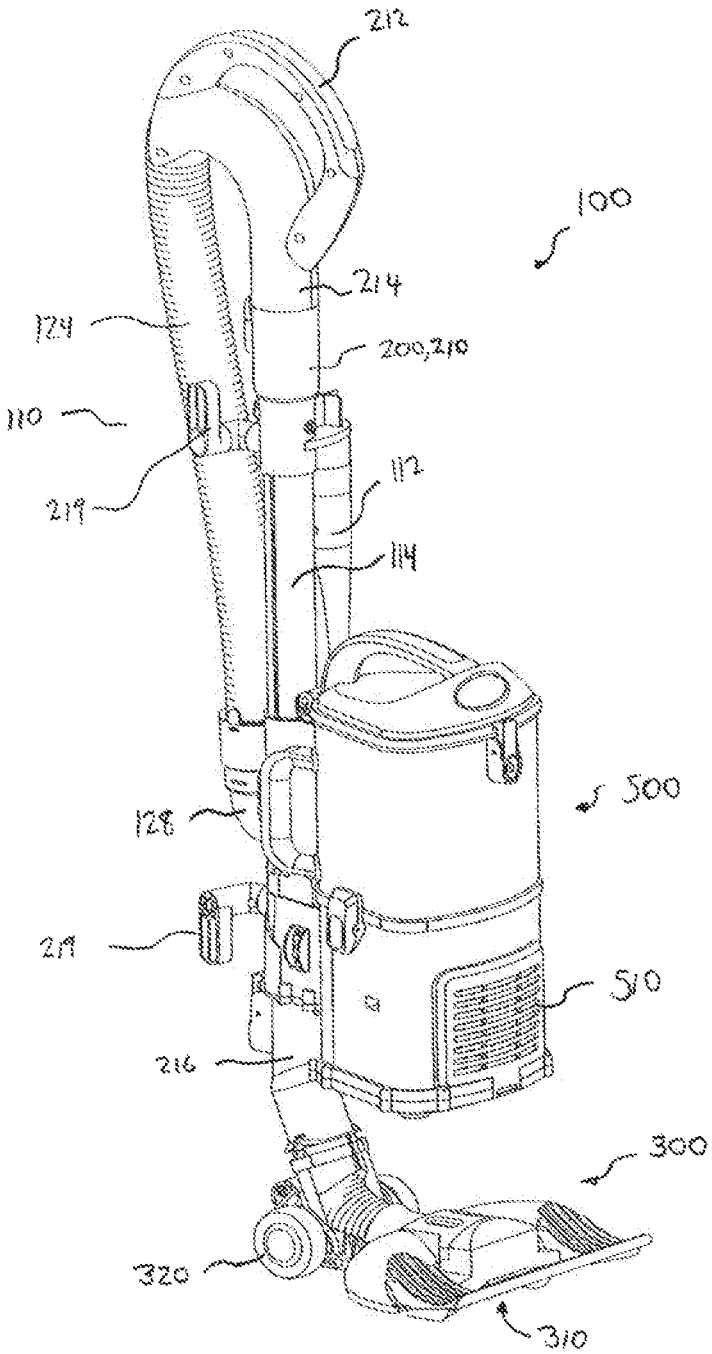
Figure 33:
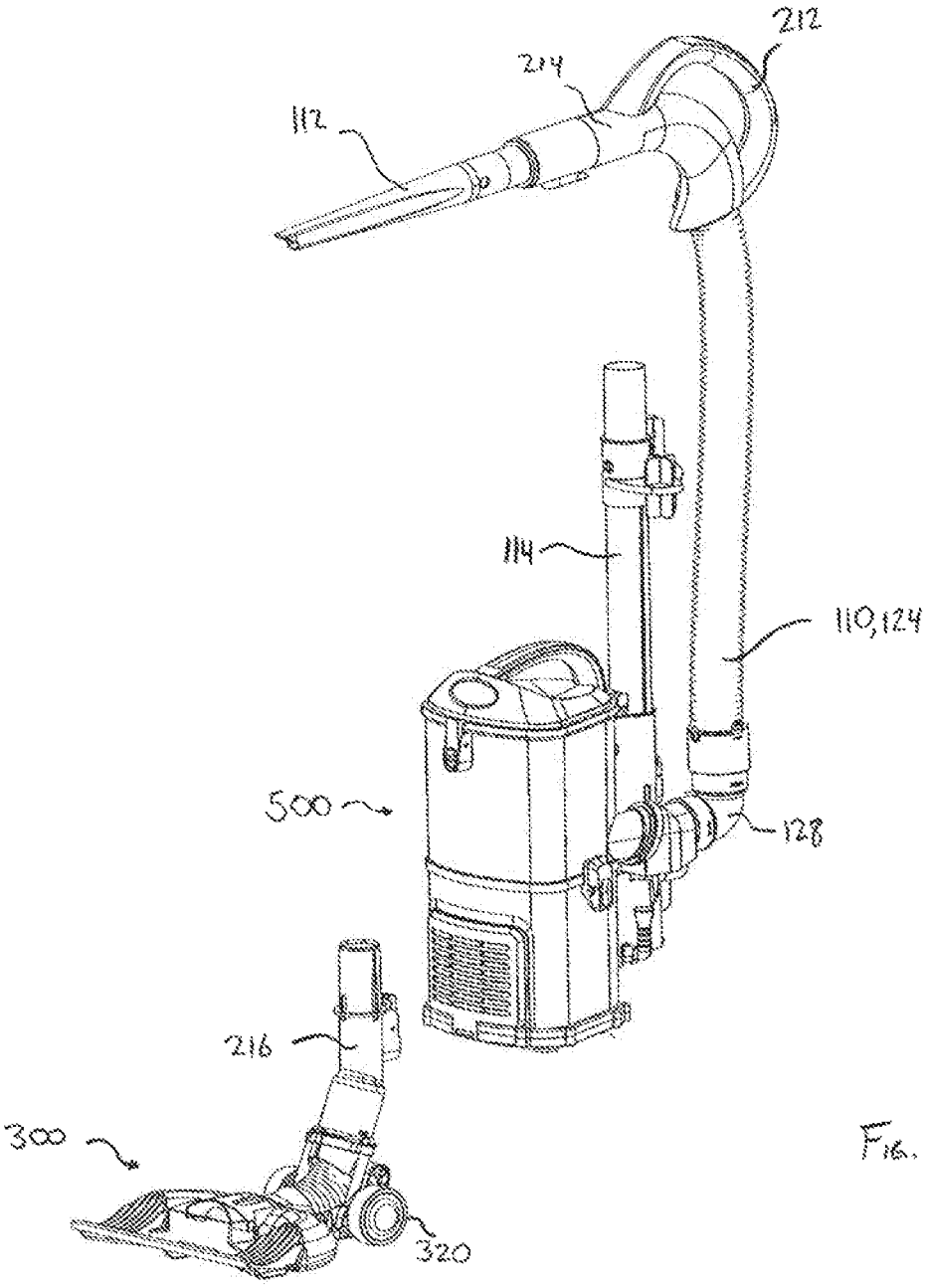
Figure 34:
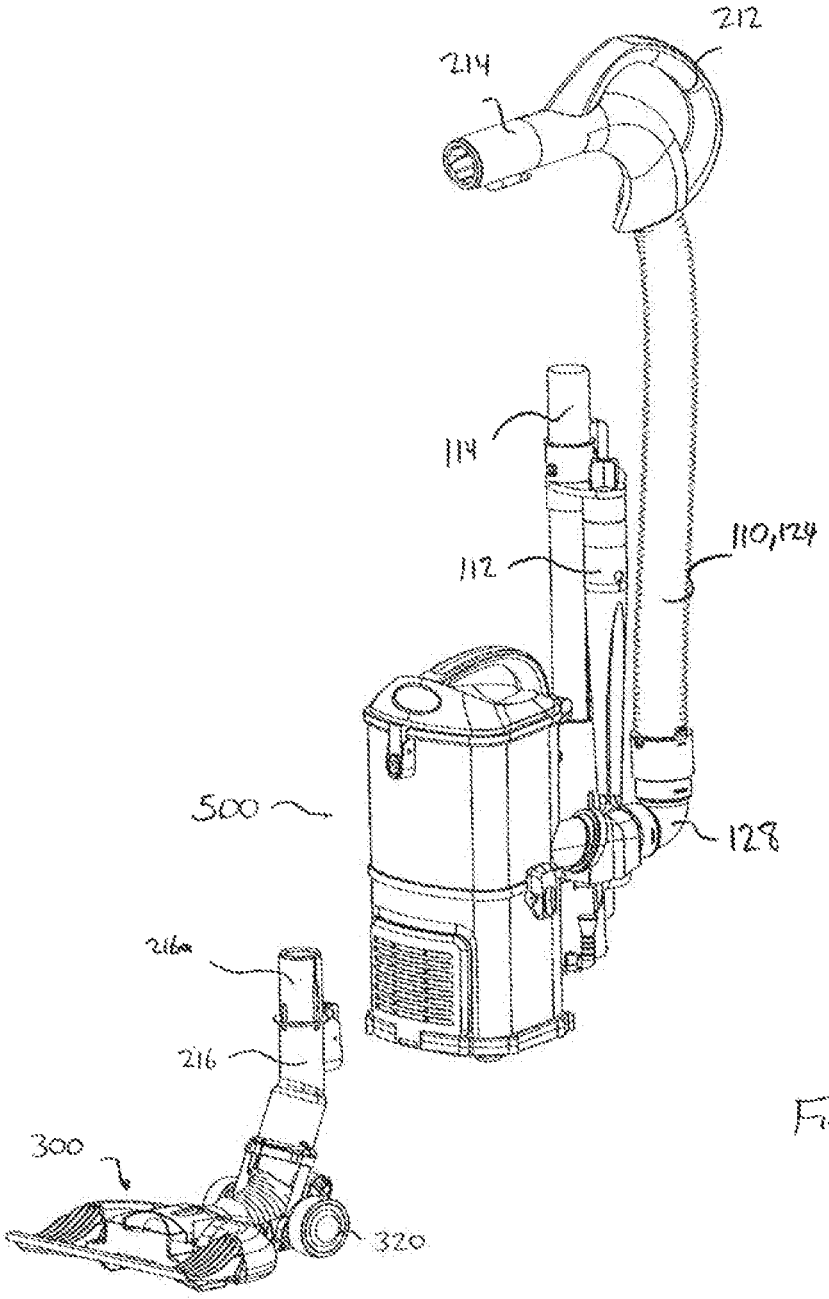
Figure 35:
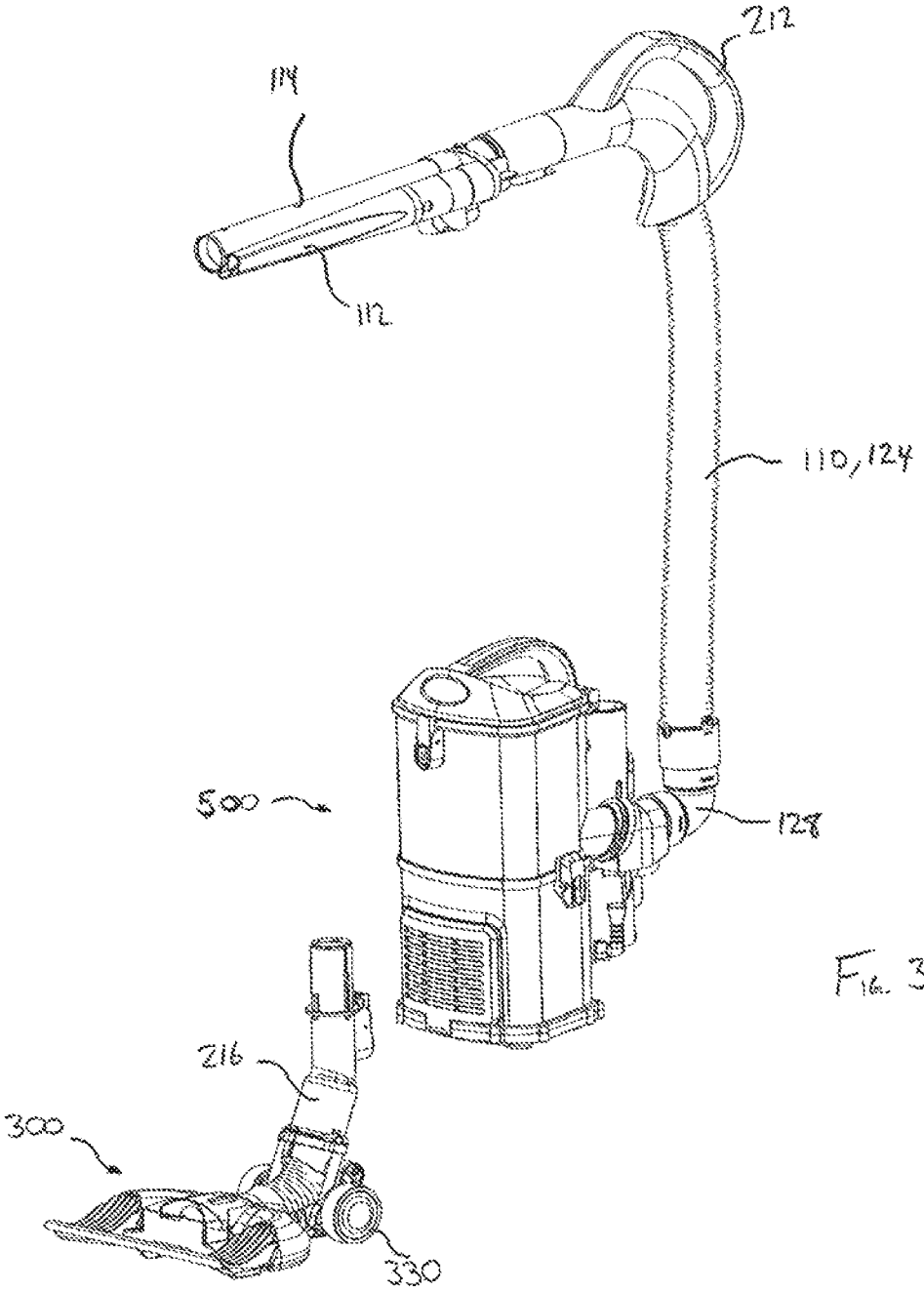
Figure 36:
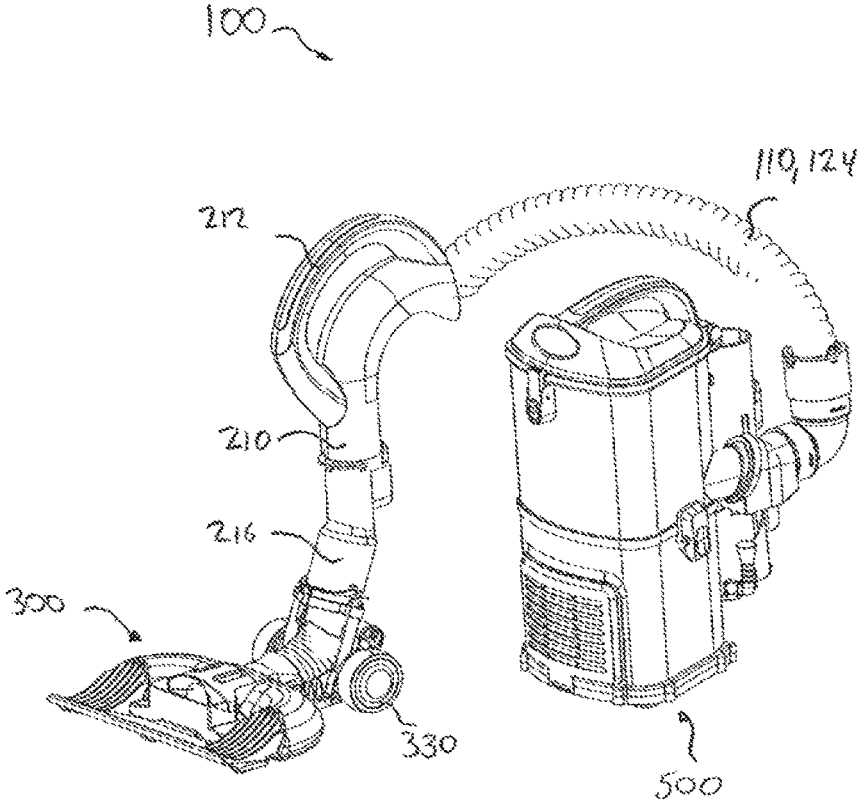
Figure 37:
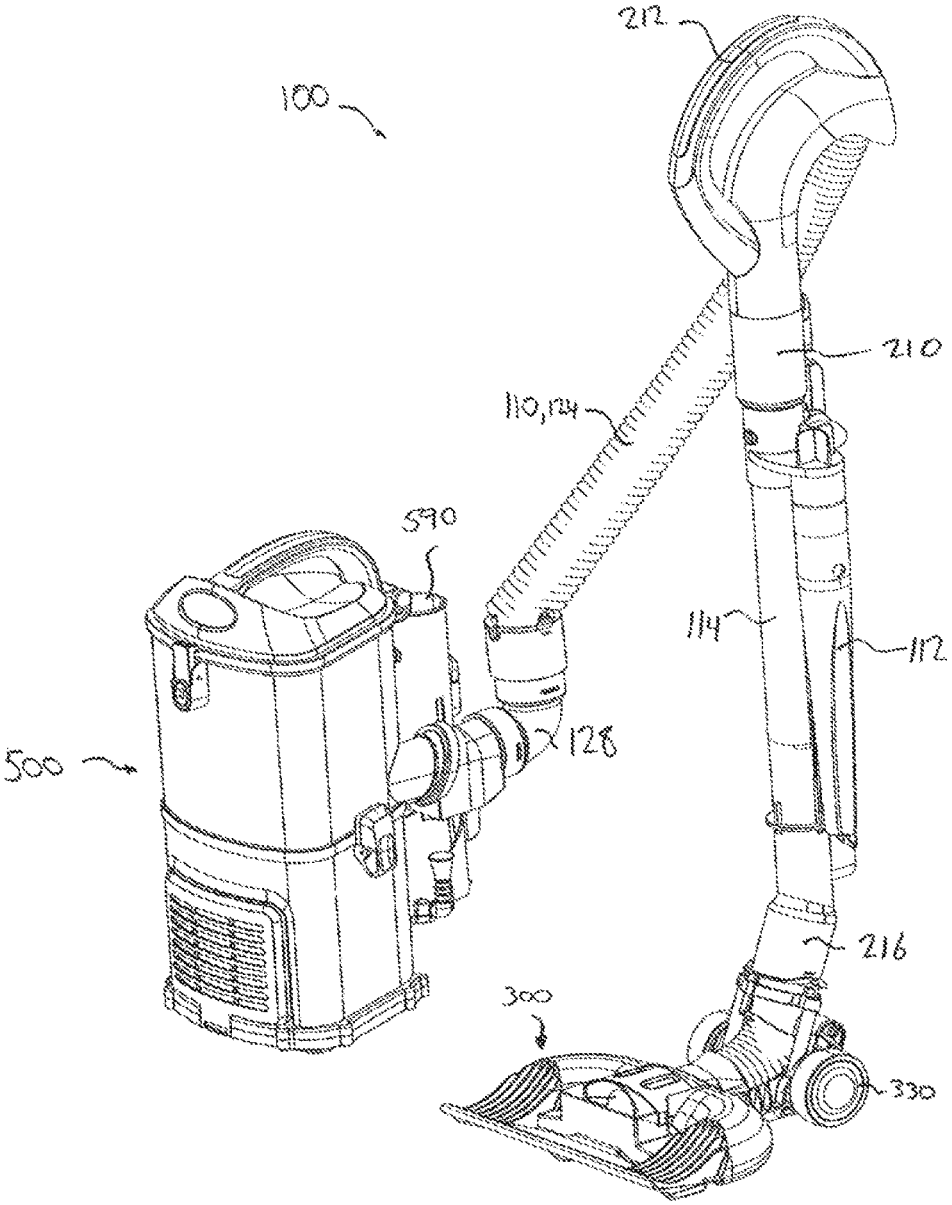
Figure 38:
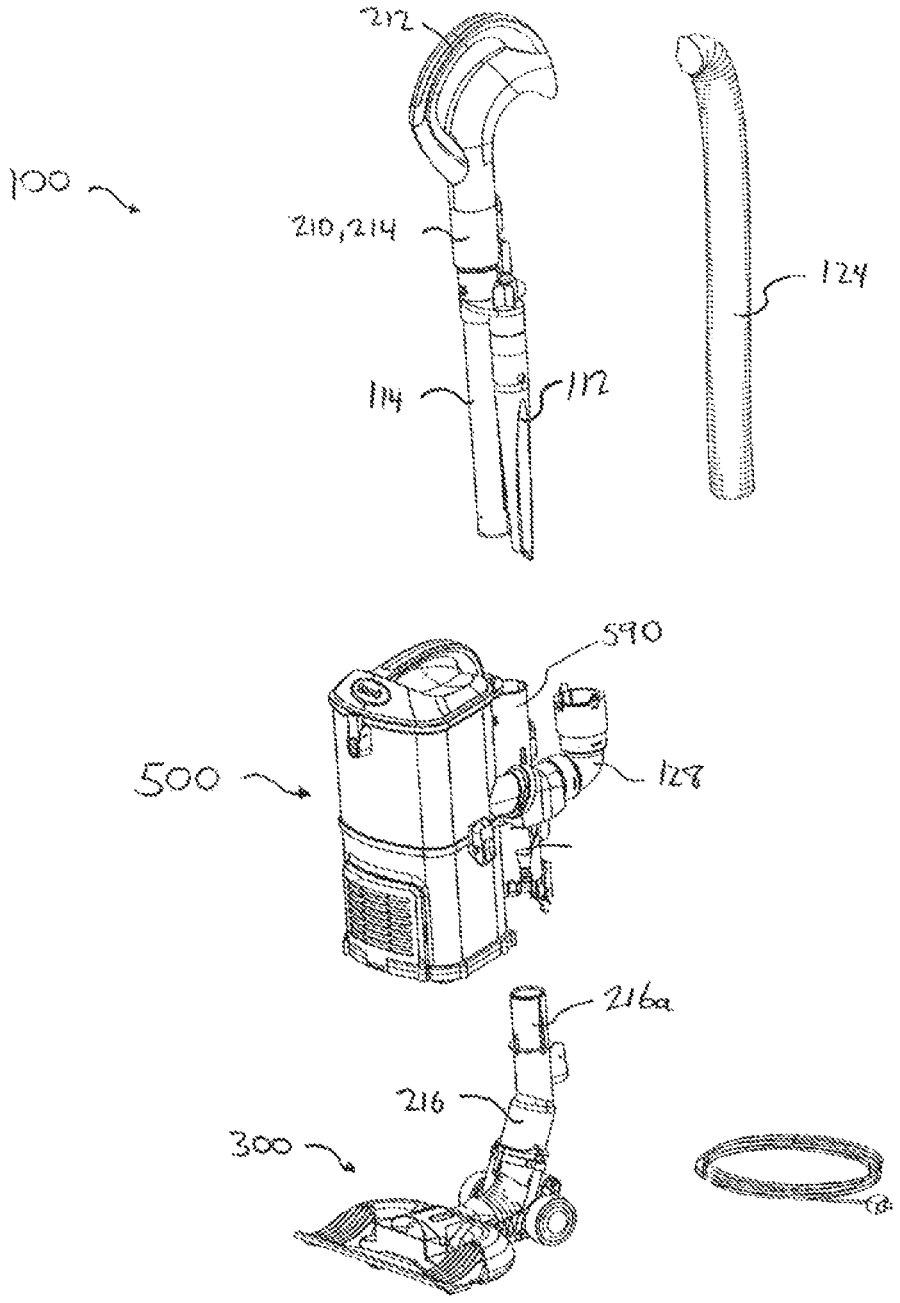

FIG. 15;

FIG. 17 is a rear isometric view of an alternate example of a vacuum cleaner with a cleaning unit mounted thereto;

FIG. 18 is a partial front isometric view of the vacuum cleaner of FIG. 17 with the cleaning unit removed;

FIG. 19 is a partial top view of the surface cleaning head of the vacuum cleaner of FIG. 17;

FIG. 20 is a side elevation view of an alternate example of a vacuum cleaner with a cleaning unit mounted thereto;

FIG. 21 is a front isometric view of an alternate example of a vacuum cleaner with a hand vacuum cleaner mounted thereto;

FIG. 22 is a side elevation view of the vacuum cleaner of FIG. 21;

FIG. 23 is a side elevation view of the vacuum cleaner of FIG. 21 with the cleaning unit removed from the floor cleaning unit;

FIG. 24 is a side elevation view of the vacuum cleaner of FIG. 21 with the cleaning unit separated from the flexible hose;

FIG. 25 is a rear isometric view of an alternate example of an attachment member;

FIG. 26 is a front isometric view of the attachment member of FIG. 25;

FIG. 27 is an exploded view of the attachment member of FIG. 25;

FIG. 28 is a rear isometric view of a locking knob;

FIG. 29 is a isometric view of the attachment member of FIG. 25 in use on the vacuum cleaner of FIG. 21;

FIG. 30 is an isometric view of the attachment member of FIG. 29 with the shell seated on the mount and the knob in an unlocked position;

FIG. 31 is an isometric view of the attachment member of FIG. 30 with the shell seated on the mount and the knob in the locked position;

FIG. 32 is a front isometric view of an example of a surface cleaning apparatus in an upright operating mode;

FIG. 33 is a front isometric view of the surface cleaning apparatus of FIG. 32 configured in a portable operating mode;

FIG. 34 is a front isometric view of the surface cleaning apparatus of FIG. 32 configured in another portable operating mode;

FIG. 35 is a front isometric view of the surface cleaning apparatus of FIG. 32 configured in yet another portable operating mode;

FIG. 36 is a front isometric view of the surface cleaning apparatus of FIG. 32 configured in yet another portable operating mode;

FIG. 37 is a front isometric view of the surface cleaning apparatus of FIG. 32 configured in yet another portable operating mode; and FIG. 38 is a partially exploded view of the some of the possible releasably mounted components of the surface cleaning apparatus of FIG. 32.

DESCRIPTION OF VARIOUS EXAMPLES

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

The following description describes various embodiments of an upright surface cleaning apparatus, for example an upright vacuum cleaner. The upright surface cleaning apparatus generally comprises a support structure or upright section that is movably connected to a surface cleaning head.

Referring to FIGS. 1 to 5, 15 to 19, 20 and 21 to 31, examples of an upright surface cleaning apparatus 100 are shown which exemplifies the design using a cleaning unit that is a hand vacuum cleaner 400. FIGS. 32-38 exemplify the design using a cleaning unit that is a portable cleaning apparatus 500, that need not be configured to operate as a separate hand vacuum cleaner when detached from the cleaning apparatus 100.

The surface cleaning apparatus 100 is a vacuum cleaner that comprises a floor cleaning unit 200 comprising a surface cleaning head 300 having a support structure 210 pivotally mounted thereto and a cleaning unit, for example hand vacuum cleaner 400 or portable surface cleaning apparatus 500, that is removably mounted to support structure 210. Support structure 210 may also be referred to as a handle, a backbone or an upright section. In this specification, the terms portable surface cleaning apparatus 500, hand vacuum and hand vacuum cleaner 400 are used alternately to refer to the cleaning unit.

It will be appreciated that in each example, the surface cleaning apparatus 400 need not be a portable cleaning unit having a dirty air inlet for cleaning a surface, for example the portable cleaning apparatus 500 illustrated in FIGS. 32-38. Instead it may be a cleaning unit that houses a suction motor and one or more air treatment members (e.g., one or more cyclones with one or more filters). Such a cleaning unit does not have a dirty air inlet adapted to clean a floor. Instead, it is configured to receive dirty air conveyed from floor cleaning unit 300. For example, the cleaning unit may be detachable from the support structure 210 as exemplified in FIG. 3*a*, FIG. 23 and FIG. 37 but flexible hose 124 may not be removable from the cleaning head, floor cleaning unit 200 or the cleaning unit. The support structure 210 (or other elements) may also comprise cord wind members 219 (as exemplified in FIGS. 17, 21 and 32) for winding the power cord of the vacuum cleaner 100 when not in use.

In accordance with a first aspect, the support structure may be of any particular design that is flexible or bendable at a location between the upper end and the lower end of the support structure when in use. Preferably, the support structure includes a hinge that pivotally connects an upper and lower portion of the support structure. In accordance with this aspect, the support structure comprises first and second portions wherein the second portion is rotatable relative to the first portion about an axis that intersects a longitudinal axis of at least one of the first and second portions.

As exemplified in FIGS. 1-5, 15-19, 20 and 21-24, the support structure 210 (also referred to as the handle 210) has an upper portion 214 and a lower portion 216 that are preferably pivotally connected by a hinge 218. Any type of hinge, pivot or bending mechanism known in the vacuum cleaner arts may be used provided that grip 212 may be moved forwardly with respect to the upper end of lower portion 214. The handle 210 is attached to the surface cleaning head 300 and a user can move the surface cleaning head 300 along a surface to be cleaned by gripping and maneuvering the handle 210. Optionally, the lower portion 216 of the handle 210 may be moveably, e.g., hingedly or pivotally, attached to the surface cleaning head 300, so that the lower portion 216 of the handle 210 can move relative to the surface cleaning head 300 during use. This may enable the user to move the surface cleaning head 300 beneath cabinets, furniture or other obstacles.

In other examples, as exemplified in FIGS. 32-38, the support structure, or handle 210, may not have a bendable or hinged configuration. In this example, the handle 210 may include an upper portion 214 and a complimentary lower portion 216 that are rigidly connected by an intervening member, for example detachable wand 114. In this example, the upper and lower portions 214, 216 cooperate with the wand 114, and optional coupling chamber 590 formed in the housing of the portable cleaning apparatus 500, to provide the support structure 210 and floor cleaning unit 200.

The upper portion 214 of the handle optionally includes a handgrip or grip 212 that is shaped to be gripped by a user. In the examples shown, the grip 212 is at the top, or upper end of the upper portion 214 of the handle 210 and is formed in a closed loop-type shape having surfaces that are rounded to increase user comfort. In other examples, the grip 212 may be of a different configuration and may be located at a different position on the upper portion 214 of the handle 210.

Alternately, or in addition, the upper portion 214 of the handle 210 optionally includes a bracket 113, as exemplified in FIGS. 1-5, which supports an auxiliary, or accessory or supplemental cleaning tool 112. In the example shown, the bracket 113 is configured to hold a single auxiliary cleaning tool 112, but in other examples the bracket 113 may be configured to hold more than one auxiliary cleaning tool 112. Also, while shown attached to the upper portion 214, it is understood that the bracket 113 may be attached to other locations on the surface cleaning apparatus, including the lower portion 216 as exemplified in FIGS. 17 and 21, the rigid extension wand 114 as exemplified in FIGS. 32-38, the surface cleaning head 300 and/or the hand vacuum cleaner 400 or portable cleaning apparatus 500.

Optionally, the cleaning unit is not retrained within, e.g., a recess, in an outer housing or other portion of the support structure. As exemplified in FIGS. 1-5, 15-19, 20, 21-24 and 32-38, an upright vacuum cleaner 100 has an absence of a housing or shell that has traditionally been used with upright vacuum cleaners. For example, no molded plastic shell is provided that houses operating components of the vacuum cleaner and includes a recess for receiving the hand vacuum cleaner 400 (or portable surface cleaning apparatus 500). Instead, as exemplified, one or more support rods or structural members may be used, e.g., one as exemplified in FIGS. 1-5, 20, 21-24 and 32-38 or two as exemplified in FIGS. 15-19, so as to define a frame to removably receive the cleaning unit. In such an embodiment, the support rods may define a frame for removably receiving the cleaning unit. As exemplified, preferably the support rods or structural members that form the upper and lower portions 214, 216 have a generally cylindrical or tube-like shape. However, in other examples, the upper and lower portions 214, 216 may be any other type of relatively thin or elongated support members having suitable cross-sectional shape including square, rectangular or polygonal. In addition, the upper and lower portions 214, 216 may be solid or hollow and may be formed from any suitable material, including plastic and metal. If one or both of the upper and lower portions 214, 216 are hollow, then the hollow portion may form part of the air flow path through the vacuum cleaner, as exemplified in FIGS. 20-23 and 32-38.

When the hinge 218 is in a first position, as shown in FIGS. 1, 2, 4, 5, 15, 16, 20 and 21-24 the upper and lower portions 214, 216 of the handle 210 are generally aligned with each other, e.g., they each have a longitudinal axis and the axis are generally parallel. As exemplified in FIGS. 15 and 22, the axis of the upper portion 214 may be located forward of the axis of the lower portion 216. The hinge 218 is preferably retained in this first position by a biasing or locking means so that the upper portion 214 of the handle 210 preferably remains at a fixed angular position with lower portion 216 when the lock is engaged so that forward and rearward movements applied to grip 212 of the upper portion 214 of the handle 210 can be translated to the second portion 216 as is known conventionally. In use, the hinge 218 can be unlocked, or released from the first position and upper portion 214 may be moved into one or more second fixed positions, wherein the grip 212 is preferably rotated forwardly. Optionally, the lock may remain in the unlocked position such that upper portion 214 may freely rotate with respect to the lower portion 216 while it is used to move the cleaning head.

In examples in which the support structure 210 is articulated, as exemplified in FIGS. 1, 2, 4, 5, 15, 17, 20 and 21-24, the grip 212 preferably comprises an actuator for releasing or unlocking the releasable lock or hinge 218, for example a button or hinge release 213 that can be activated by a user during use of vacuum cleaner 100 to unlock the hinge 218. It will be appreciated that the actuator may be of any type and may be located at any location and is preferably provided on the upper portion and is preferably adjacent the grip 212. When a user activates the hinge release 213, the retaining or locking means used to secure the hinge 218 in the first position is disengaged, allowing the hinge 218 to rotate or pivot, as shown in FIGS. 3*a* and 17. As the hinge 218 rotates, the first portion 214 of the handle 210 can be moved into a plurality of angular positions relative to the second portion 216 handle 210. Optionally, the hinge 218 may rotate between, and lock into, one or a given number of set or indexed angular positions. Alternatively, the rotation of the hinge 218 may be continuously variable, after being initially unlocked, allowing for the first portion 214 to be moved into an indefinite number of angular positions relative to the second portion 216 (e.g., freely rotatable). In examples in which the support structure 210 is not articulate (i.e. does not include a hinge) as exemplified in FIGS. 32-38, the grip 212 may not include such an acutator.

The upright surface cleaning apparatus also includes a cleaning unit, for example hand vacuum cleaner 400 or portable cleaning apparatus 500. The cleaning unit is attached to and supported by the support structure 210.

Preferably, the cleaning unit is removably mounted to the support structure and it may be detachably mounted thereto. Preferably, in some configurations, the cleaning unit can be removable from support structure 210 while still in air flow communication with the cleaning head 300. Accordingly, in some examples, an attachment member 120 may be used to provide both a member to removably attach the cleaning unit to support structure 210 and an air flow connection when the cleaning unit is removed with the attachment member 120.

In the some of the examples shown, the hand vacuum cleaner 400 is attached to the support structure 210 using a mount apparatus, for example mount 220. Preferably, instead of connecting directly to the hand vacuum cleaning 400, the mount apparatus is configured to receive a complimentary attachment apparatus, for example attachment member 120, which is connected, and preferably removably connected, to the hand vacuum cleaner 400. Preferably, as exemplified in FIGS. 1, 2, 4, 5, 15-19, 20 and 21-24, the lower portion 216 comprises the mount 220 for supporting the hand vacuum cleaner 400. It will be appreciated that, alternately, mount 220 may be provided on upper portion 216.

Hand vacuum cleaner 400 is preferably connected in fluid communication with the cleaning head 300 by a conduit that comprises, and may consist of, a flexible hose. In such a case, the lower portion 216 also optionally comprises a hose guide 230, as exemplified in FIGS. 1, 2, 4 and 5 for keeping the flexible hose 124 in close proximity to the support structure 210. When the hand vacuum cleaner 400 is detached or removed from the support structure 210 the flexible hose 124 may be removed from the hose guide 230, as shown in FIG. 3*a*. In another example, as exemplified in FIGS. 15-19, 20 and 21-24, a hose guide may not be included when the upstream end of the flexible hose 124 is connected in air flow communication with an upper end of the lower portion 216 instead of directly to the surface cleaning head 300.

In some examples, as exemplified in FIGS. 1-5, the flexible hose 124 may comprise substantially the entire length of the airflow conduit 110 connecting the hand vacuum 400 to the surface cleaning head 300. In other examples, as exemplified in FIGS. 20 and 21-34, the flexible hose 124 may comprise only a portion of the airflow conduit 110 and another portion of the airflow conduit 110 may be formed by the lower portion 216 of the support structure 210 (e.g., a hollow support rod).

In some examples, as exemplified in FIGS. 32-38, the air flow path connecting the portable cleaning apparatus 500 to the surface cleaning head 300 can include the upper and lower portions 214, 216, the flexible hose 124 and the cleaning wand 114.

In a second aspect, which may be used by itself or with any one or more other aspects, e.g., with or without a bendable wand and/or with or without a gravity mount, examples of the upright vacuum cleaner 100 may be operated in one or more of the following functional configurations or operating modes, and preferably all of the following modes. The versatility of operating in different modes is achieved by permitting hand vacuum cleaner 400 to be removed from support structure 210 with or without attachment member 120. Alternately, or in addition, further, versatility is achieved by permitting flexible hose 124 to be disconnectable from attachment member 120 and/or the cleaning head 300. Alternatively, or in addition, further, versatility of some examples is achieved permitting portable cleaning apparatus 500 to be removed form support structure 210 in a variety of configurations, as explained in detail below.

In a first configuration, exemplified in FIGS. 1, 2, 17, 20 and 22, the vacuum cleaner 100 can be operated with the hand vacuum cleaner 400 mounted to the lower portion 216 of the floor cleaning unit 200. In this configuration the hand vacuum cleaner 400 is supported by the support structure 210 and the vacuum cleaner 100 can be operated as an upright vacuum cleaner. In this configuration, the hand vacuum cleaner 400 is attached to the support structure 210 using, e.g., an attachment member 120 (examples of attachment members are described in greater detail below). In some examples, a portion of the load of the hand vacuum cleaner 400 is optionally also supported by a mount bracket 224, which receives and supports another part of surface cleaning apparatus 400, such as optional rear wheel 480 of the surface cleaning apparatus 400.

In another example of an upright operating mode, as exemplified in FIG. 32, the portable cleaning apparatus 500 is mounted to the lower portion 216 and is fluid communication with, and is rollingly supported by the surface cleaning head 300. In this configuration, or mode, the air path from the dirty air inlet 310 to the portable cleaning apparatus 500 includes the upper and lower portions 214, 216, the wand 114 and an optional flexible air flow conduit, for example the flexible hose 124. Proximate members in the air flow pathway, for example the lower end of extension wand 114 and the upper end of the lower portion 216, may be directly connectable or, as exemplified in FIGS. 32-38, may be connected using a suitable, relesable coupling member, for example coupling chamber 590 formed in the housing of the portable cleaning apparatus 500, to provide the desired substantially air-tight connection. The flexible air flow conduit includes a portable portion that is removably mounted to the surface cleaning apparatus 100. In this example, the entire flexible hose 124 and upper portion 214 are removably connectable to the wand 114 and the lower portion 216, as explained below.

In a second configuration, the surface cleaning apparatus 100 is operable in one or more of the following portable operating mode. In one portable operating mode, as exemplified in FIGS. 3*a* and 23, the surface cleaning apparatus 400 is detached from the support structure 210 but remains in fluid communication with the surface cleaning head 300 via, e.g., flexible hose 124 and attachment member 120. In this configuration, the hand vacuum cleaner 400 may be carried by the user (or rested on the floor or other surface) while still serving as the vacuum or suction source for the vacuum cleaner 100.

It will be appreciated that in some examples of this portable operating mode, as exemplified in FIGS. 3*a* and 23, the air flow passage between the portable surface cleaning apparatus 400 and the surface cleaning head 300 need not be reconfigured when the hand vacuum cleaner 400 is removed. In other words, a hose (for example flexible hose 124) need not be disconnected and then reconnected.

In another example of a portable operating mode, as exemplified in FIG. 37, the portable cleaning apparatus 500 is detached from the support structure 210 but remains in fluid communication with the surface cleaning head 300, via an air flow pathway including flexible hose 124, upper portion 214, wand 114 and lower portion 216. In this example no portions of the air flow pathway need to be reconfigured when the portable cleaning apparatus 500 is removed. A portable portion of the flexible air flow conduit, for example flexible hose 124 in combination with upper portion 214, is connected in fluid flow communication with the extension wand 114 and the extension wand 114 is communicably connected to the surface cleaning head 300, for example by lower portion 216.

Operating the surface cleaning apparatus 100 in this portable operating mode enables a user to remove the weight of the cleaning unit from the support structure 210 by separately carrying the cleaning unit (or resting it on the ground). This may allow a user to more easily maneuver the support structure 210 and cleaning head 300 around obstacles, for example furniture and stairs, on the surface being cleaned.

In another example of a portable operating mode, as exemplified in FIGS. 3*b*, 4 and 24, the surface cleaning apparatus 400 is detached from the support structure 210 and from fluid communication with surface cleaning head 300. The cleaning unit may have a nozzle and be a portable surface cleaning apparatus, such as a hand vacuum cleaner. As exemplified in FIGS. 4 and 24, the hand vacuum cleaner 400 may be uncoupled from the attachment member 120 (which remains attached to the support structure 210) and can be used independently as a portable cleaning apparatus or a hand vacuum.

In another example of a portable operating mode, as exemplified in FIGS. 33 and 34, the portable cleaning apparatus 500 is detached from the support structure 210 and the portable portion of the flexible air flow conduit, for example flexible hose 124 and upper portion 214, is detached from the extension wand 114. Detaching the upper portion 214 from the extension wand 114 severs the fluid communication between the portable cleaning apparatus 500 and the surface cleaning head 300. In some examples, as shown in FIG. 33, the portable portion of the air flow conduit can be connected to an auxiliary cleaning tool, for example crevasse tool 112. In other examples, as shown in FIG. 34, the exposed end of the upper portion 214 can be adapted to clean surfaces directly. Optionally, the extension wand 114 can remain attached to, and be moved with, the portable cleaning apparatus 500 in this configuration.

In yet another example of a portable operating mode, as exemplified in FIG. 35, the portable cleaning apparatus 500 can be detached from the lower portion 216 (thereby severing the fluid communication between the portable cleaning apparatus 500 and the cleaning head 300) and can remain fluidly connected to the extension wand 114. In this mode, the upper portion 214 remains connected to the downstream end of the extension wand 114 while the upstream end of the extension wand 114 is detached from the portable cleaning apparatus 500. In this configuration, a user can use the extension wand 114 to increase the cleaning range of the surface cleaning apparatus 110, as explained herein.

In yet another example of a portable operating mode, as exemplified in FIG. 36, the surface cleaning apparatus 100 can be configured so that the portable portion of the flexible air flow conduit, for example the upper portion 214 and flexible hose 124, is detached from the extension wand 114 and is connected in fluid flow communication with the surface cleaning head 300. In the present example, the upper portion 214 can be connected directly to the lower portion 216, i.e. without the use of extension wand 114 or portions of the housing of the portable cleaning apparatus 500, thereby establishing an air flow pathway from the surface cleaning head 300 to the portable cleaning apparatus. This configuration may enable a user to closely control the movements of the surface cleaning head 300 in situations where the extended reach of the extension wand 114 is undesirable, for example when cleaning furniture surfaces or stair treads.

Optionally, as exemplified in FIGS. 32-38, the components of the air flow pathway of the surface cleaning apparatus 100 can be configured such that they are generally interconnectable. For example, the lower end of the extension wand 114 can be configured to connected to both the coupling chamber 590 of the portable cleaning apparatus 500 (FIG. 32), and the lower portion 216 (FIG. 37). Similarly, the upper portion 214 can be configure to be connectable to the extension wand 114 (FIG. 32), the lower portion 216 (FIG. 36) and an auxiliary cleaning tool 112 (FIG. 33).

Optionally, in some examples, as exemplified in FIG. 3*b*, the surface cleaning apparatus 400 is detached from the support structure 210 and from fluid communication with surface cleaning head 300 by detaching a flexible air flow conduit, for example flexible hose 124 from the surface cleaning head 300. Accordingly, flexible hose 124 serves as an extended cleaning attachment for the hand vacuum cleaner 400. Optionally, one or both ends of flexible hose 124 may be disconnectable from the surface cleaning apparatus.

Accordingly, if the attachment member 120 is coupled to the hand vacuum cleaner 400, and the upstream end of the air conduit 110 (for example hose 124) is detached from the surface cleaning head 300, then the combination of the attachment member 120 and the flexible hose 124 (decoupled from the surface cleaning head 300) may serve as an auxiliary or accessory cleaning tool. The free end of the hose 124 may be maneuvered by the user to clean objects and surfaces that cannot be cleaned using the surface cleaning head 300. In some examples, the upstream end of the flexible hose 124 may be connected to the auxiliary cleaning tool 112. Alternatively, the flexible hose 124 may be removed from the attachment member 120 and the auxiliary cleaning tool 112 may be mounted directly to the air inlet 126 of the attachment member 120. It will be appreciated that tool 112 may have a plate 123 and arms 150 provided at the coupling end thereof.

Optionally, the attachment member 120 may be removed from the hand vacuum cleaner 400 and the auxiliary cleaning tool 112 may be fitted directly to the nozzle 412 (shown in FIGS. 6-10), without the use of a flexible hose 124 or other type intermediate air conduit. In addition to the auxiliary or accessory cleaning tool 112, the nozzle 412 may be directly connected to any one of a number of cleaning tools that have been provided with the an appropriate attachment member, including wands, brushes, crevasse tools and other hoses.

Optionally, a cleaning wand 114 may be attached to the upstream end of the flexible hose 124, as exemplified in FIGS. 20 and 32. The addition of the cleaning wand 114 to the end of the flexible hose 124 may enable a user to reach further (for example to the top of drapes or curtains) or to extend the airflow conduit 110 into confined spaces (for example between couch cushions or under cabinets and appliances). When assembled as shown in FIG. 21, the upright vacuum cleaner configuration, the dirty air travels from the cleaning head 300 through lower portion 216 (which is the up flow duct), through hose 124 and into mounting member 120.

In some examples, the cleaning wand 114 may be shaped so that it can be received within or in air flow communication with an upper opening 286 of the lower portion 216 of the support structure 210, as exemplified in FIG. 20.

In these examples, when the cleaning wand 114 is not in use it can be received within, and thereby stored within the lower portion 216 of the support structure 210 (not shown) or maybe mounted to upper end of lower portion 216 and form part of the support structure 210. In other examples, the cleaning wand 114 may be elsewhere and flexible hose 124 may be connected directly to upper opening 286.

In other examples, as exemplified in FIG. 32, the wand 114 may be rigid enough to provide structural strength to the surface cleaning apparatus 100, and may form part of the handle/support structure 210. In this example the extension wand 114 forms part of the air flow pathway when the surface cleaning apparatus is operated in the upright operating mode, and can be selectably included in one or more of the portable operating modes, as shown in FIGS. 33-37 and described in detail above.

In any of the examples described above, the air conduit 110 (for example flexible hose 124 and/or wand 114) may still be detachable from the surface cleaning head 300 even when the surface cleaning unit is not detachable from the support structure. Accordingly, some or all of air conduit may be detachable from the surface cleaning head 300 whether or not the hand vacuum cleaner 400 is detachable from the support structure 210 to enable a user to use the flexible hose 124 and/or the wand 114 to clean surfaces that are awkward to clean using the surface cleaning head 300, for example upholstery, drapes, stairs and other, non-level, confined or elevated surfaces.

As exemplified in FIG. 21, in a preferred embodiment, the lower portion 216 is hollow and forms part of the airflow passage through the vacuum cleaner. Accordingly, lower portion 216 functions as both an air flow conduit and a support structure on which surface cleaning apparatus 400 is mounted. If a rigid cleaning wand 114 is not required, then the dirty air may travel from lower portion 216 directly into surface cleaning apparatus 400, e.g., via attachment member 120. Alternately, if a cleaning wand 114 is provided, then as exemplified, the dirty air may travel from the upper end of lower portion 216 into wand 114, into flexible hose 124, through optional attachment member 120, and then into surface cleaning apparatus 400.

To provide the user with increased reach and cleaning range, the cleaning wand 114 may be more rigid than the flexible hose 124, and is preferably rigid, so that the cleaning wand 114 will maintain its generally elongate configuration (that is the upstream end of the cleaning wand being separated from but generally concentric with the downstream end of the cleaning wand), even when it is only held at one end by the user. In some instances, the cleaning wand 114 may be substantially rigid so that it will not deflect or bend during use. In other instances, the cleaning wand 114 may be more rigid than the flexible hose 124, but still somewhat resiliently flexible so that it can bend during use.

Optionally, the upstream end of the cleaning wand 114 can be connected to other auxiliary or accessory cleaning tools, for example an air turbine powered brush 116. In some instances, the cleaning wand 114 may not be required and the flexible hose 124 may be directly connected to the brush 116 or other accessory or auxiliary tool. Some auxiliary cleaning tools, for example the brush 116 may also be described as second surface cleaning heads or auxiliary cleaning heads. In some instances, the nozzle 412 (described in detail below) of the hand vacuum cleaner 400 may also be described as a second surface cleaning head, particularly when the hand vacuum cleaner 400 is configured as a hand vacuum. Optionally, the cleaning wand 114 or any other second surface cleaning head or auxiliary tool may be connected directly to the nozzle 412.

While in some of the examples described the cleaning unit is a portable surface cleaning apparatus 400 has a nozzle 412 that may be used to directly clean a surface, in other examples of the surface cleaning apparatus 100, as exemplified in FIGS. 32-38, the cleaning unit is a portable cleaning apparatus 500 that need not have a nozzle that can directly engage a surface. In these examples, carrying the cleaning unit separate from the backbone 200 and surface cleaning head 300 may still be advantageous as it may reduce the effort required to maneuver the support structure 210 and surface cleaning head 300 by removing the weight of the cleaning unit or by permitting the surface cleaning head to be used under furniture (as exemplified in FIGS. 3*a* and 37), and it may still allow the user to clean surfaces without the surface cleaning head 300 if the cleaning unit remains connected to the portable length or portion of flexible hose 124 or any other accessory or auxiliary cleaning device.

In accordance with a third aspect, which may be used by itself or with one or more of the other aspects, the removable cleaning unit is secured in position by gravity. This may be achieved using a mount 220 that removably receives attachment member 120.

Some examples of the mount 220 may be configured to removably receive a portion of the hand vacuum cleaner 400 or preferably, as exemplified, an attachment member 120 that may be removably coupled to the hand vacuum cleaner 400. Alternately, the attachment member may itself include the mount so that the attachment member may be removably attached directly to the lower portion 216. This may be achieved by the attachment member and the mount being an integrated assembly wherein the attachment member and the mount are not disconnectable from each other (i.e. the hand vacuum cleaner 400 can be removed but not with the attachment member) or the attachment member and the mount may be separable as exemplified in FIGS. 21-31, whereby the hand vacuum cleaner may be removed with or without the attachment member so as to increase the versatility of the surface cleaning apparatus.

The mount 220, as exemplified in FIGS. 1-5 and 15-19, is preferably configured to retain the hand vacuum cleaner 400 therein under the influence of gravity. Accordingly, a mechanical lock need not be used. In particular, a user may lift the portable surface cleaning apparatus off of upright section 210 without having to press a button or otherwise release a mechanical lock. The absence of mechanical fasters allows for simple, one-handed removal of the attachment member 120 and the hand vacuum cleaner 400 from the mount 220, without the need to unlock or undo any fasteners. One-handed detachment of the hand vacuum cleaner 400 may be advantageous as it allows a user to control and maneuver the support structure 210 with one hand while simultaneously removing the hand vacuum cleaner 400 from the mount 220 with the other hand. In use, this may allow a user to frequently attach and detach the hand vacuum cleaner 400 from the mount 220 in response to the user's needs, for example navigating around furniture, stairs or other obstacles on the surface to be cleaned.

Optionally, the mount 220 may be outfitted with magnets for retaining the attachment member 120. Magnets may assist in holding the hand vacuum cleaner on the mount and still permit one-handed removal as no fastener or lock need be manually released.

Alternatively, or in addition, as exemplified in FIGS. 21-31 a lock, for example a rotatable locking knob may be used to releasably secure adjustment member 120 and mount 220 together. In such an embodiment, it is preferred, as exemplified in the embodiment of FIGS. 21-31, that when the lock is disengaged, hand vacuum cleaner 400 is still held in position by gravity. Other examples of possible fasteners include clips, snaps, and straps. Magnets may alternately or in addition be used.

One example of a mount 220, as exemplified in FIGS. 1-5, is a generally U-shaped member sized to receive collar 140 or other mounting portion of the complimentary attachment member 120. The inner surface of the mount 220 comprises a protrusion 222 that extends outward from the inner surface of the mount 220 and removably seats within the generally U-shaped channel 144 of the collar 140.

In this example, loads placed on the mount 220 (via both the U-shaped opening and/or the mount bracket 224) are in turn transferred via the lower portion 216 of the handle 210 to the surface cleaning head 300 and ultimately to the floor or other type of surface being cleaned. Another portion of the load of the hand vacuum cleaner 400 may be supported by an additional mounting bracket, such as mount bracket 224, which receives and supports optional rear wheel 480 of the hand vacuum cleaner 400. The surface of the mount bracket 224 may be complimentary to the curved shape of the optional rear wheel 480 so that the optional rear wheel 480 can at least partially nest within mount bracket 224. An upward facing protrusion 222 on the inner surface of the mount 220 seats within the channel 144 of the attachment member 120 and provides a degree of lateral support, restraining the movement of the attachment member 120 (and therefore the hand vacuum cleaner 400) when the handle 210 is moved from a vertical position to an angled position when in use. Further, protrusion 222 may comprise a cam surface to assist in guiding protrusion 222 into channel 144 as the portable surface cleaning apparatus is lowered onto mount 220. In this example the attachment member 120 and the optional rear wheel 480 are preferably not held in place by clips, straps or any other type of mechanical fastening means.

As exemplified, in addition to supporting the weight of the hand vacuum cleaner 400, the attachment member 120 also preferably serves as a fluid conduit establishing a fluid flow connection between the hand vacuum cleaner 400 and the airflow conduit 110, which is preferably a flexible hose 124. The mount 220 may be made from any material that can support the weight of the hand vacuum cleaner 400, including plastic and metal.

A second example of a mount 220, as exemplified in FIGS. 15-19 comprises more than one member configured to receive the collar portion 140 of attachment member 120. As exemplified, two support rods or ribs 256 are provided, each or which holds part of mount 220.

Split saddle mount 220 comprises a pair of generally opposing saddle flanges 280 (one on each rib) that cooperate to provide a mount or a mounting location for the attachment member 120 that is connected to the hand vacuum cleaner 400. Due to the spacing of the ribs 256 and the general curvature of the hand vacuum cleaner 400, the hand vacuum cleaner 400 is preferably positioned in front of ribs 256. The attachment member 120 may extend rearward of hand vacuum cleaner 400 and may be received on split saddle flanges 280. Alternately, it will be appreciated that hand vacuum cleaner 400 may be partially nest between, or be received between, the ribs 256.

As exemplified, to supportingly engage the attachment member 120, each saddle flange 280 preferably includes a projection or protrusion (see FIG. 18) that is received within the channel 144 of the collar 140 (as described in more detail with reference to FIGS. 11-14 below). The generally curved profile of the collar 140 and channel 144 may enable the attachment member 120 (and the associated hand vacuum cleaner 400) to generally self-level or self-register between the ribs 256 when the user initially places the attachment member 120 on the saddle flanges 260. Optionally, the saddle flanges 260 may include magnets or other fastening devices to secure or retain the attachment member 120.

Ribs 256 are secured in position by a connecting structure at the upper and lower end of ribs 256. Any such structure may be used. As exemplified in FIGS. 15-19, second portion 216 may comprise a generally upside down U-shaped wishbone portion 250 to secure the upper ends of ribs 256 together.

If used together with the first aspect, the wishbone 250 may be provided with a hinge 218 at the centre of an upper portion of the wishbone 252, and each prong 254 of the wishbone extends downward, and connects to a rib 256. The ribs 256 are preferably substantially parallel and cooperate to define a split saddle mount 220 for receiving the attachment member 120 and the hand vacuum cleaner 400. Optionally, the ribs 256 may be integrally formed with the prongs 254 of the wishbone portion 250, or they may be separate tubes or rods fastened to the prongs 254 of the wishbone 250, as shown.

The lower ends of the ribs 256 may be attached to a bracket 260 having a generally opposite configuration than the wishbone. That is, the bracket may include two, upward facing projections 262, for attaching to the ribs 256, that are connected by a cross-member 264 to provide a single downward facing coupling point 266. An advantage of providing a single, downward facing coupling point may be the fact that a single coupling point can be pivotally and rotationally connected to the surface cleaning head 300. Another advantage is that a narrower rear end may be utilized for the surface cleaning head 300.

The bracket 260 also includes a housing 268, which is preferably hollow, having a lower opening 270 that is connected in flow communication with the surface cleaning head 300 (e.g. by a rigid pipe as exemplified by FIGS. 20 and 21-31 or, by a flexible hose as exemplified in FIGS. 15-19). Housing 268 may be pivotally mounted to surface cleaning head, preferably at about the location of rear wheels 320, such as by having a portion pivotally mounted to the axle of rear wheels 320. Optionally, the connection between the lower opening 270 and the surface cleaning head 300 can be a rotatable and pivotal connection. The hollow housing 268 may extend from the lower opening 270, through the cross-member 264 to define an upper collar 272.

A third example of a mount 220 and complimentary attachment member 120 is exemplified in FIGS. 20 and 21-31, specifically FIGS. 25-31. This example of the attachment member 120 exemplifies an attachment member 120 that is lockably attachable to mount 220.

Mount 220 optionally comprises structural member 186 that has a central opening for receiving the lower portion 216 of the support structure 210. Mount 220 may be secured to lower portion 216 such as by a key, a set screw, an adhesive or other locking means. In the example illustrated the central opening of structural member 186 is generally annular (to receive the generally cylindrical lower portion 216), while in other examples the central opening may have a different shape that is complimentary to the profile of its respective lower portion. In other examples, the mount 220 may be integrally formed with the lower portion 216.

The mount 220 also comprises a pair of upwardly extending bosses 182. The bosses 182 may be integral with structural member 186 and are sized and shaped to be received within corresponding holes 184 in shell 174 of the attachment member 120. Once received within their corresponding holes 184, the bosses 182 serve to register the shell 174 on the mount 220 and restrain movement of the shell 174 relative to the mount 220 in the horizontal plane (when viewed with vacuum cleaner 100 in its upright position).

Preferably, as in the example shown, each boss 182 is generally conical, or frusto-conical, in shape so that a proximate end of each boss 182 (adjacent the mount 220) is wider (i.e. has a larger diameter) than the distal end of each boss 182 (spaced apart from the proximate end). Generally, the holes 184 in the shell 174 have a width (or diameter) that corresponds to the widest portion of the bosses 182, for example the base or proximate portion of the bosses 182 in the current example. Having a width (or diameter) of a hole that corresponds to the widest portion of each boss 182 enables the entire boss 182 to be received within its corresponding hole 184. Providing a narrower distal end or tip on each boss 182 may make it easier for a user to position the bosses 182 within their holes 184 when placing the shell 174 onto the mount 220 and may enable the surface of each boss 182 to act as a guiding or cam surface for guiding the shell 174 to its desired mounted position. In other examples, the mount 220 may contain a greater or fewer number of bosses 182 and each boss 182 may have any desired shape (typically corresponding to the shape of the corresponding holes 184), including cubic, rectangular prism and pyramidal.

In some examples the mount 220 also includes a coupling, locking or attachment means for securing the shell 174 to the mount 220, when the shell 174 is seated on the mount 220 (with bosses 182 received within corresponding holes 184). As exemplified in FIGS. 25-31, one example of an attachment means is locking knob 188 that is rotatably connected to the mount 220, such as on protrusion 190, and is secured thereto such as by a screw (not shown). The front, or outer face of the locking knob 188 comprises a pair of tabs 191 that are sized to be graspable by a user to rotate the locking know 188 about the protrusion 190. The rear, or inner face, of the locking knob 188 comprises a channel or groove 189 that is sized to receive the locking peg 180. Operation of the locking knob 188 is described below in relation to FIGS. 29-31. In other examples, the attachment means may be any suitable mechanism, including clips, snaps, magnets, latches or hook and loop type fasteners. Alternatively, the mount 220 could be free from attachment means and the shell 174 could be held in place by gravity when in use.

As exemplified in FIGS. 25-31, the groove 178 is a semi-cylindrical recess formed in shell portion 175*a* that is shaped to at least partially receive the lower portion 216 of the support structure 210. In other examples, the shape of the groove 178 may be any suitable, complimentary shape chosen to fit the lower portion of the support structure 210. In the example illustrated, the groove 178 subtends approximately 180 degrees of arc, while in other examples the groove 178 may subtend a larger or smaller arc, for example 200 degrees or 30 degrees. Having the lower portion 216 at least partially received within or nested within the groove 178 may increase the stability of the shell 174 when placed on the mount 220, which may reduce the lateral shear loading on bosses 182.

Shell 174 also comprises a protrusion or locking peg 180, extending from shell 174. In the example illustrated, the locking peg 180 is located on shell portion 175*a*. In other examples, the locking peg 180 may be located on any suitable portion of the shell 174 and may have any shape or profile that is complimentary to the groove 189 on the rear face of the locking knob 188.

FIG. 29 is an illustration of the attachment member 120 when the shell 174, supporting the hand vacuum cleaner 400, is slightly separated from the mount 220, for example when the shell 174 is in the process of being placed on, or removed from, the mount 220. As shown in this figure, the lower portion 216 is partially received within the groove 178 which may serve to stabilize the shell 174 and may also serve as a locating or positioning means, which may help a user to horizontally align the holes 184 in the shell 174 with the bosses 182 on the mount 220. When the shell 174 is spaced apart from the mount 220 the knob 188 is rotated to its open or unlocked position, as shown.

When the shell 174 is lowered onto the mount 220, as shown in FIG. 29, the shell 174 (and hand vacuum cleaner 400) are supported by an upper face of the mount 220 and the bosses 182. The locking knob 188 is rotated to the unlocked position.

As shown in FIG. 31, to secure the shell 174 to the mount 220, the knob 188 is rotated into its closed or locked position (clockwise as illustrated in FIGS. 29-31), thereby retaining locking peg 180 and restraining vertical movement of the shell 174 relative to the mount 220. As described above, horizontal movement (i.e. in the horizontal plane) of the shell 174 relative to the mount 220 is restrained by the combination of the groove 178 and the bosses 182 received in holes 184. Accordingly, with the knob 188 in the locked position (as shown in FIG. 31) the shell 174 is fixed relative to the mount 220.

In operation, the cleaning unit may be lifted vertically off of attachment member 120 if the lock is engaged. If the lock is not engaged, then the attachment member may be lifted off of the mount 220 and the cleaning unit removed while still in air flow communication with hose 124.

In some examples of the surface cleaning apparatus 100, the mount 220 may be located in a variety of locations along the length of the second portion 216. Preferably, the mount 220 is positioned at approximately the waist height of the intended user (e.g., 2.5-3.5 feet above the floor) so that the user can attached or detach the hand vacuum cleaner 400 from the support structure 210 without bending over. This may decrease the stress and strain experienced by the user when the user removes the hand vacuum cleaner 400 from the support structure 210.

In other examples, as exemplified in FIGS. 32-38, the portable cleaning apparatus 500 can be removably mounted on the lower portion 216 of the handle 210. In such examples, the mount apparatus can be a segment of the lower portion 216, for example segment 216*a*, that is configured to be received within a corresponding slot or aperture in the portable cleaning apparatus 500, for example a portion of the coupling chamber 590. The portable cleaning apparatus 500 is configured so that it can be stably supported on the lower portion 216, with or without the use a locking mechanism. In the present example, the coupling is such the segment 216*a* is received sufficiently far within the coupling chamber 590 of the portable cleaning apparatus 500 that the coupling can support/resist both shear and bending loads. To remove the portable cleaning apparatus 500 from the support structure 210, a used can lift the portable cleaning apparatus 500 relative to the lower portion 216 until the segment 216*a* is clear from the coupling chamber 590.

The surface cleaning head 300 serves as a base portion of the vacuum cleaner 100 and is preferably in rolling contact with the surface to be cleaned. When the vacuum cleaner is 100 in an upright position (as exemplified in FIGS. 1, 2, 4, 5, 15, 16, 20, 21-24 and 32) the surface cleaning head 300 is supported by optional main or rear wheels 320 and/or optional front wheels (not shown). Any surface cleaning head may be used.

In some examples, as exemplified in FIG. 3*a*, the vacuum cleaner 100 may comprise an additional support wheel 321 that is provided on the support structure 210 to provide additional rolling support when the vacuum cleaner 100 is moved into an angled position during use. In other examples, the surface cleaning head 300 may include a greater or fewer number of wheels. Preferably, lower portion 216 is rotatably mounted to the cleaning head. Accordingly, a user may rotate grip 212 clockwise or counterclockwise to assist in steering the cleaning head.

The surface cleaning head 300 also comprises a dirty air inlet 310 that is connected in fluid communication with a dirty air outlet 312 by one or more dirty air conduits (not shown). Preferably, the dirty air inlet is an air flow chamber wherein at least a portion of the lower side is open.

The dirty air outlet 312 may be coupled, optionally removably coupled, to the upstream end of the conduit, preferably via a flexible hose 124, that extends from the dirty air outlet 312 of the surface cleaning head 300 to the upright section, such as the attachment member air inlet 126. The fluid pathway may continue through the attachment member passageway 129, which terminates in attachment member air outlet 127, and through attachment member air outlet 127 which mates with the opening 438 of the portable cleaning apparatus 400.

In some examples, as exemplified in FIGS. 15-19, the surface cleaning head 300 includes a hollow conduit member 330 and a second air conduit 334. As exemplified in FIGS. 17-19, one example of the second air conduit 334 is a second flexible hose 335. In the preferred arrangement shown, the dirty air outlet 312 of the surface cleaning head 300 is connected to the second or upstream flexible hose 335 and the second flexible hose 335 extends from the dirty air outlet 312, through the hollow conduit member 330, through the hollow housing 268 to the upper collar 272. The downstream end of the second flexible hose 335 may be fixedly connected to the upper collar 272, or it may have a fitting that seats upon a surface of the upper collar 272 preventing the second flexible hose 335 from retracting within the hollow housing 268 while leaving the downstream end of the second flexible hose 335 free to extend upward, away from the upper collar 272.

The second flexible hose 335 forms part of the continuous airflow passageway that connects the dirty air outlet 312 of the surface cleaning head 300 to the opening 438 on the hand vacuum cleaner 400. In accordance with a fourth aspect that may be used by itself or with any other aspect, to establish the continuous airflow passageway, the downstream end of the second upstream flexible hose 335 may be connected to the upstream end of the downstream flexible hose 124. The connection between the flexible hose 124 and the downstream end of the second flexible hose 335 is preferably a detachable connection so that the flexible hose 124 can be detached from the surface cleaning head 300 as described above.

Optionally, in a fifth aspect, which may be used by itself or with any one or more other aspects, the second flexible hose 335 is also an extensible, or stretchable, hose that can extend when pulled on by the user. In some examples, the second flexible hose 335 is a stretch hose and may have a stretched length to non-stretched length ratio of between 2:1-6:1. In examples where the second flexible hose 335 is not stretchable, when a user removes the hand vacuum cleaner 400 from its mount during use, the maximum distance that the hand vacuum cleaner 400 can be separated from the support structure 210 and the surface cleaning head 300 is determined by the length of the flexible hose 124. However, in some instances, a user may wish to move the hand vacuum cleaner 400 a greater distance from the support structure 210, for example to pass the surface cleaning head 300 under a bed or other large piece of furniture. When a stretchable second flexible hose 335 is used, the downstream end of the second flexible hose 335 can unseat from the upper collar 272 and extend away from the bracket 260, whereby some of hose 335 may pass through housing 268 thereby lengthening the airflow conduit connecting the hand vacuum cleaner 400 to the surface cleaning head 300 and allowing the hand vacuum cleaner 400 to be moved further from the support structure 210 in use. Accordingly, it will be appreciated that some or all of the conduit that may be extended to provide additional length for an air flow passage may be stored on the surface cleaning head 300.

It will be appreciated that lower section 216 may be rotatably mounted on cleaning head 300 without hose 335 extending through a housing 268. Further, a housing 268 may be used even if lower section 216 is not rotatably mounted to cleaning head 300. Such a housing need not be pivotally mounted to surface cleaning head.

Preferably, the second flexible hose 335 is also resilient so that it will return to its original, un-stretched length when it is released by the user. The resilience of the second flexible hose 335 may tend to retract the second flexible hose 335 through the hollow housing 268 and the hollow conduit member 330 and may serve to re-seat the downstream end of the second flexible hose 335 on the upper collar 272. In this example, the second flexible hose 335 functions as a variable length air conduit and may reduce the need for a user to add extra hoses or conduit members to the vacuum 100 during use.

To allow for easy and repeated extension of the second flexible hose 335, the second flexible hose 335 may be sized to freely pass through both the hollow conduit member 330 of the surface cleaning head 300 and the hollow housing 268 of the bracket 260.

In the example shown in FIG. 15-19, the hollow housing 268 is integral the bracket 260 and also serves as the coupling means that connects the lower portion 216 to the surface cleaning head 300. As shown, the coupling between the lower portion 216 and the surface cleaning head 300 may be the telescoping or overlapping engagement of the lower opening 270 over the surface cleaning head 300 hollow conduit member 330. In other examples, the coupling or attachment between the lower portion 216 and the surface cleaning head 300 may be any type of connection including a threaded connection, clamps or tabs. The connection between the lower portion 216 and the surface cleaning head 300 may be fixed or selectively releasable. An advantage of providing a single, downward facing coupling point 266 may be the fact that a single coupling point 266 can be pivotally and rotationally connected to the surface cleaning head 300. Further, the hollow conduit member 330 may be pivotally connected to the surface cleaning head 300, as exemplified in FIGS. 15-19, and in other examples, the hollow conduit member 330 may be fixedly connected to the surface cleaning head 300, or integrally formed therewith.

As shown, the hollow housing 268 may be integral with the bracket 260 and provide both a hollow passageway and an attachment point. However, in other examples, the hollow housing 268 may be external the bracket 260 and may be formed from a separate conduit. Similarly, the air flow conduit 110 connecting the attachment member 120 to the second flexible hose 335 may be the flexible hose 124 or any other suitable conduit, including flexible conduits, rigid conduits, conduits integral with the handle and conduits external the handle.

Optionally, the ribs 256 (or another portion of the second portion 216) may be surrounded by a housing or shell. The housing may provide structural strength to the second portion 216 or it may merely provide an improved aesthetic appearance of the vacuum 100, or both. If a housing is formed around a section of the second portion 216 (or any other section of the handle 210 or support structure 210) the mount for supporting the hand vacuum (for example the mount 220 or the saddle flanges 260) may be within a recess in the housing. Providing a recess in the housing for receiving the hand vacuum may create a more integrated or seamless visual appearance when the hand vacuum is mounted to the support structure 210; it may also improve the rigidity of the support structure 210.

In a sixth aspect, which may be used by itself or with any one or more other aspects when the cleaning unit, for example hand vacuum cleaner 400, is mounted to the backbone, the centre of gravity of the backbone and hand vacuum cleaner 400 combined is preferably below a plane P extending from the axle of rear wheel 320 to the upper end of upper portion 214 (as exemplified in FIG. 17), thereby improving maneuverability of surface cleaning head 300. As exemplified, this may be achieved by wishbone portion 250 extending forwardly to provide a mount for upper portion 214 (i.e. the handle) at a forward point of the backbone and passageway 268 extending rearwardly. It will be appreciated that other constructions, such as those exemplified in FIGS. 1-5 or FIGS. 20 and 21-31, may be used to position the centre of gravity behind the plane. For example, as best shown in FIG. 5, one example of the lower portion 216 includes an upper end that is connected to the hinge 218 such that the upper portion 214 is drivingly connected to the surface cleaning head 300. In this construction the lower end includes a step-back or kinked-back portion 215. The step-back portion 215 enables the mount 220 to be positioned sufficiently behind the rear wheels 320 such that the centre of gravity of the combination of the support structure 210 and the hand vacuum cleaner 400 is below the plane P. As a result of this configuration, the surface cleaning apparatus 100 may be more stable when rotated and maneuvered by the user, especially when upper portion 214 is rotated about hinge 218. Specifically, locating the centre of gravity of the combination of the hand vacuum cleaner 400 and the support structure 210 below the plane P may tend to reduce the over rotation of the support structure 210 or over-steer of the vacuum 100 in use, and may reduce the strain on a user's arm and wrist.

It will be appreciated that the dual hose construction (i.e. the flexible hose 124 and the second flexible hose 335 of FIG. 15-19) may be used in combination with any example disclosed herein or by itself in a surface cleaning apparatus. Similarly, the positioning of a removably mounted portable surface cleaning apparatus with a low centre of gravity may be used in combination with any example disclosed herein or by itself in a surface cleaning apparatus.

Preferably, the cleaning unit is a portable surface cleaning apparatus, and more preferably a hand vacuum cleaner, wherein the portable surface cleaning apparatus optionally has a nozzle having an open sided air flow chamber. It will be appreciated that the cleaning unit may be of any construction and may use any particular air treatment member (e.g., one or more cyclones comprising one or more cyclonic cleaning stages and/or one or more filters). Further, the cleaning unit may alternately, or in addition, selectively receive an auxiliary cleaning tool.

Referring now to FIGS. 6-14, examples a hand vacuum cleaner 400 and the attachment member 120 of the vacuum 100 are shown in more detail.

In some examples, the surface cleaning unit can be a hand vacuum cleaner 400 that can be operated as the vacuum suction supply for the vacuum 100 and it can be operated as a stand alone hand vacuum cleaner, that is movable along a surface to be cleaned by gripping and maneuvering handle 402, when it is removed from, or detached from the support structure 210. The hand vacuum cleaner 400 includes an upper portion 404, a lower portion 406, a front 408, and a rear 410. In the example shown, maneuvering handle 402 is provided at the upper portion 404. In alternate examples, maneuvering handle 402 may be provided elsewhere on the vacuum cleaner 400, for example at the rear 410.

In the example shown, the hand vacuum cleaner 400 comprises a nozzle 412 and a cyclone unit 414, which together preferably form a cleaning head portion 416 of the hand vacuum cleaner 400. In the example shown, the cleaning head portion 416 is provided at the front 408 of the hand vacuum cleaner 400.

Nozzle 412 comprises a dirty air inlet 418, through which dirty air is drawn into the portable cleaning apparatus 400, and when used as a hand vacuum cleaner the nozzle 412 directly engages a surface to be cleaned. An airflow passage extends from the dirty air inlet 418 to a clean air outlet 420 of the hand vacuum cleaner 400. In the example shown, clean air outlet 420 is at the rear 410 of the hand vacuum cleaner 400. It will be appreciated that clean air outlet may optionally be connected to a fluid conduit provided in the floor cleaning unit.

Cyclone unit 414 is provided in the airflow passage, downstream of the dirty air inlet 418. In the example shown, the cyclone unit 414 comprises one cyclone 422, and one dirt chamber 424. In alternate examples, the cyclone unit 414 may include more than one cyclone, and more than one dirt chamber. Further, the cyclones may be arranged in stages, and may be provided in parallel or in sequence. Alternately, or in addition, one or more filters or other dirt separation members may be used.

In the example shown, the nozzle 412 is positioned at the lower portion 406 of the portable cleaning apparatus 400. More preferably, as in the example shown, nozzle 412 is positioned at the bottom of the portable cleaning apparatus 400, and is preferably beneath the cyclone unit 414 when used as a hand vacuum cleaner and is between the cyclone unit 414 and the mount 220 when attached to the support structure 210. Further, as in the example shown, the nozzle 412 is preferably fixedly positioned at the lower portion 406 of the portable cleaning apparatus 400. That is, the nozzle 412 is not movable with respect to the remainder of the portable cleaning apparatus 400, and is fixed at the lower portion 106 of the portable cleaning apparatus 400. As shown in FIGS. 7 and 8, nozzle 412 has a width $W_N$ and, as shown in FIG. 11, coupling plate 123 has a width $W_p$ that is generally the same as width $W_N$.

Nozzle 412 exemplifies a particular design for an open sided nozzle. Open sided nozzle 412 has an open side that faces the surface to be cleaned when the nozzle is placed against a surface to be cleaned. Accordingly, nozzle 412 defines an air flow chamber that has an open lower side. In operation, air will flow longitudinally through the air flow chamber to an air exit. It will be appreciated that only part of the nozzle may have an open lower side. Alternately, all of the nozzle, from an air inlet end to the air outlet, may have an open lower side. It will be appreciated that various other design may be used. An advantage of using an open sided nozzle is that the nozzle may be the member that is used to mount hand vacuum cleaner 400 to mounting member 120.

Referring now to FIGS. 8-14, nozzle 412 comprises an upper nozzle wall 426. In the example shown, the upper nozzle wall 426 comprises a portion 419 of a wall 415 of the cyclone unit. Nozzle 412 further preferably comprises a depending wall 428 extending downwardly from the upper nozzle wall 426. The depending wall 428 is generally U-shaped. The height of the depending wall may vary. The open end of the U-shape defines an open side wall 430 of the nozzle 412, and forms the dirty air inlet 418 of the portable cleaning apparatus 400. In the example shown, the open side wall 430 is provided at the front of the nozzle 412 and forms a portion of a flow passage that is in communication with the opening 438. When in use as a hand vacuum, optional wheels 435 are in contact with a surface and the open side wall 430 sits above and is adjacent a hard surface to be cleaned. It will be appreciated that depending wall 428 may be positioned only rearward of opening 438. Alternately, or in addition, depending wall 428 may be provided adjacent the lateral sides of opening 438. The depending walls may be discrete walls or they may be joined together as exemplified. The walls may be continuous or discontinuous.

In the example shown, the lower end 432 of the depending wall 428 defines an open lower end 434 of the nozzle 412. The open lower end 434 extends to the front 408 of the hand vacuum cleaner 400, and merges with the open side 430. In use, the open lower end 434 faces a surface to be cleaned. In the example shown, a plurality of wheels 435 are mounted to the depending wall 428, and extend below the lower end 432 of the depending wall 428. Accordingly, when in use as a hand vacuum, when wheels 435 are in contact with a surface, the lower end 432 of the depending wall 428 is spaced from a surface to be cleaned, and the space between the lower end of the depending wall 428 and the surface to be cleaned form a secondary dirty air inlet to the portable cleaning apparatus 400 when used as a hand vacuum.

The upper nozzle wall 426, depending wall 428, and open lower end 434 of the nozzle 412 define an airflow chamber 436 of the nozzle. An opening 438 is preferably provided in the upper nozzle wall 426, and is in communication with the airflow chamber 436. When in use as a hand vacuum, the wheels 435 are in contact with a surface, the opening 438 faces a surface to be cleaned, air enters the dirty air inlet 418, passes horizontally through the airflow chamber 436, and passes into the opening 438. Opening 438 is in communication with a cyclone inlet passage 439, which is in communication with a cyclone air inlet 440 of cyclone 422. In some embodiments, opening 438 need not be in upper wall 426.

Nozzle 412 and attachment member 120 are configured such that attachment member 120 may form part of the air flow conduit to opening 438 when attachment member 120 is mounted to hand vacuum cleaner 400. For example, when the portable cleaning apparatus 400 is used in combination with the support structure 210 and the surface cleaning head 300, the opening 438 in the nozzle 412 is in sealed, fluid communication with the air outlet 127 of the attachment member 120. By way of this connection, a continuous fluid pathway is established between the dirty air input 310 of the surface cleaning head 300 and the opening 438.

It will be appreciated that examples of the attachment member 120 may be removably mounted to nozzle 412 by any engagement means known in the connecting arts. For example, pivoting arms may be used, see for example FIG. 14, or sliding engagement may be used, see for example FIGS. 20 and 26. Further, attachment member 120 may be of any configuration. Attachment member 120 may be part of, or may be connected to, an accessory cleaning tool by any means, such as a flexible hose. The flexible hose may be hose 124 if hose 124 is removably mounted to the floor cleaning unit.

As exemplified in FIGS. 1-19, one example of the attachment member 120 is removably engaged with nozzle 412 by the engagement of pivoting arms in slots provided on nozzle 412. Accordingly, for example, nozzle 412 may also include a slot 490 defining a recess in the depending wall 428 that is adjacent the upper nozzle wall 426. The slot 490 preferably extends continuously along the U-shaped portion of the nozzle depending wall 428 and may be bounded at each end by corners 492. The attachment member 120 includes two arms 150 each having a shoulder 154 and being pivotally connected to the coupling plate 123 using pins 156 (alternatively, the arms 150 could be resilient). FIG. 14 is a partially exploded view of the attachment member 120, illustrating one example of the rotational connection between the coupling 142 and the collar 140. In the example shown, the coupling 142 comprises a cylindrical body wall that passes through an opening in the collar 140. Once the coupling 142 had been inserted into the collar 140 it is retained using fastening clip 143. The combination of the coupling plate 123 and the arms 150 may also be described as connecting portion, mounting portion or nozzle mounting portion of the attachment member 120.

In order to assemble the mount on nozzle 412, coupling plate 123 may be slid into the open end of airflow chamber 436. Accordingly, when the coupling plate 123 of the attachment member 120 is slid into the airflow chamber 436, the arms 150 are pressed together by the nozzle 412 walls until the point when arms 150 are aligned with slot 490 (i.e. when the shoulders 154 are advanced past the corners 492). When the arms 150 are aligned with the slot 490, the attachment member 120 is "clicked-in" or locked in place when the arms 150 spread apart and the shoulders 154 of the arms 150 become lodged behind the corners 492 of slot 490. The arms 150 may be manually separated or the attachment member may include a biasing means (not shown) that biases the arms 150 apart. With the arms 150 in the spread configuration the attachment member 120 cannot be slidingly removed from the nozzle 412. When a user wishes to detach the attachment means 120 from the nozzle 412 the user may squeeze upstanding tabs 152 together thereby allowing the shoulders 154 to slide past the corners 492. The mount may alternately be inserted by squeezing upstanding tabs 152 together so that plate 123 may be inserted in chamber 436.

When the hand vacuum cleaner 400 is coupled to the attachment member 120 the airflow chamber 436 may receive, and be partially filled with the coupling plate 123 (as exemplified in FIG. 1-5, 15-19, 20 or 21-31) of the attachment member 120. The coupling plate 123 is preferably shaped to be slidingly received within the airflow chamber 436.

Insertion of the coupling plate 123 into the airflow chamber 436 serves to register the air outlet 127 with the nozzle opening 438. As shown, the air outlet 127 has a width $W_o$ and a length $L_o$ that are preferably the same as the width $W_o$ and a length $L_o$ of the opening 438. A sealing gasket 123 may provided at the juncture of the openings.

The attachment member 120 and the nozzle 412 may alternately, or in addition also include a plurality of magnets 158 that magnetically couple the attachment member 120 to the nozzle 412 to improve the connection between them and ensure that air outlet 127 is properly registered with opening 438. It will be appreciated that, in an alternate embodiment, only magnets maybe used. Other mounting means may be used. For example, a plurality of latches may be used or air outlet 127 may extend into opening 438.

As exemplified in FIGS. 24-27, the cleaning unit may be secured in position by sliding engagement. As exemplified, a coupling plate 123 is configured to be slidingly received within a portion of the nozzle of the surface cleaning apparatus, and is sized so that the air outlet 127 is registered with the air inlet of the hand vacuum cleaner 400 when coupled. As exemplified, hand vacuum cleaner 400 may be held on the coupling plate 123 using only gravitational forces once it is slid into position.

Clean air outlet 420 is provided downstream of the cyclone unit 414, suction motor and optional post-motor filter contained optionally within the cleaner body 460. Clean air outlet 420 may comprise a plurality of apertures formed in housing 461. The cleaner body 460 may also contain one or more of a separation plate, a dirt chamber, a pre-motor filter and a plurality of connecting fluid conduits or passageways.

In the examples shown, cleaner body 460 is removably mounted to head portion 416. For example, cleaner body 460 may be entirely removable from head portion 416, or pivotally mounted to head portion 416. Accordingly, cleaner body 460 and head portion 416 may be separated in order to provide access to the interior of cleaner body 460 or head portion 416. This may allow a pre-motor filter to be cleaned, changed, or serviced, or the motor to be cleaned, changed or serviced. Alternately, head portion 416 may be cleaned or serviced.

For example, any dirt stuck in the enclosed passages portable cleaning apparatus 400 may be removed. Alternately, a replacement cleaner body 460 or head portion 416 may be provided, and may be mounted to an existing head portion 416 or cleaner body 460, respectively.

One or more additional rear wheels 480 may be mounted to housing 461 at lower portion 406, and may be used in conjunction with wheels 435 when the portable cleaning apparatus 400 is used as a hand vacuum. When the portable cleaning apparatus 400 is attached to the support structure 210 the additional wheel 480 preferably engages with the mount bracket 224 and partially supports the portable cleaning apparatus 400 on the handle 210 as described above.

Preferably, as exemplified in FIGS. 11 and 26, in accordance with a seventh aspect that may be used by itself or with one or more other aspects, the portion of the attachment member 120 that is used to mount the attachment member to the backbone may also comprise part of the air flow path from surface cleaning head 300 to hand vacuum cleaner 400. For example, as exemplified in FIG. 11, the attachment member 120 may include a mounting portion or collar 140 that includes a coupling 142 and defines a channel 144. The collar 140 is connected to the airflow passageway 128, or alternatively may be connected directly to the air conduit 110. Optionally, the coupling 142 is a rotatable coupling that allows the airflow passageway 128 to rotate relative to the collar 140.

In another example, as exemplified in FIG. 27, the attachment member 120 comprises a shell 174 having two complimentary shell portions 175*a* and 175*c*, which cooperate to define the outer surfaces of the shell 174. Shell portion 175*a* comprises a coupling 176 for joining the attachment member airflow passage way 128 to the shell 174 and a groove 178 for receiving a portion of the lower portion 216.

The coupling 176 may be any type of suitable coupling including a rigid coupling, a fixed coupling, a releasable coupling and a rotatable coupling. The coupling 176 comprises a central opening or aperture that forms part of the continuous airflow conduit or passage way between the air inlet 126 and the air outlet 127 formed in coupling plate 123 (which, in the example illustrated is formed from complimentary portions 123*a*, 123*b* and internal members 177). The coupling 176 and the air outlet 127 are connected in fluid communication by internal shell conduit 175*c* (shown comprising two portions, but optionally formed from more than two portions or a single member). Therefore, in the present example, as best illustrated in FIG. 27, dirty air from the surface cleaning head 300 travels into air inlet 126, through airflow passageway 128, through shell portion 175*a*, through internal shell conduit 175*c* and exits via air outlet 127 formed through shell portion 174 and the integral coupling plate 123. In the example shown, airflow passageway 128 is connected to flexible hose 124 using an annular insert 179 that comprises clips 160. In other examples, the clips 160 may be integral the airflow passageway 128.

The upstream end of the airflow passageway 128 defines the air inlet 126. In operation, the air inlet 126 is preferably coupled to the airflow conduit 110 that extends to the surface cleaning head 300 (the flexible air hose 124 in the example shown). As exemplified in FIGS. 10-14, the air inlet 126 is releasably coupled to the flexible air hose by clips 160. Downstream of the coupling 142 an enclosed airflow passage connects the airflow passage 128 to the air outlet 127. It will be appreciated that the attachment member 120 need not comprise part of the air flow passage. For example, coupling 142 may be located out of the flow path defined by passageway 128. Alternately, plate 123 need not have opening 127. Accordingly, attachment member may have a first part that is secured to hand vacuum cleaner 400 and a second distinct part that completes that air flow passage from surface cleaning head 300 to opening 438.

The airflow passageway 128 may be flexible or rigid and may be generally straight or may have a curved shape, as shown. Preferably, the curved airflow passageway 128 subtends fewer than 45 degrees.

It will be appreciated that the removable cleaning unit or hand vacuum cleaner and the bendable wand may be used by themselves or with any other feature disclosed herein. In addition, any of the features disclosed herein may be used by themselves, or with any other feature, and may include the removable surface cleaning unit and the bendable wand. It will be appreciated that the removable surface cleaning unit may comprise the operating components of the surface cleaning apparatus (the motor and cyclones/filters) or only some of them and is preferably capable of being used as a self contained portable cleaning apparatus if removed from physical contact with and air flow communication with the upright vacuum cleaner.

What has been described above has been intended to be illustrative of the invention and non-limiting and it will be understood by persons skilled in the art that other variants and modifications may be made without departing from the scope of the invention as defined in the claims appended hereto.

What is claimed is:

1. A reconfigurable upright surface cleaning apparatus comprising, when configured in an upright mode:

(a) a surface cleaning head having a dirty air inlet;

(b) a support structure moveably mounted to the surface cleaning head between a storage position and a floor cleaning position;

(c) a cleaning unit mounted to the support structure, the cleaning unit comprising a suction motor and an air treatment member;

(d) a wand mounted to a portion of the support structure which supports the cleaning unit, wherein the wand is located downstream from the surface cleaning head, the wand having an inlet end that is positioned in the portion of the support structure; and, (e) a flexible air flow conduit positioned downstream of the wand;

wherein the wand is removably mountable to the support structure and the wand is remountable to the support structure while the cleaning unit remains in position on the support structure and, wherein the cleaning unit is removably mountable to the support structure and the cleaning unit is removable while the wand remains in position on the portion of the support structure and the portion of the support structure remains connected to the surface cleaning head, wherein the upright surface cleaning apparatus is convertible to a portable mode in which the cleaning unit is removed from the support structure, the wand is mounted to the support structure and the cleaning unit is in air flow communication with the surface cleaning head and, wherein the upright surface cleaning apparatus is also convertible to an above floor cleaning mode in which the cleaning unit is mounted to the support structure, the wand has been removed from the support structure, the wand is positioned upstream of and in fluid communication with the flexible air flow conduit and the flexible air flow conduit is positioned upstream of and in fluid communication with the cleaning unit and the portion of the support structure remains mounted to the surface cleaning head when the wand is removed.

2. The upright surface cleaning apparatus of claim 1, wherein all of the wand is removed when the upright surface cleaning apparatus is converted to the above floor cleaning mode.

3. The upright surface cleaning apparatus of claim 2, wherein the cleaning unit is spaced from the surface cleaning head when mounted to the support structure.

4. The upright surface cleaning apparatus of claim 1, wherein the support structure further comprises an upper portion including a hand grip and a lower portion that comprises the portion of the support structure and comprises an up flow duct, the up flow duct is moveably mounted to the surface cleaning head and the upper portion and cleaning unit are mounted to the up flow duct.

5. The upright surface cleaning apparatus of claim 1, wherein the support structure comprises an upper portion having a handgrip and a lower portion movably mounted to the surface cleaning head, the lower portion comprises the portion of the support structure and has an upper opening in fluid flow communication with the dirty air inlet, and the wand is in air flow communication with the upper opening when mounted to the lower portion.

6. The upright surface cleaning apparatus of claim 5, wherein the wand is received within the upper opening when mounted to the support structure.

7. The upright surface cleaning apparatus of claim 5, wherein the cleaning unit is removably mounted to an exterior of the portion of the support structure and the wand is received within the upper opening when mounted to the support structure.

8. The upright surface cleaning apparatus of claim 1 wherein, the inlet end of the wand is receivable within the portion of the support structure and, when the wand is mounted to the portion of the support structure, the inlet end is located below an upper end of the cleaning unit when the cleaning unit is mounted to the portion of the support structure.

9. The upright surface cleaning apparatus of claim 1, wherein the inlet end of the wand is positioned in the portion of the support structure to which the cleaning unit is attached when the wand is mounted to the support structure and the cleaning unit is mounted to the portion of the support structure.

10. The upright surface cleaning apparatus of claim 1, wherein when the upright surface cleaning apparatus is converted to the portable mode, the portion of the support structure remains mounted to the surface cleaning head when the wand is removed.

11. The upright surface cleaning apparatus of claim 1, wherein the wand is removable while the cleaning unit remains mounted to the support structure.

* * * * *